US011118303B2

(12) United States Patent
Ahamad et al.

(10) Patent No.: US 11,118,303 B2
(45) Date of Patent: Sep. 14, 2021

(54) VARIOUS HINGE BRACKETS AND A HINGE RECEIVER FOR A LAUNDRY APPLIANCE

(71) Applicant: WHIRLPOOL CORPORATION, Benton Harbor, MI (US)

(72) Inventors: Iftkhar Ahamad, Pune Maharashtra (IN); Neyda Eliza Leon Lopez, Nuevo Leon (MX); Raghavendran Prabhakaran, Pune (IN); Suraj Dilip Shelar, Maharshtra (IN)

(73) Assignee: Whirlpool Corporation, Benton Harbor, MI (US)

( * ) Notice: Subject to any disclaimer, the term of this patent is extended or adjusted under 35 U.S.C. 154(b) by 46 days.

(21) Appl. No.: 16/573,280

(22) Filed: Sep. 17, 2019

(65) Prior Publication Data

US 2020/0199805 A1 Jun. 25, 2020

Related U.S. Application Data

(60) Provisional application No. 62/784,602, filed on Dec. 24, 2018.

(51) Int. Cl.

| | |
|---|---|
| ***D06F 39/14*** | (2006.01) |
| ***E05D 1/04*** | (2006.01) |
| ***D06F 37/28*** | (2006.01) |

(52) U.S. Cl.

CPC ..... *D06F 39/14* (2013.01); *D06F 37/28* (2013.01); *E05D 1/04* (2013.01); *E05Y 2900/312* (2013.01)

(58) Field of Classification Search

CPC . D06F 39/14; D06F 37/28; E05D 1/04; E05Y 2900/312

See application file for complete search history.

(56) References Cited

U.S. PATENT DOCUMENTS

| | | | | |
|---|---|---|---|---|
| 4,115,901 A | | 9/1978 | Schmidt | |
| 4,787,121 A | * | 11/1988 | Racenis | D06F 39/14 16/356 |
| 4,914,781 A | | 4/1990 | Sokn et al. | |
| 8,444,234 B2 | * | 5/2013 | Kim | E05D 11/06 312/228 |

(Continued)

FOREIGN PATENT DOCUMENTS

| | | | |
|---|---|---|---|
| FR | 2668180 | A1 | 4/1992 |
| JP | 2015204928 | A | 11/2015 |

(Continued)

*Primary Examiner* — Daniel J Rohrhoff

(74) *Attorney, Agent, or Firm* — Price Heneveld LLP

(57) ABSTRACT

A hinge bracket to couple a hinge to a lid of a laundry appliance comprising: an elongated slot receiving a connector portion of a hinge; first fastener receivers extending from the elongated slot laterally inward toward a midline of a cabinet of the laundry appliance and configured to cooperate with fastener receivers of the hinge to receive fasteners that fasten the hinge to the hinge bracket; second fastener receivers on an opposite side of the hinge bracket as the first fastener receivers and configured to cooperate with the fastener receivers through a C-shaped lip of the lid to receive fasteners fastening the lid to the hinge bracket; and an indented portion formed laterally away from the elongated slot and facing the curved portion of the hinge. The laundry appliance can further include a hinge receiver to couple the hinge to a cabinet.

20 Claims, 46 Drawing Sheets

(56) References Cited

U.S. PATENT DOCUMENTS

| | | | | |
|---|---|---|---|---|
| 8,763,431 | B2 * | 7/2014 | Kim | D06F 23/04 68/3 R |
| 10,604,881 | B1 * | 3/2020 | Allen | D06F 34/28 |
| 10,724,284 | B2 * | 7/2020 | Collene | E05F 3/104 |
| 10,883,296 | B2 * | 1/2021 | Han | E05F 3/20 |
| 2006/0254323 | A1 * | 11/2006 | Kim | D06F 39/14 68/235 R |
| 2017/0130502 | A1 * | 5/2017 | Collene | D06F 39/14 |
| 2017/0191210 | A1 | 7/2017 | Jung et al. | |

FOREIGN PATENT DOCUMENTS

| | | | | |
|---|---|---|---|---|
| RU | 2448208 | C1 | 4/2012 | |
| WO | WO-2018004295 | A1 * | 1/2018 | D06F 37/28 |

* cited by examiner

VARIOUS HINGE BRACKETS AND A HINGE RECEIVER FOR A LAUNDRY APPLIANCE

CROSS-REFERENCE TO RELATED APPLICATION

This application claims priority to and the benefit under 35 U.S.C. § 119(e) of U.S. Provisional Application No. 62/784,602, filed on Dec. 24, 2018, entitled, "VARIOUS HINGE BRACKETS AND A HINGE RECEIVER FOR A LAUNDRY APPLIANCE," the disclosure to which is hereby incorporated herein by reference in its entirety.

BACKGROUND

The present device generally relates to laundry appliances that include hinge brackets and a hinge receiver, and more specifically, to hinge brackets and a hinge receiver for use in operably coupling a lid of the laundry appliance to a cabinet of the laundry appliance.

Hinges are sometimes unable to connect directly to the lid of the laundry appliance. In addition, if the lid rotates too far from a closed position to past a desired open position, the hinge, the lid, and other aspects of the laundry appliance (such as a user interface) can become damaged. Therefore, there is a need for hinge brackets to connect the hinges to the lid, as well as a hinge receiver that resists the lid from rotating past the desired open position. In addition, there is a need for laundry appliances that incorporate such hinge brackets and hinge receivers. Further, there is a need for laundry appliances that incorporate such hinge brackets and hinge receivers for use with a lid that defines the lateral edges of the laundry appliance when the lid is in a closed position.

SUMMARY

In at least one aspect, a laundry appliance comprises: a cabinet having a midline; a chamber disposed within the cabinet, and configured to hold an article of clothing for washing or drying; an opening into the chamber; a lid selectively movable to, from, and between a closed position that prevents access to the opening, and an open position that allows access to the opening, the lid having a C-shaped lip having an edge that extends inward when the lid is in the closed position creating a space between a top wall of the lid and the edge of the lip, and fastener receivers through the C-shaped lip; a hinge including: a first end extending laterally into a hinge receiver of the cabinet in a direction towards the midline of the cabinet; a connecter portion having fastener receivers, the connector portion extending at least approximately orthogonally to the first end; and a curved portion between the first end and the connector portion, the curved portion extending laterally further away from the midline than the connector portion; and a hinge bracket coupling the hinge to the lid, the hinge bracket including: an elongated slot receiving the connector portion of the hinge; first fastener receivers extending from the elongated slot laterally inward toward the midline and configured to cooperate with the fastener receivers of the hinge to receive fasteners that fasten the hinge to the hinge bracket; second fastener receivers on an opposite side of the hinge bracket as the first fastener receivers that extend laterally inward toward the midline and configured to cooperate with the fastener receivers through the C-shaped lip of the lid to receive fasteners fastening the lid to the hinge bracket; and an indented portion formed laterally away from the elongated slot and facing the curved portion of the hinge. In an embodiment, the first fastener receivers and the second fastener receivers of the hinge bracket are parallel but not collinear. In an embodiment, the hinge bracket further includes a bottom side that faces downward when the lid is in the closed position and an opening into the elongated slot that is disposed at the bottom side. In an embodiment, the opposite side of the hinge bracket is nested into the C-shaped lip of the lid. In an embodiment, the cabinet includes a top portion, and the lid having a first lateral side, a second lateral side, and a front side that are disposed above the top portion of the cabinet when the lid is in the closed position. In an embodiment, the top wall, the C-shaped lip, and the edge of the lip of the lid are adjacent to the top side, the opposite side, and the bottom side of the hinge bracket respectively. In an embodiment, the curved portion of the hinge projects laterally outward from the perspective of the midline toward the C-shaped lip of the lid.

In at least another aspect, a laundry appliance comprises: a cabinet having a midline; a chamber disposed within the cabinet, and configured to hold an article of clothing for washing or drying; an opening into the chamber; a lid selectively movable to, from, and between a closed position that prevents access to the opening, and an open position that allows access to the opening, the lid having a C-shaped lip having an edge that extends inward when the lid is in the closed position creating a space between a top wall of the lid and the edge of the lip, and fastener receivers through the C-shaped lip; a hinge including: a first end extending laterally into a hinge receiver of the cabinet in a direction towards the midline of the cabinet; a connecter portion having fastener receivers, the connector portion extending at least approximately orthogonally to the first end; and a curved portion between the first end and the connector portion; and a hinge bracket coupling the hinge to the lid, the hinge bracket including: an elongated slot receiving the connector portion of the hinge, the elongated slot having a first surface opposing a second surface, the connector portion of the hinge disposed between the first surface and the second surface; at least a portion of the hinge bracket is disposed in the space of the lid, with a bottom side that faces the edge of the C-shaped lip and a top side that faces the top wall of the lid; fastener receivers that cooperate with the fastener receivers through the C-shaped lip to receive fasteners to fasten the lid and the hinge bracket together. In an embodiment, the hinge bracket further includes snap-fit features extending outward from the bottom side. In an embodiment, the lid further includes snap-fit receivers through the C-shaped lip receiving the snap-fit features of the hinge bracket. In an embodiment, the cabinet has a top portion, and the lid has a first lateral side, a second lateral side, and a front side that are disposed above the top portion of the cabinet when the lid is in the closed position. In an embodiment, the hinge bracket includes a first side that faces toward the midline, and a second side that faces the C-shaped lip. In an embodiment, the fastener receivers of the hinge bracket extend from the second side, through the first surface of the elongated slot, and through the second surface of the elongated slot, so that the fasteners extend through the fastener receivers of the lid, through the second side, the first surface, the fastener receivers of the hinge, and through the second surface, to fasten the lid, the hinge bracket, and the hinge together. In an embodiment, the hinge bracket includes a first side that faces toward the midline, and a second side that faces the C-shaped lip. In an embodiment, the fastener receivers of the lid are disposed at a portion of the C-shaped lip that is parallel to the top wall of the lid. In an embodiment, the fastener receivers of the hinge bracket extend from the first side, through the second surface of the elongated slot, and through the first surface of the elongated slot, so that the fasteners extend through the fastener receivers of the hinge bracket at the first side, through the second surface of the elongated slot, through the fastener receivers of the hinge, and through the first surface of the elongated slot, to fasten the hinge bracket and the hinge together. In an embodiment, the hinge bracket further comprises second fastener receivers open at the bottom side of the hinge bracket and extending toward the top side of the hinge bracket orthogonal to the fastener receivers of the hinge bracket, so that fasteners extend through the fastener receivers of the lid and through the second fastener receivers open at the bottom side of the hinge bracket, to fasten the hinge bracket and the lid together. In an embodiment, the laundry appliance further comprises: a second hinge including a first end extending laterally into a hinge receiver of the cabinet in a direction towards the midline of the cabinet, a connecter portion having fastener receivers, the connector portion extending at least approximately orthogonally relative to the first end, a curved portion between the first end and the connector portion. In an embodiment, the lid has a first lateral side and a second lateral side, the C-shaped lip is disposed at each of the first lateral side and the second lateral side, fastener receivers through the C-shaped lip at the first lateral side of the lid, and fastener receivers through the C-shaped lip at the second lateral side of the lid. In an embodiment, the hinge bracket couples both the hinge and the second hinge to the lid, the hinge bracket including a length that extends essentially from the first lateral side of the lid to the second lateral side of the lid. In an embodiment, at least a portion of the hinge bracket is disposed in the space of the lid at the first lateral side and in the space of the lid at the second lateral side, with a bottom side that faces the edge of the C-shaped lip at both the first lateral side and the second lateral side of the lid, a top side that faces the top wall of the lid, a first side that faces the C-shaped lip at the first lateral side and a second side that faces the C-shaped lip at the second lateral side. In an embodiment, the hinge bracket further comprises a first elongated slot receiving the connector portion of the hinge, and a second elongated slot receiving the connector portion of the second hinge, both the first elongated slot and the second elongated slot each having a first surface opposing a second surface, the connector portion of the hinge disposed between the first surface and the second surface of the first elongated slot, and the connector portion of the second hinge disposed between the first surface and the second surface of the second elongated slot. In an embodiment, the hinge bracket further comprises fastener receivers at the first side that cooperate with the fastener receivers through the C-shaped lip at the first lateral side of the lid and fastener receivers through the connector portion of the hinge to receive fasteners, the fastener receivers at the first side of the hinge bracket extending through the first side, through the first surface of the first elongated slot, and through the second surface of the first elongated slot, so that the fasteners extend through the fastener receivers of the C-shaped lip at the first lateral side of the lid, through the first side of the hinge bracket, the first surface of the first elongated slot, the fastener receivers of the hinge, and through the second surface of the first elongated slot to fasten the lid, the hinge bracket, and the hinge together. In an embodiment, the hinge bracket further comprises fastener receivers at the second side that cooperate with the fastener receivers through the C-shaped lip at the second lateral side of the lid and fastener receivers through the connector portion of the second hinge to receive fasteners, the fastener receivers at the second side of the hinge bracket extending through the second side, through the first surface of the second elongated slot, and through the second surface of the second elongated slot, so that the fasteners extend through the fastener receivers of the C-shaped lip at the second lateral side of the lid, through the second side of the hinge bracket, the first surface of the second elongated slot, the fastener receivers of the second hinge, and through the second surface of the second elongated slot to fasten the lid, the hinge bracket, and the second hinge together. In an embodiment, the hinge bracket further includes a first indentation at least partially surrounding a hinge receiver receiving the hinge when the lid is in the closed position, and a second indentation at least partially surrounding a hinge receiver receiving the second hinge when the lid is in the closed position. In an embodiment, the hinge bracket further includes an elongated flat surface at the bottom side that is coplanar with the top wall of the lid and facing downward when the lid is in the closed position, the elongated flat surface extending lengthwise from approximately the first elongated slot to the second elongated slot. In an embodiment, the cabinet has a top portion, and the lid has a first lateral side, a second lateral side, and a front side that are disposed above the top portion of the cabinet when the lid is in the closed position.

In at least another aspect, a laundry appliance comprises: a cabinet having a midline; a chamber disposed within the cabinet, and configured to hold an article of clothing for washing or drying; an opening into the chamber; a lid selectively movable to, from, and between a closed position that prevents access to the opening, and an open position that allows access to the opening; a hinge receiver coupled to the cabinet, the hinge receiver including an inner chamber with an inner surface; a hinge including: a cam at a first end that is disposed in the inner chamber of the hinge receiver; and a connecter portion operably connected to the lid; wherein, when the lid is in the closed position, the cam is not abutting the inner surface of the hinge receiver; and wherein, when the lid is in the open position, the cam abuts the inner surface of the hinge receiver and the inner surface prevents the cam and the lid from rotating past the open position. In an embodiment, the hinge receiver further includes a first side wall, a second side wall opposing the first side wall, and a forward wall that transitions into a top wall via an intermediary curved portion. In an embodiment, the first side wall, the second side wall, and the forward wall that transitions into the top wall define at least part of the inner chamber. In an embodiment, the forward wall that transitions into the top wall provides the inner surface abutting the cam of the hinge when the lid is in the open position. In an embodiment, the hinge receiver further includes a first curved surface and a second curved surface that is parallel to the first curved surface upon which the hinge rotates when the lid transitions from the closed position to the open position. In an embodiment, the first side wall provides the first curved surface, and the second side wall provides the second curved surface.

These and other features, advantages, and objects of the present device will be further understood and appreciated by those skilled in the art upon studying the following specification, claims, and appended drawings.

DETAILED DESCRIPTION OF EMBODIMENTS

Figure 1:
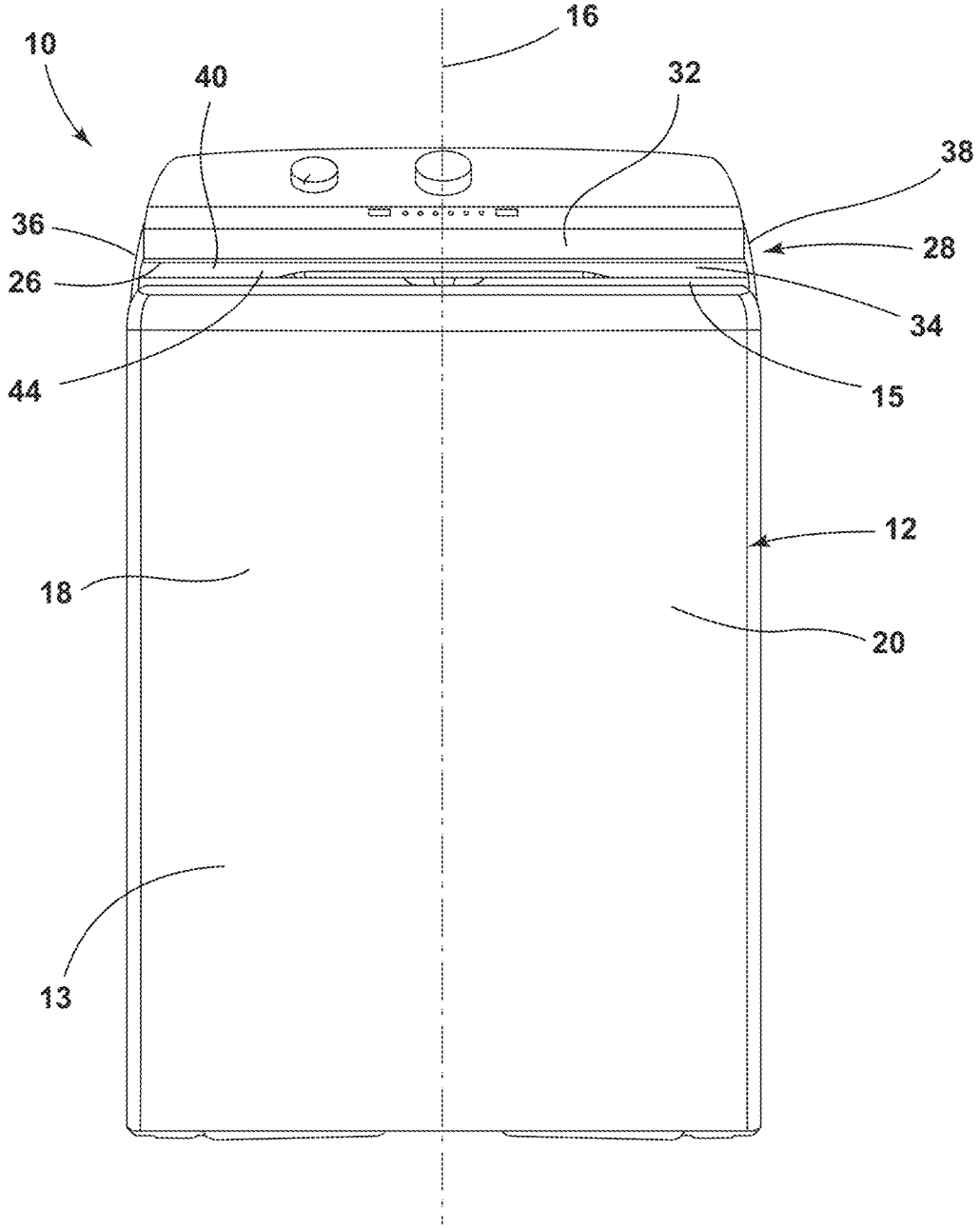
FIG. 1 is a front view of a laundry appliance, illustrating a lid in a closed position and rotatably coupled to a cabinet, which has a midline at least approximately dividing the cabinet into two halves.

For purposes of description herein the terms "downward," "inward," "outward," "upward," "front," "rear," and derivatives thereof, shall relate to the device as oriented in FIG. 1, unless the context clarifies otherwise. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2A:
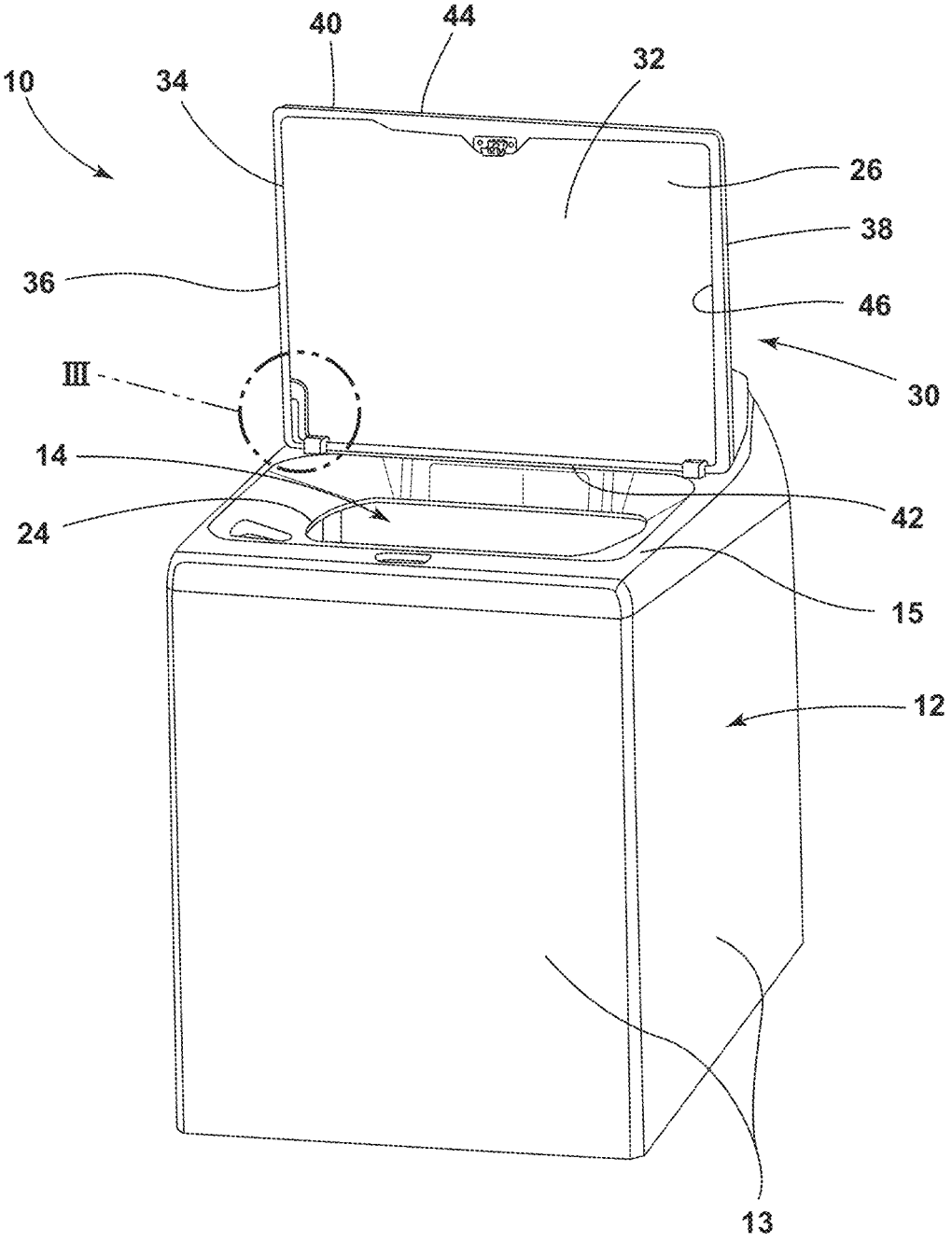
FIG. 2A is a perspective view of the laundry appliance of FIG. 1, illustrating the lid in an open position allowing access through an opening to a chamber into which an article of clothing can be placed for a laundering action.
Figure 2B:
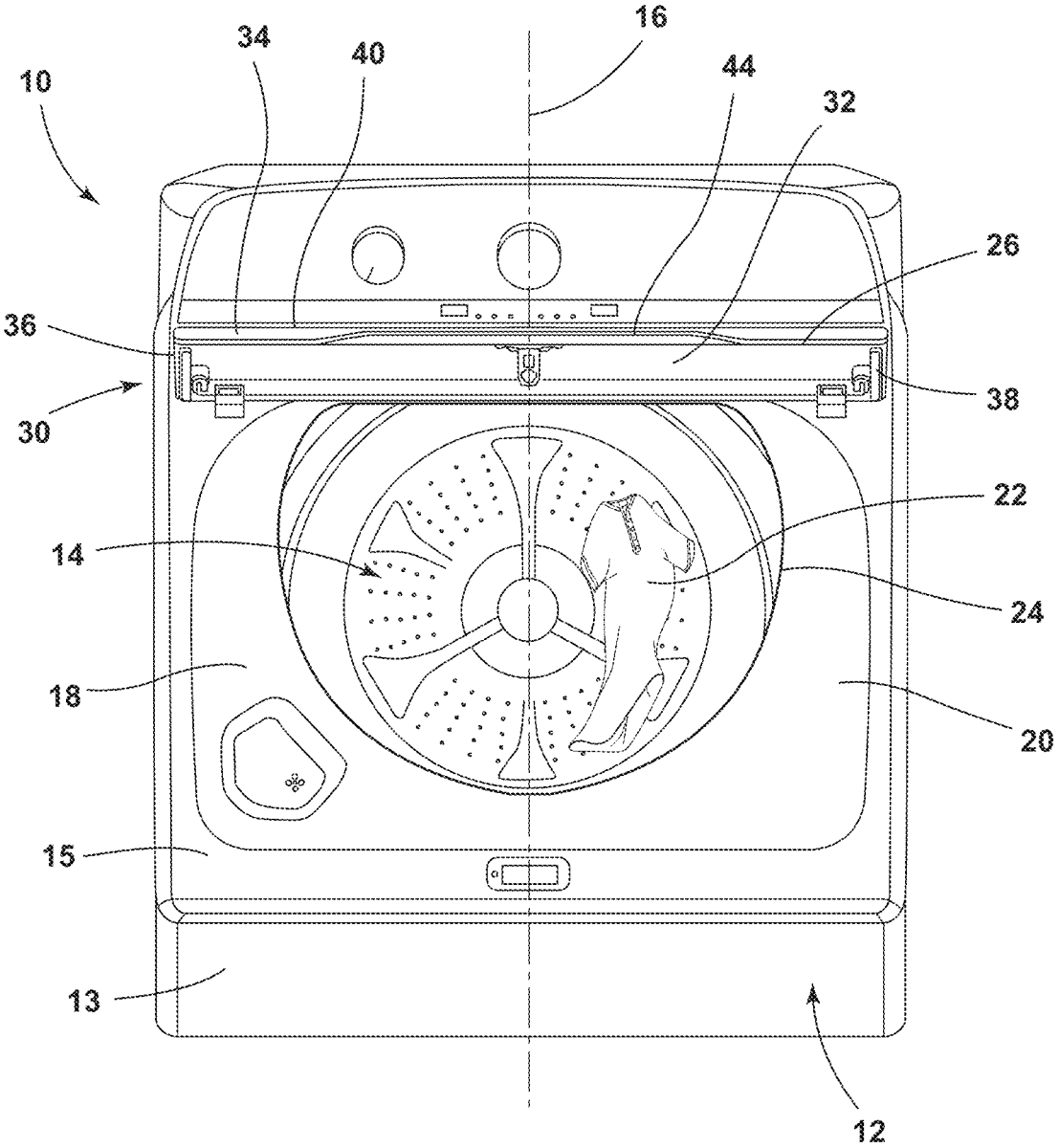
FIG. 2B is a top view of the laundry appliance of FIG. 1, illustrating the lid in an open position and an article of clothing placed in the chamber for a laundering action.

Referring to FIGS. 1-2B, a laundry appliance 10 includes a cabinet 12 and a chamber 14 disposed within the cabinet 12. The cabinet 12 has a midline 16, a sagittal plane through which at least approximately divides the cabinet 12 into two approximately symmetrical halves—a first half 18 and a second half 20. In some embodiments, such as the illustrated embodiment, the cabinet 12 includes generally vertical side walls 13 and a top portion 15 coupled to the side walls 13. The vertical side walls 13 are typically constructed of metal. The top portion 15 can be constructed of metal or molded plastic.

The chamber 14 holds an article of clothing 22 for washing or drying, or both washing and drying. The laundry appliance 10 further includes an opening 24 into the chamber 14. In the illustrated embodiment, the opening 24 is through the top portion 15. The laundry appliance 10 further includes a lid 26. The lid 26 is selectively movable to, from, and between a closed position 28 and an open position 30. In the closed position 28, the lid 26 prevents access to the opening 24 into the chamber 14. In the open position 30, the lid 26 allows access to the opening 24 into the chamber 14. In practice, a person moves the lid 26 to the open position 30, places the article of clothing 22 through the opening 24 and into the chamber 14, closes the lid 26, and then commands the laundry appliance 10 to perform a washing operation or drying operation or both. The laundry appliance 10 may be a washing machine, a dryer, or a combination washing machine and dryer.

Figure 3:
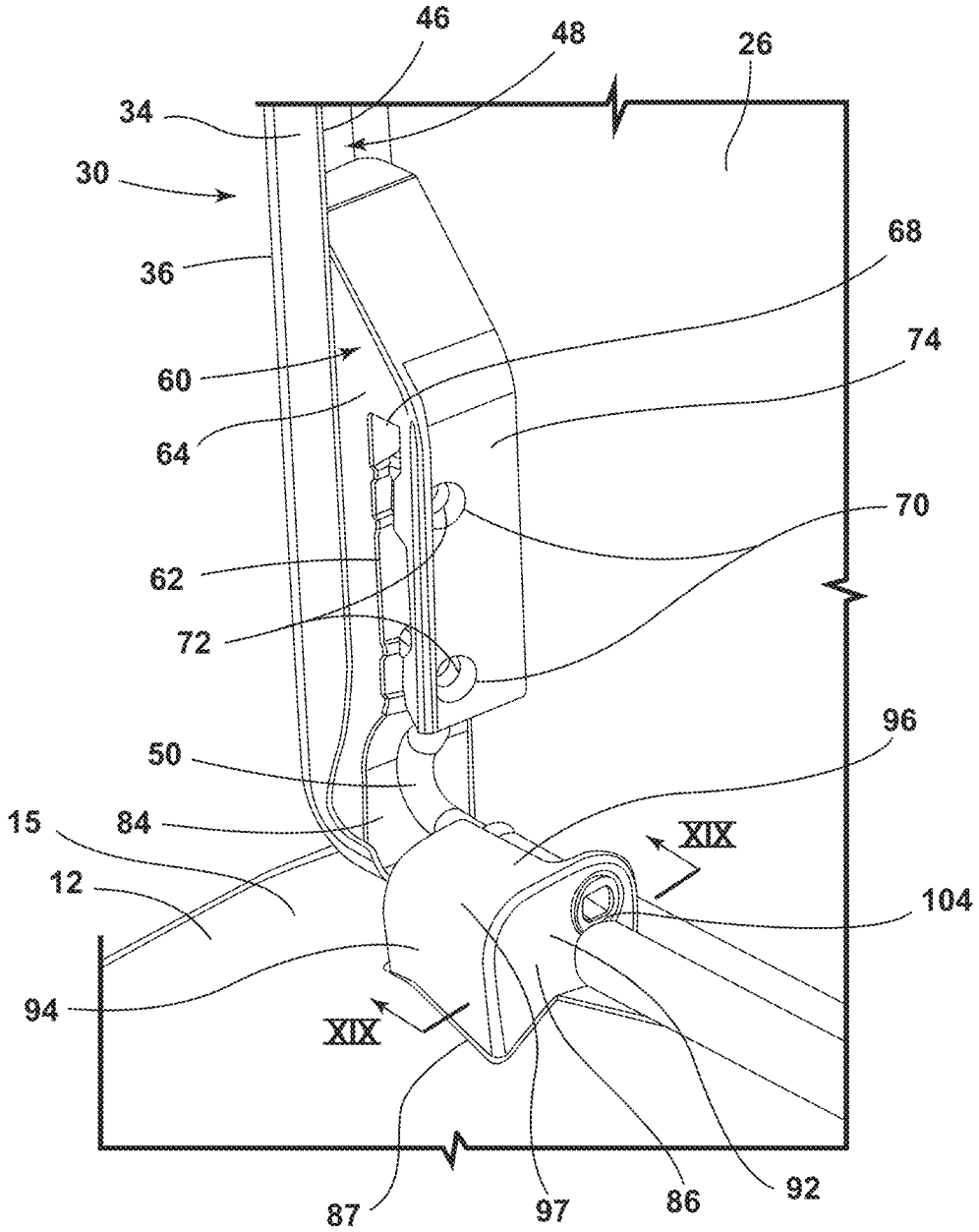
FIG. 3 is a perspective view of area III of FIG. 2A, illustrating a hinge bracket operably coupling a hinge to the lid, with a portion of the hinge bracket nested in a space provided by a C-shaped lip of the lid.

Referring now additionally to FIG. 3, the lid 26 has a top wall 32 and a C-shaped lip 34 that curls downward and inward, from the perspective of when the lid 26 is in the closed position 28. The lid 26 further has a first lateral side 36, a second lateral side 38, a front side 40, and a rear side 42. The C-shaped lip 34 may extend along a perimeter 44 of the lid 26, such as along the perimeter 44 of the lid 26 at the first lateral side 36, the front side 40, and the second lateral side 38. The C-shaped lip 34 has an edge 46. At the first lateral side 36 and the second lateral side 38, the edge 46 extends inward toward the midline 16. The C-shaped lip 34 creates a space 48 between the top wall 32 and the edge 46 of the C-shaped lip 34. In embodiments, the C-shaped lip 34 extends inward toward the midline 16 and at least approximately parallel with the top wall 32. In the illustrated embodiment, the first lateral side 36, the second lateral side 38, and the front side 40 of the lid 26 are not nested into the top portion 15 of the cabinet 12, when the lid 26 is in the closed position 28. Rather, in the illustrated embodiment, the first lateral side 36, the second lateral side 38, and the front side 40 of the lid 26 are disposed above the top portion 15 of the cabinet 12, when the lid 26 is in the closed position 28. There is no portion of the cabinet 12 laterally adjacent to the first lateral side 36, the second lateral side 38, and the front side 40 of the lid 26, when the lid 26 is in the closed position 28. However, in other embodiments, the first lateral side 36, the second lateral side 38, and the front side 40 of the lid 26 could be nested into the top portion 15 of the cabinet 12, as known in the art. In some embodiments, the lid 26 is made predominately of a metal, such as a type of steel. In other embodiments, the lid 26 includes a substantial glass or other optically transparent component.

Figure 4:
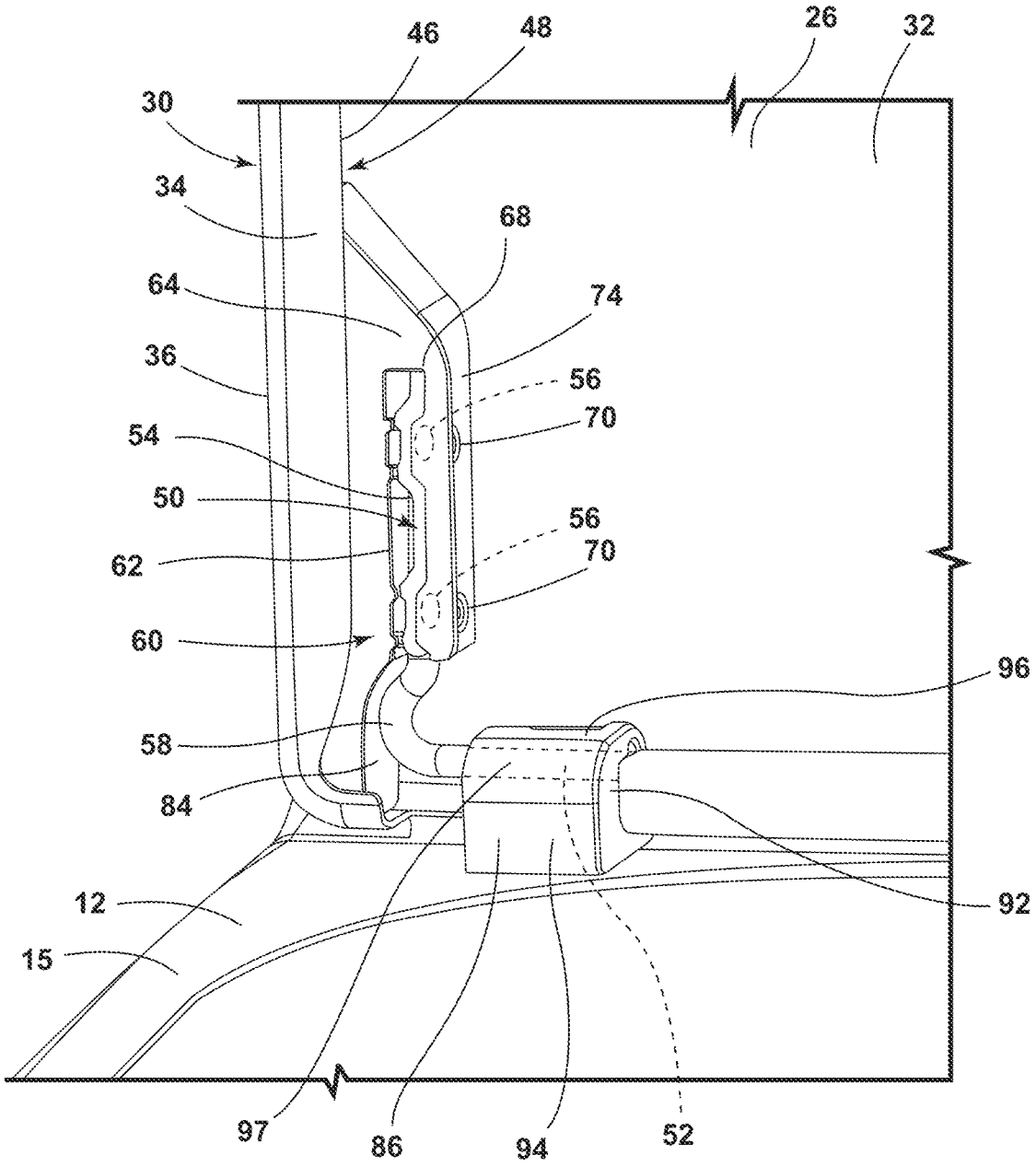
FIG. 4 is another perspective view of what is illustrated in FIG. 3, further illustrating the hinge bracket having first fastener receivers collinear with fastener receivers in a connection portion of the hinge and receiving fasteners to fasten the hinge to the hinge bracket, specifically in an elongated slot of the hinge bracket.
Figure 5:
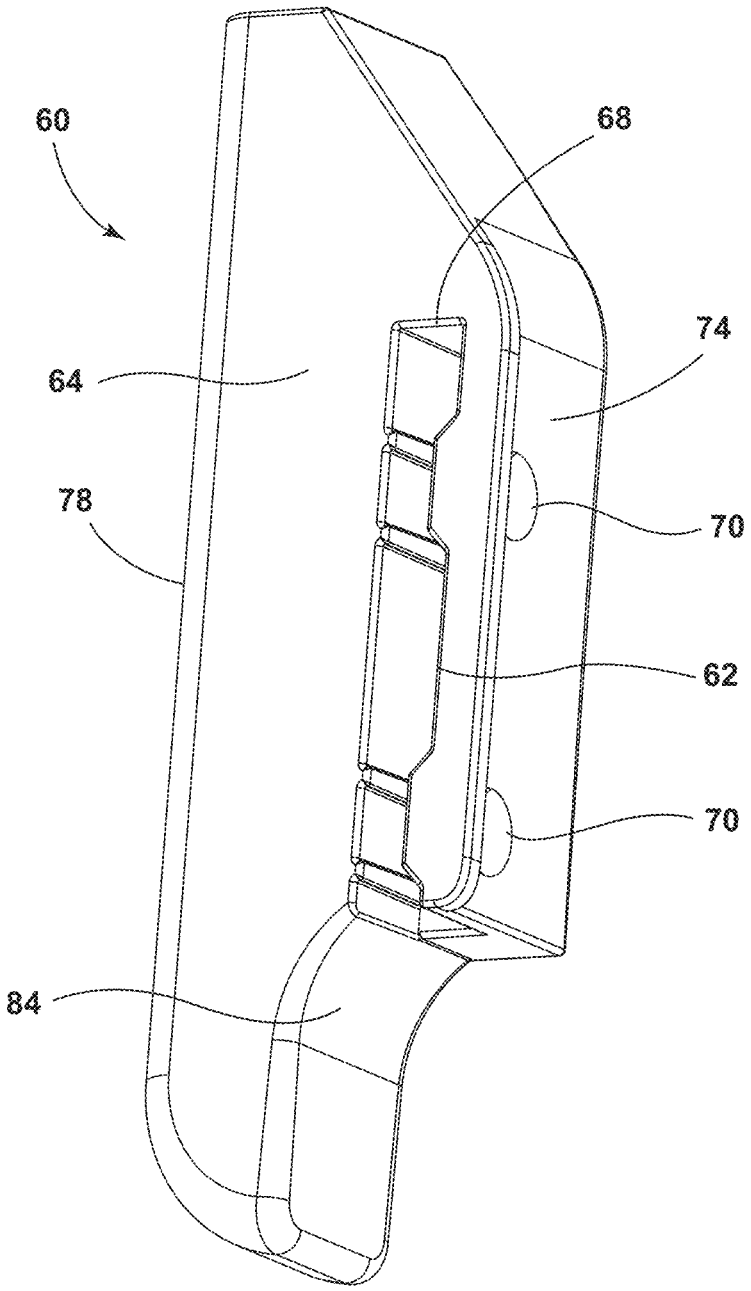
FIG. 5 is a perspective view of the hinge bracket of FIG. 3, illustrating an opening at a bottom side providing access to the elongated slot.
Figure 6:
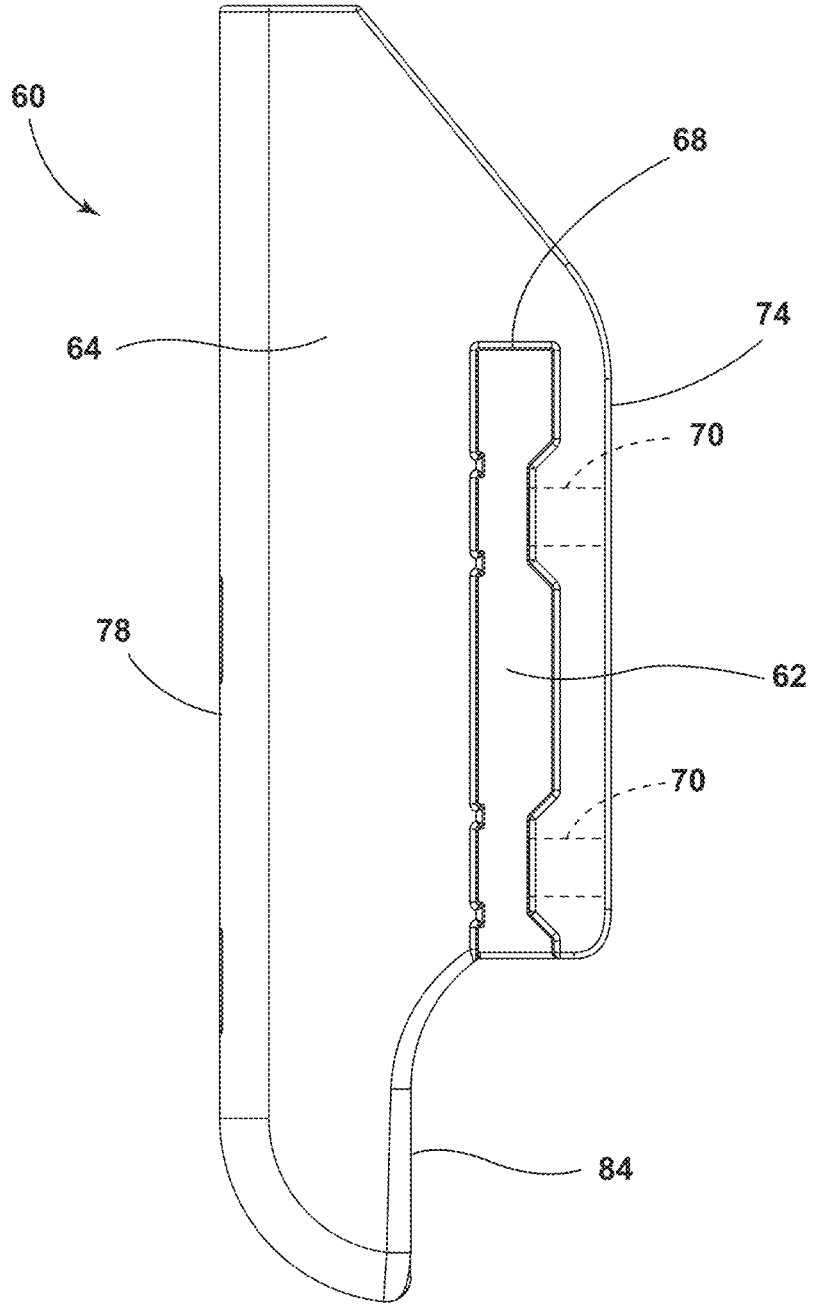
FIG. 6 is a view of the bottom side of the hinge bracket of FIG. 3, illustrating the fastener receivers extending through from a first side of the hinge bracket to the elongated slot but not all the way through to an outboard side, which is on the opposite side of the hinge bracket as the first side (inboard side)
Figure 7:
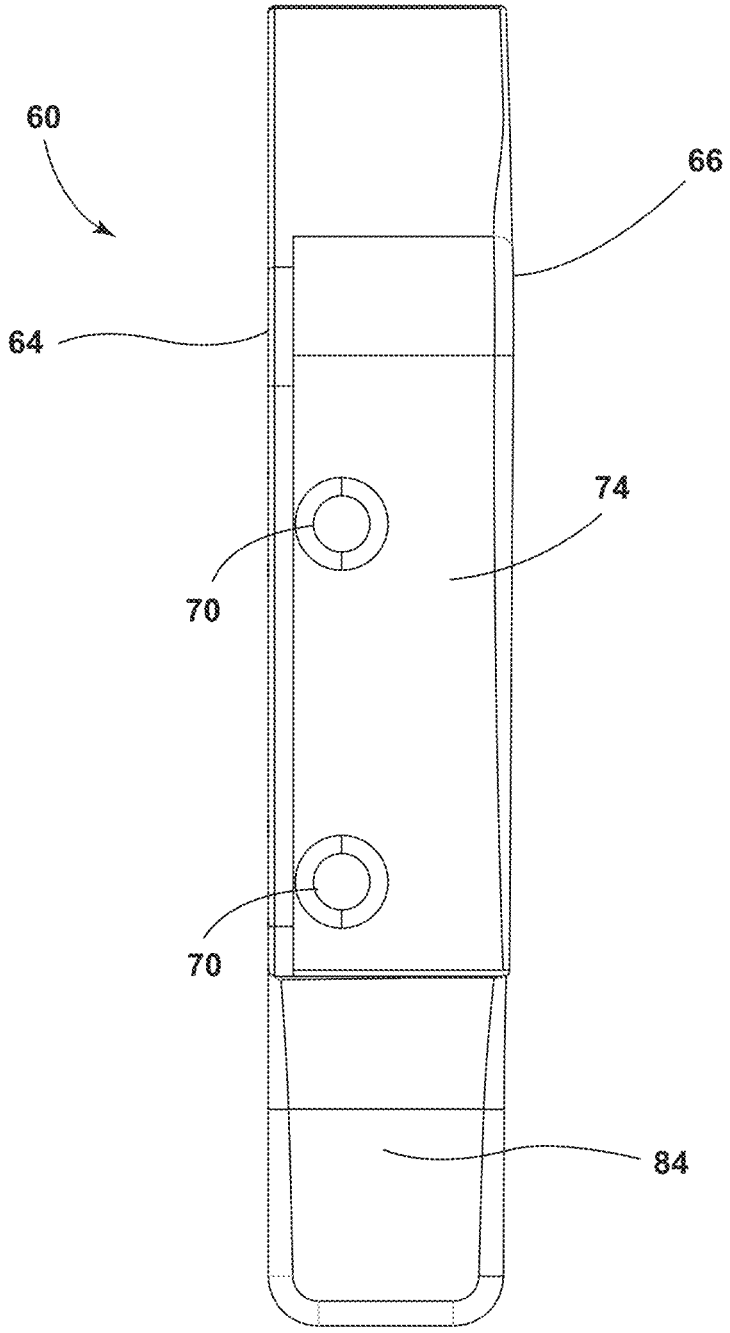
FIG. 7 is a view of the first side of the hinge bracket of FIG. 3, illustrating the first side having an indented portion that indents towards the outboard side, as well as the fastener receivers, which are not disposed at the indented portion.
Figure 8:
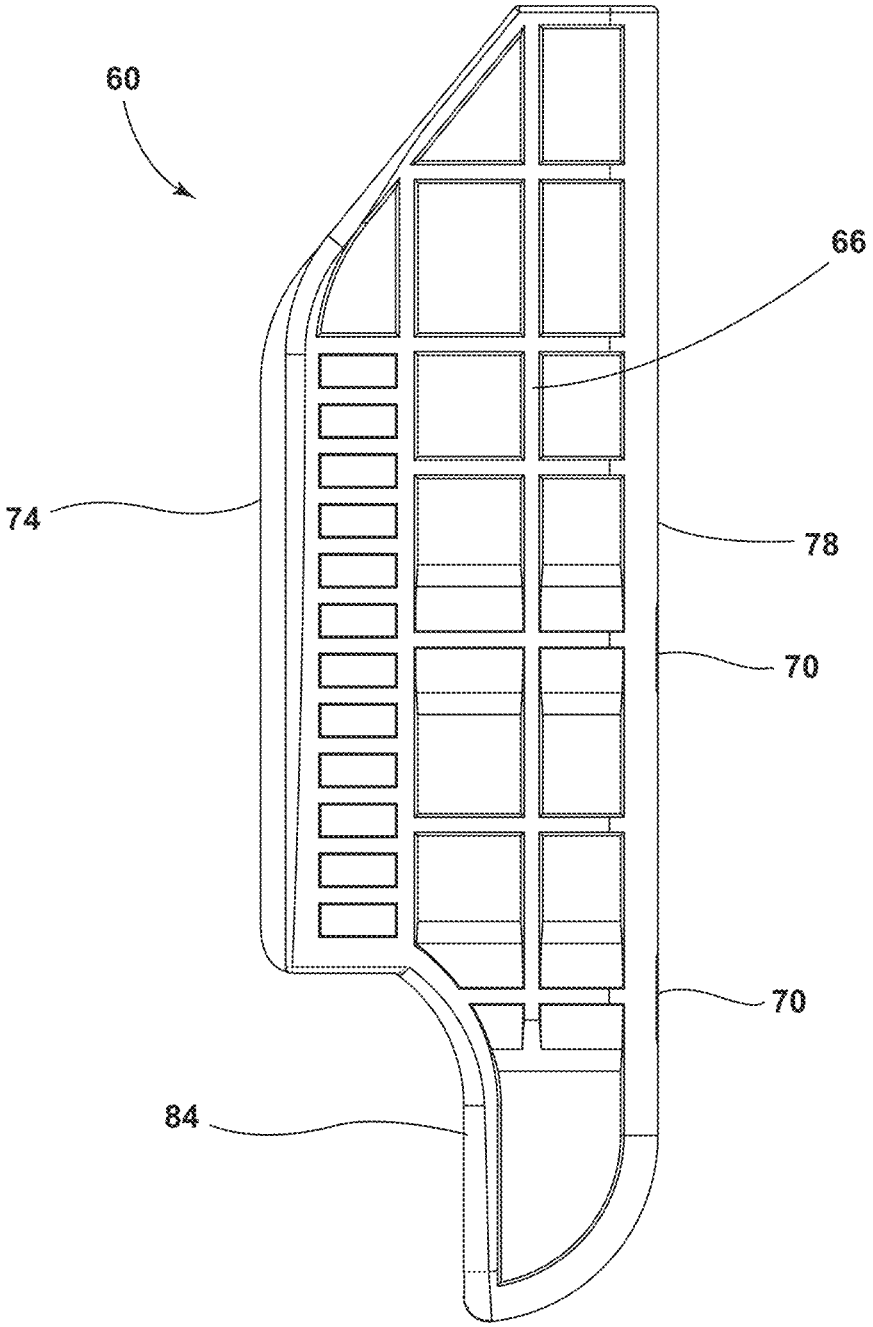
FIG. 8 is a view of the top side of the hinge bracket of FIG. 3, illustrating second fastener receivers available at the outboard side.
Figure 9:
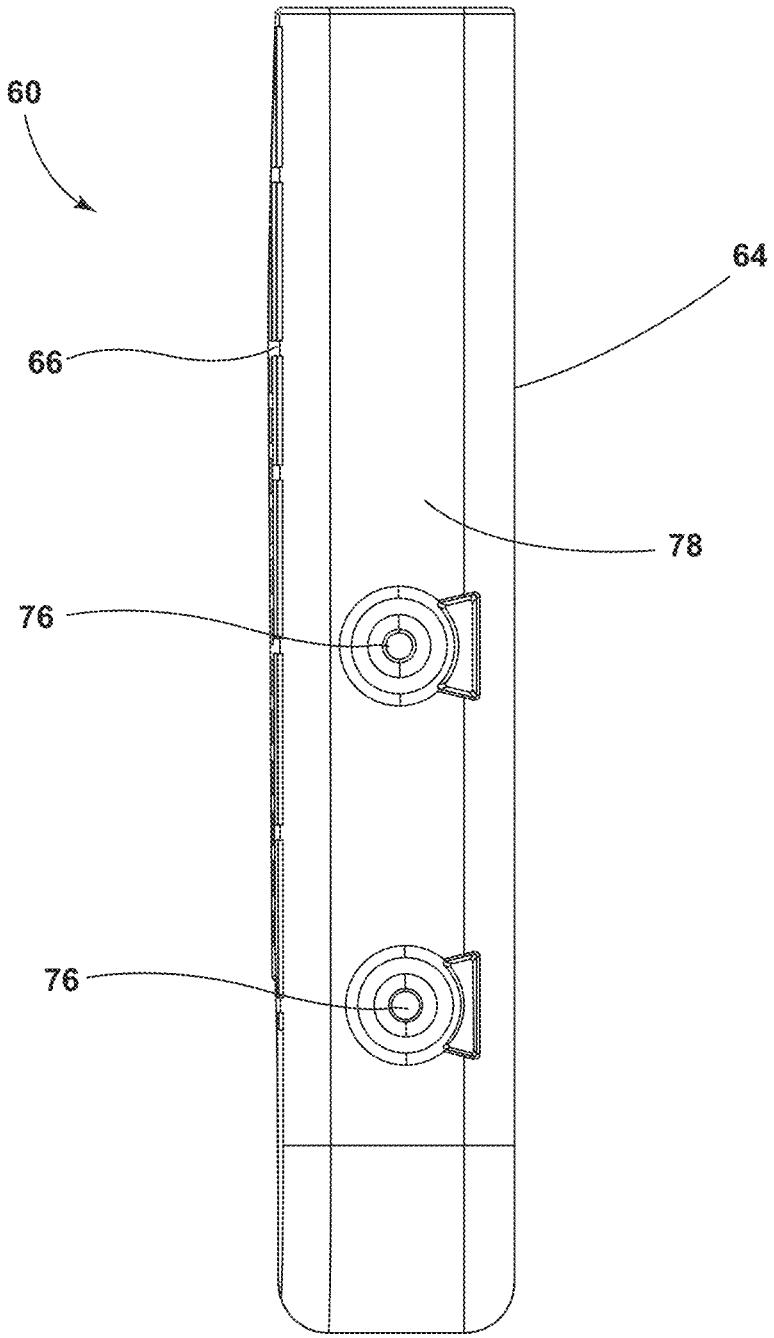
FIG. 9 is a view of the outboard side of the hinge bracket of FIG. 3, illustrating the second fastener receivers.
Figure 10:
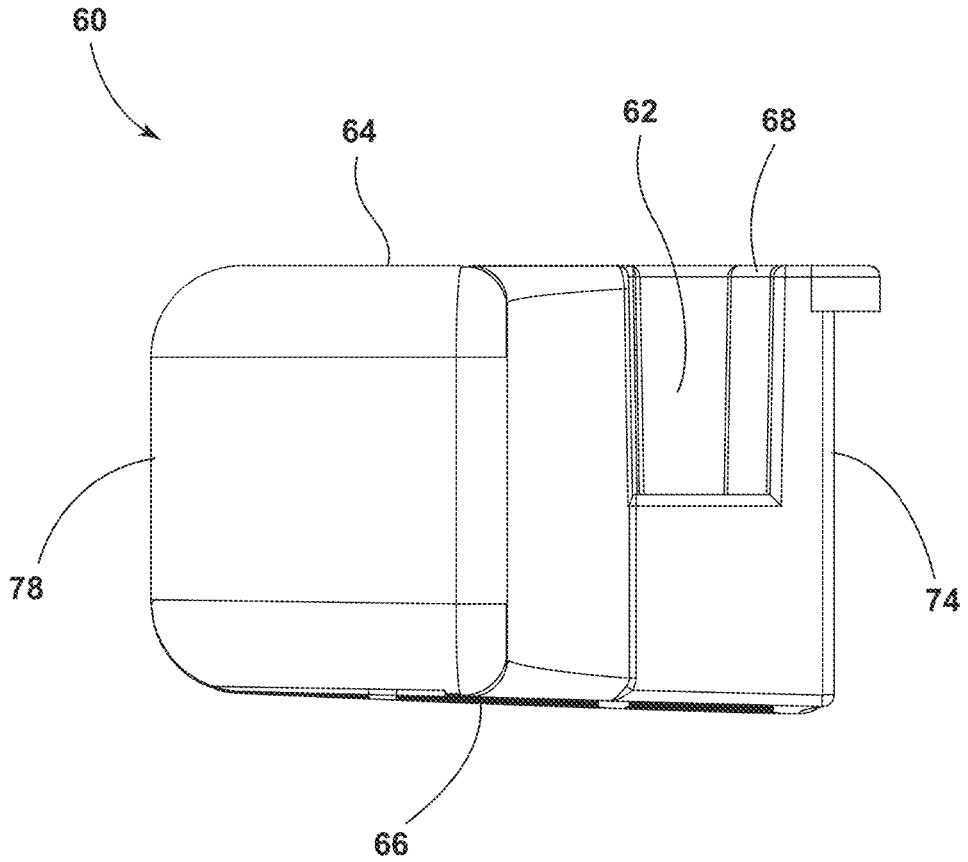
FIG. 10 is an elevational view of the hinge bracket of FIG. 3, illustrating the elongated slot available at the bottom side but not the top side.
Figure 11:
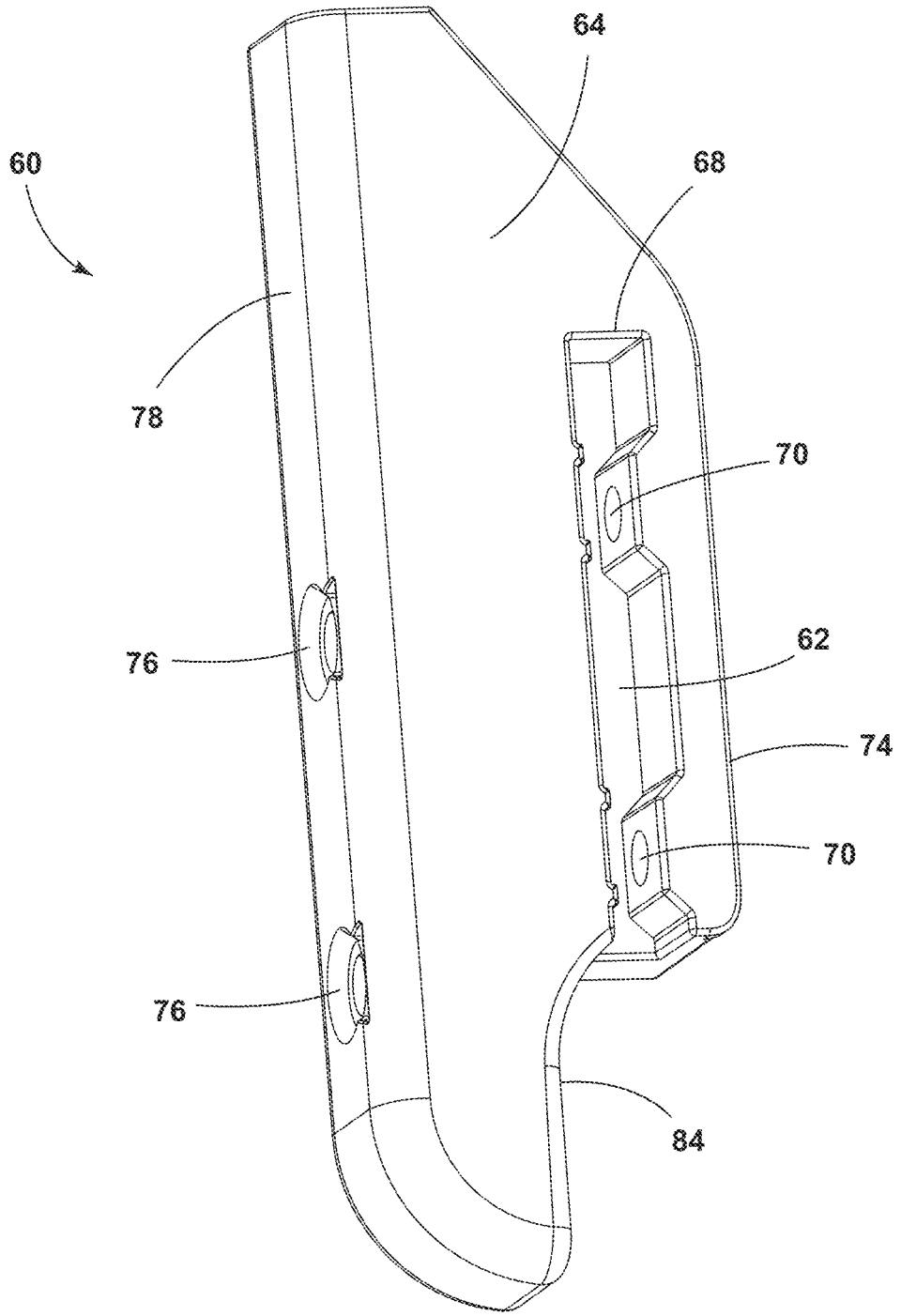
FIG. 11 is another perspective view of the hinge bracket of FIG. 3, illustrating the first fastener receivers extending from the first side through to the elongated slot to allow fasteners to attach the hinge to the hinge bracket within the elongated slot, and the second fastener receivers extending from the outboard side into the hinge bracket to allow fasteners to attach the hinge bracket to the lid.
Figure 12:
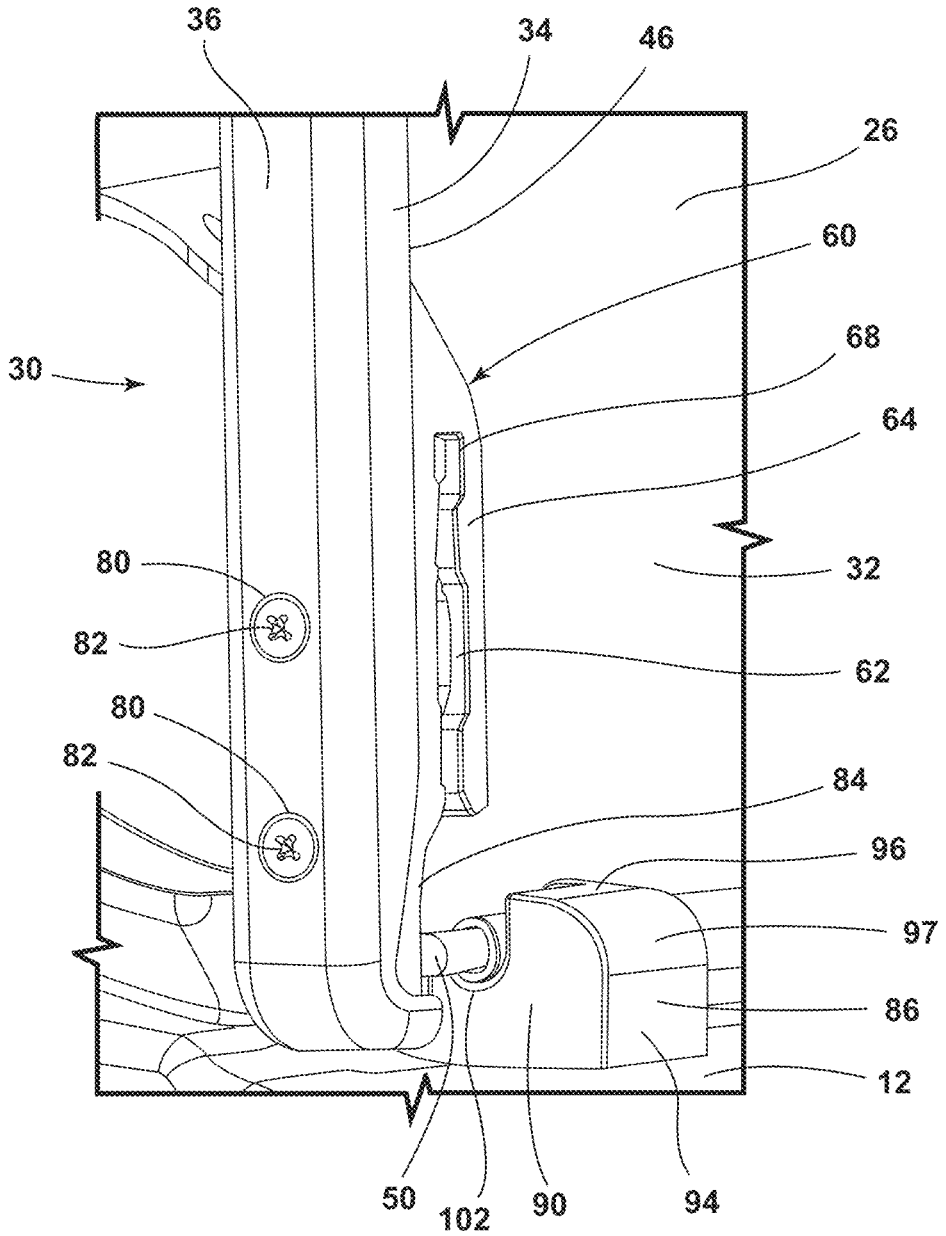
FIG. 12 is a perspective view of area III again, illustrating fasteners extending through fastener receivers of the C-shaped lip of the lid, through the second fastener receivers of the hinge bracket, thus operably connecting the lid, the hinge bracket, and the hinge together, the hinge being operably connected to a hinge receiver of the cabinet.
Figure 13:
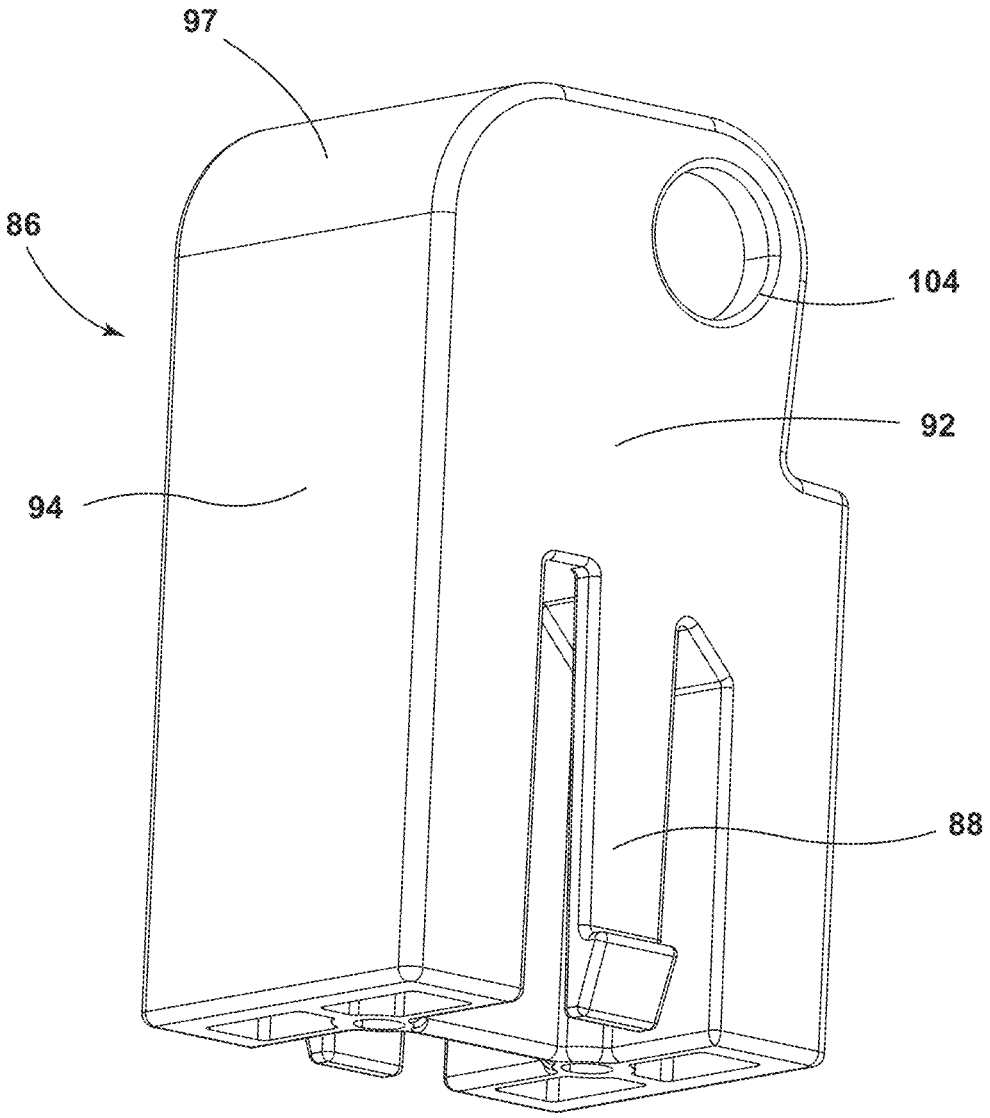
FIG. 13 is a perspective view of the hinge receiver of FIG. 12, illustrating a forward wall and a second side wall from which a snap-fit portion extends and which provides a second curved surface on which the hinge rotates as the lid is moved to, from, and between the open position and the closed position.
Figure 14:
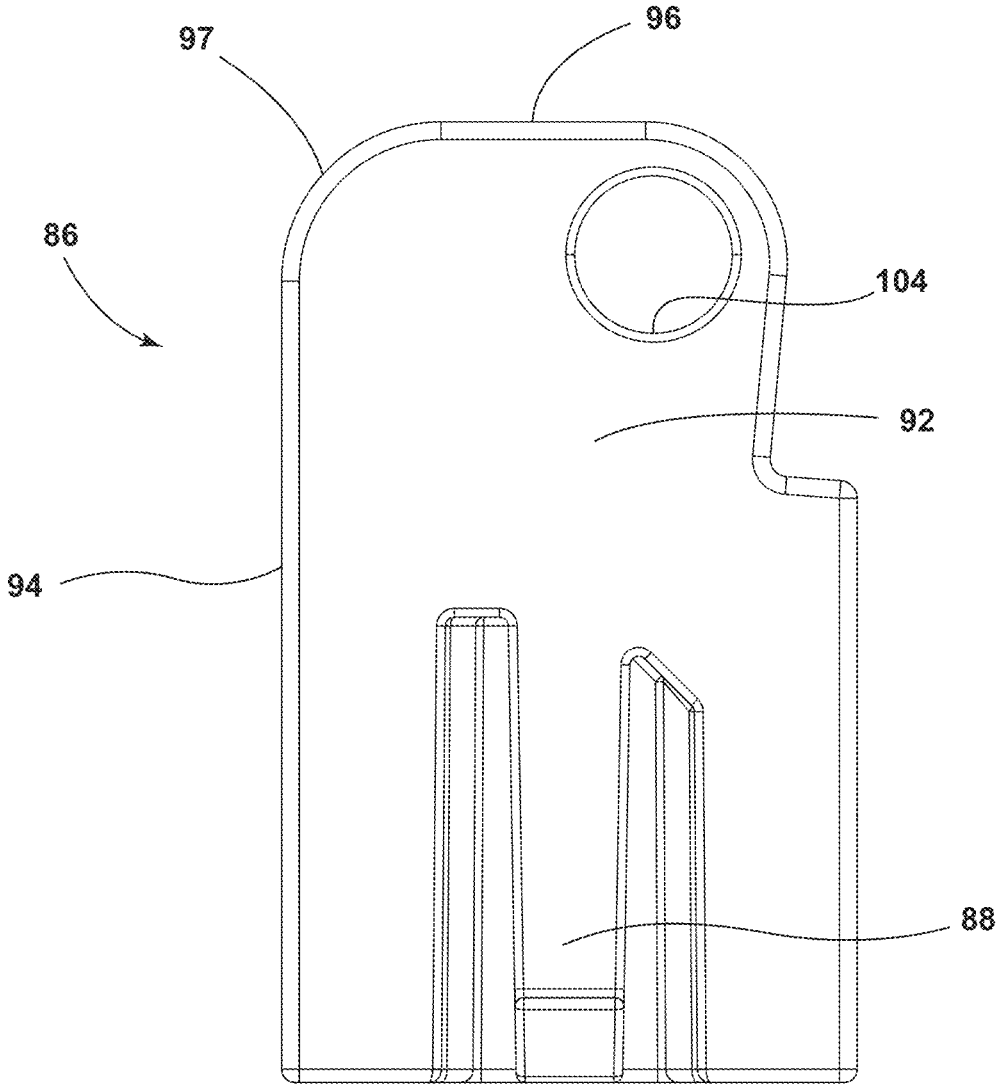
FIG. 14 is a view of the second side wall of the hinge receiver of FIG. 12, illustrating the forward wall transitioning into a top wall via a curved portion.
Figure 15:
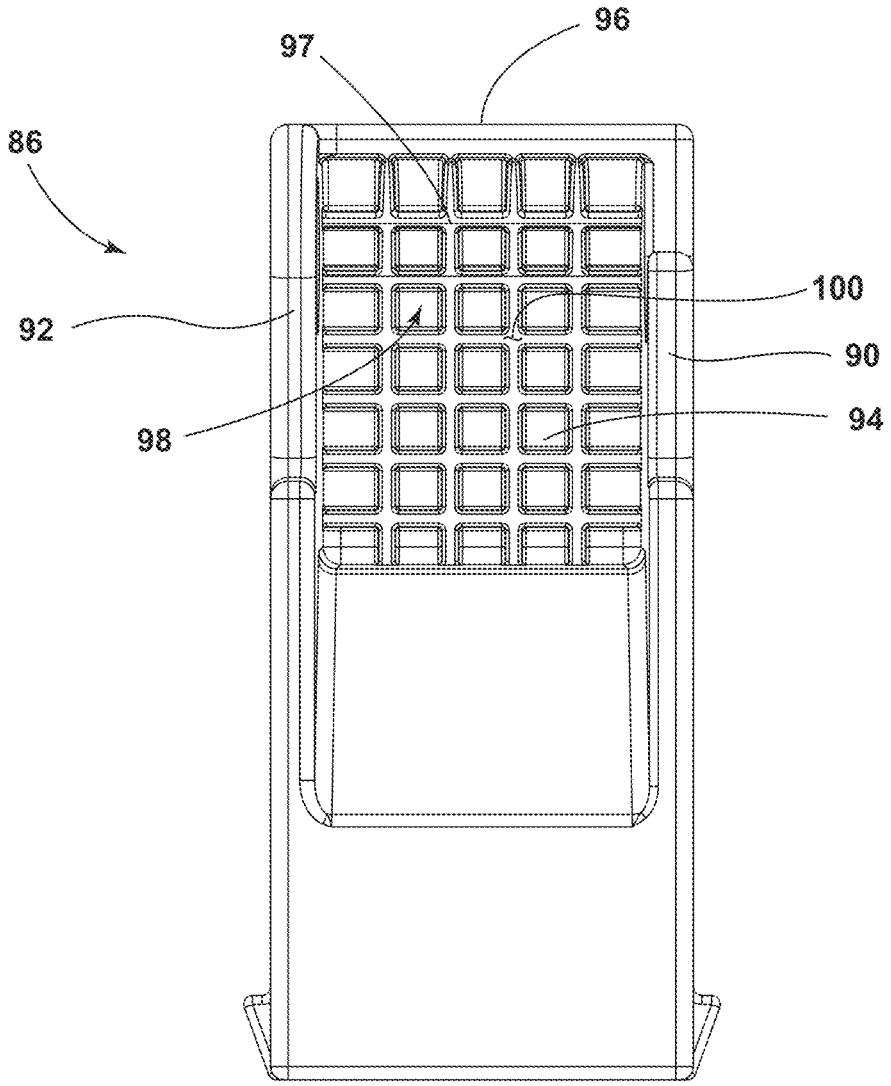
FIG. 15 is a view of the hinge receiver of FIG. 12, illustrating a first side wall, the second side wall, the forward wall, the curved portion, and the top wall forming an inner chamber having an inner surface.
Figure 16:
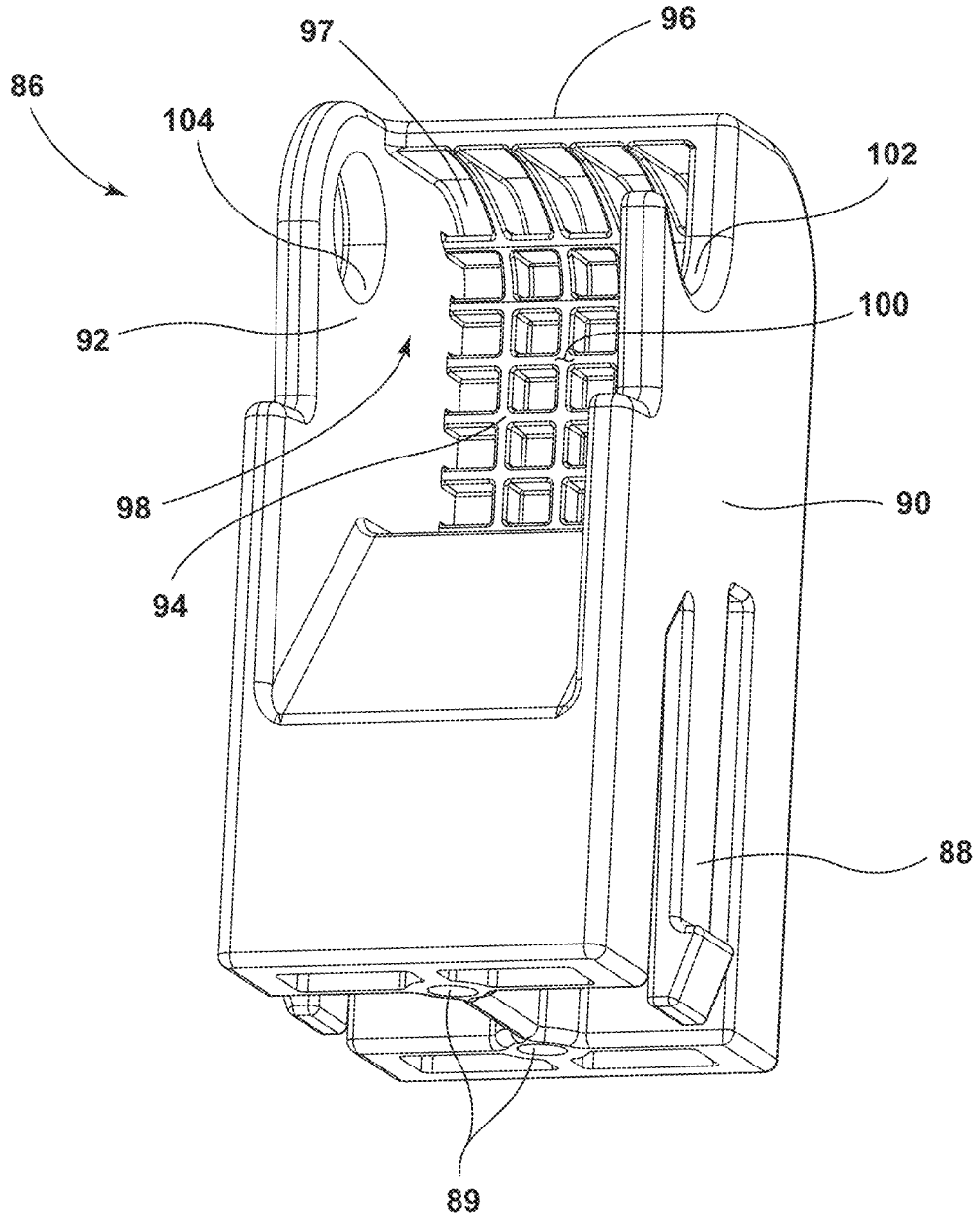
FIG. 16 is another perspective view of the hinge receiver of FIG. 12, illustrating the first side wall providing a first curved surface, on which the hinge, along with the second curved surface, rotates when the lid is moved to, from, and between the open position and the closed position.
Figure 17:
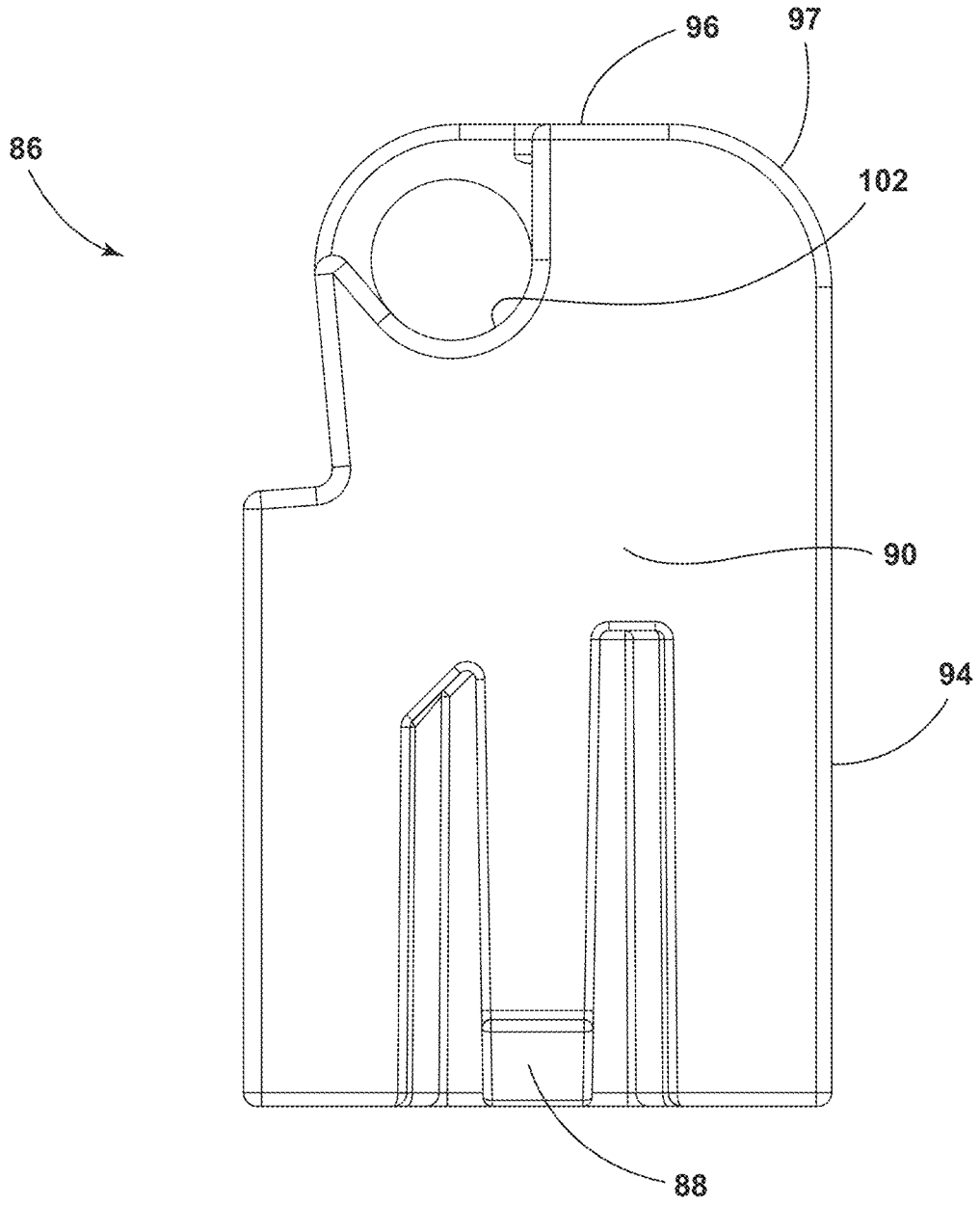
FIG. 17 is a view of the first side wall of the hinge receiver of FIG. 12, illustrating another snap-fit portion extending from the first side wall.
Figure 18:
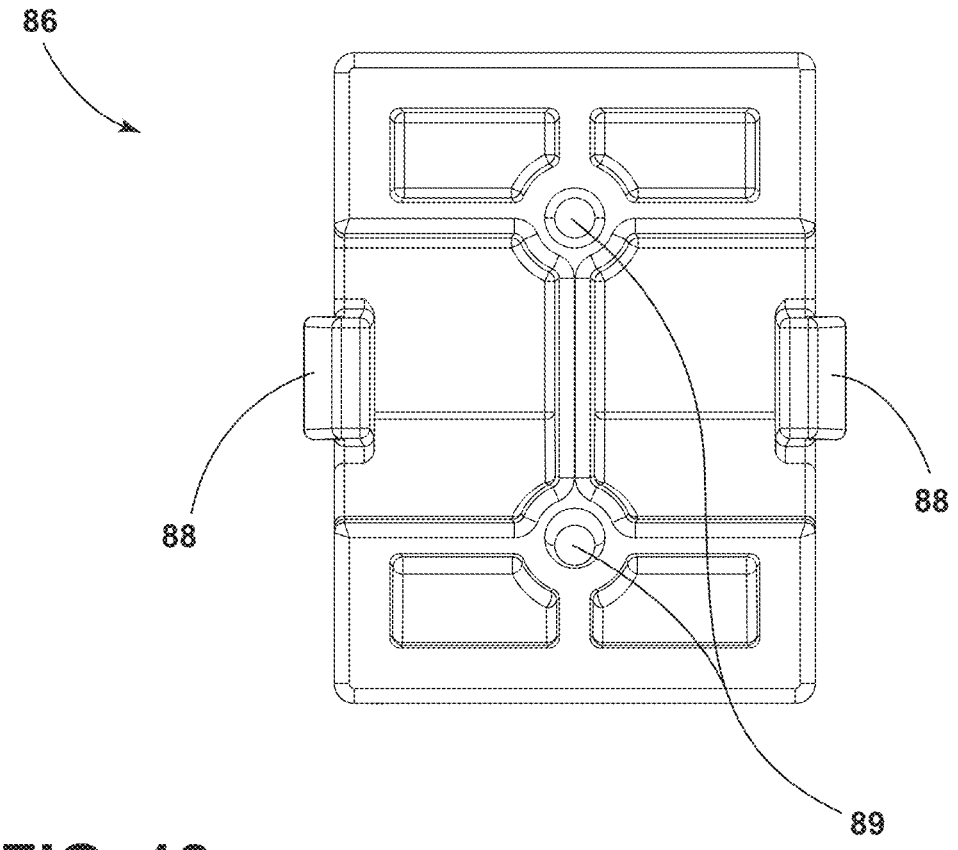
FIG. 18 is another view of the hinge receiver of FIG. 12, illustrating the snap-fit portions, which allow the hinge receiver to connect to the cabinet.

Referring now to FIG. 4, the laundry appliance 10 further includes an embodiment of a hinge 50, which allows the lid 26 to move to, from, and between the closed position 28 and the open position 30 relative to the cabinet 12. This embodiment of the hinge 50 includes a first end 52. The hinge 50 further includes a connector portion 54. The connector portion 54 has fastener receivers 56, which, in embodiments, extends through the connector portion 54 to allow a fastener to extend through the same. The hinge 50 further includes a curved portion 58 between the first end 52 and the connector portion 54. The first end 52 of the hinge 50 extends laterally into a hinge receiver (embodiments of which will be discussed below) of the cabinet 12 in a direction towards the midline 16 of the cabinet 12. As the lid 26 is moved to the open position 30 from the closed position 28, the first end 52 of the hinge 50 rotates within or about the hinge receiver. The connector portion 54 is at least approximately orthogonal to the first end 52. The curved portion 58 extends laterally further away from the midline 16 (that is, closer to the first lateral side 36 of the lid 26) than the connector portion 54 of the hinge 50. The curved portion 58 projects laterally outward from the perspective of the midline 16 toward the C-shaped lip 34 of the lid 26, such as toward or into the space 48 that the C-shaped lip 34 forms with the top wall 32.

Referring now additionally to FIGS. 5-12, the laundry appliance 10 further includes an embodiment of a hinge bracket 60. The hinge bracket 60 couples the hinge 50 to the lid 26. In embodiments, such as the presently illustrated embodiment, the hinge bracket 60 includes an elongated slot 62. The elongated slot 62 receives and at least partially surrounds the connector portion 54 of the hinge 50. The hinge bracket 60 further includes a bottom side 64 that faces downward when the lid 26 is in the closed position 28, and a top side 66 that faces in the opposite direction as the bottom side 64 and thus the top wall 32 of the lid 26. The bottom side 64 provides an opening 68 into the elongated slot 62.

The elongated slot 62 further includes first fastener receivers 70. In embodiments, the first fastener receivers 70 extend from the elongated slot 62 laterally inward toward the midline 16. In other embodiments, the first fastener receivers 70 further extend from the elongated slot 62 laterally outward into the hinge bracket 60. The first fastener receivers 70 cooperate (i.e., are collinear) with the fastener receivers 56 of the hinge 50. The first fastener receivers 70 receive fasteners 72 that further extend into the fastener receivers 56 of the connector portion 54 of the hinge 50 to fasten the hinge 50 to the hinge bracket 60. The first fastener receivers 70 are disposed at (i.e., available to receive fasteners 72 at) a first side 74 of the hinge bracket 60.

The hinge bracket 60 further includes second fastener receivers 76. In embodiments, the second fastener receivers 76 are disposed at (i.e., available to receive fasteners at) a second side 78 of the hinge bracket 60. The second side 78 is the opposite side of the hinge bracket 60 from the first side 74. The second fastener receivers 76 extend laterally inward toward the midline 16 from the second side 78. The second side 78 of the hinge bracket 60 is nested into the space 48 that the C-shaped lip 34 of the lid 26 makes. The C-shaped lip 34 partially secures the hinge bracket 60 before the hinge bracket 60 and the lid 26 are fastened together. When the hinge bracket 60 is so nested within the C-shaped lip 34, the top wall 32 of the lid 26 is adjacent to the top side 66 of the hinge bracket 60, the C-shaped lip 34 contacts the second side 78 of the hinge bracket 60, and the edge 46 of the C-shaped lip 34 is adjacent to the bottom side 64 of the hinge bracket 60. In other embodiments, the second fastener receivers 76 are available at the bottom side 64 of the hinge bracket 60, and extend toward the top side 66.

The second fastener receivers 76 cooperate with (i.e., are collinear with) fastener receivers 80 through the C-shaped lip 34 of the lid 26 to receive fasteners 82. The fasteners 82 thus fasten the lid 26 to the hinge bracket 60. In embodiments, the first fastener receivers 70 and the second fastener receivers 76 are at least approximately parallel (they can be parallel) but, in the illustrated embodiment, are not collinear, and the fastener receivers 80 through the C-shaped lip 34 are disposed at the first lateral side 36 of the lid 26. In other embodiments, the first fastener receivers 70 and the second fastener receivers 76 are at least approximately orthogonal, and the fastener receivers 80 through the C-shaped lip 34 are disposed adjacent to the edge 46 through the portion of the C-shaped lip 34 that runs parallel with the top wall 32 of the lid 26.

The hinge bracket 60 further includes an indented portion 84 into the first side 74 that decreases the distance between the first side 74 and the second side 78. The indented portion 84 faces the curved portion 58 of the hinge 50. Because the curved portion 58 of the hinge 50 extends further towards the first lateral side 36 of the lid 26 than the connector portion 54 of the hinge 50, the indented portion 84 of the hinge bracket 60 provides room for the curved portion 58 of the hinge 50 to exist.

Referring back to FIGS. 3, 4, and 12, and additionally FIGS. 13-19, the laundry appliance 10 further includes a hinge receiver 86. The hinge receiver 86 is coupled to the cabinet 12—in the illustrated embodiment, at the top portion 15 of the cabinet 12. In embodiments, the hinge receiver 86 includes a pair of cantilevered snap-fit portions 88. The snap-fit portions 88 enable the hinge receiver 86 to be securely accepted into a slot 87 of the cabinet 12, such as at the top portion 15 thereof. In embodiments, the hinge receiver 86 further includes fastener receivers 89 to cooperate with fasteners 91 to fasten the hinge receiver 86 to the cabinet 12, such as at the top portion 15 thereof.

The hinge receiver 86 includes a first side wall 90, a second side wall 92 that opposes the first side wall 90, and a forward wall 94 that transitions into a top wall 96 via an intermediary curved portion 97. The first side wall 90, the second side wall 92, the forward wall 94, and the top wall 96 define part of an inner chamber 98 having an inner surface 100. The hinge receiver 86 further includes a first curved surface 102 and a second curved surface 104. In embodiments, at least a portion of the first curved surface 102 is parallel to the second curved surface 104. In the illustrated embodiment, the first side wall 90 provides the first curved surface 102, and the second side wall 92 provides the second curved surface 104.

Figure 19:
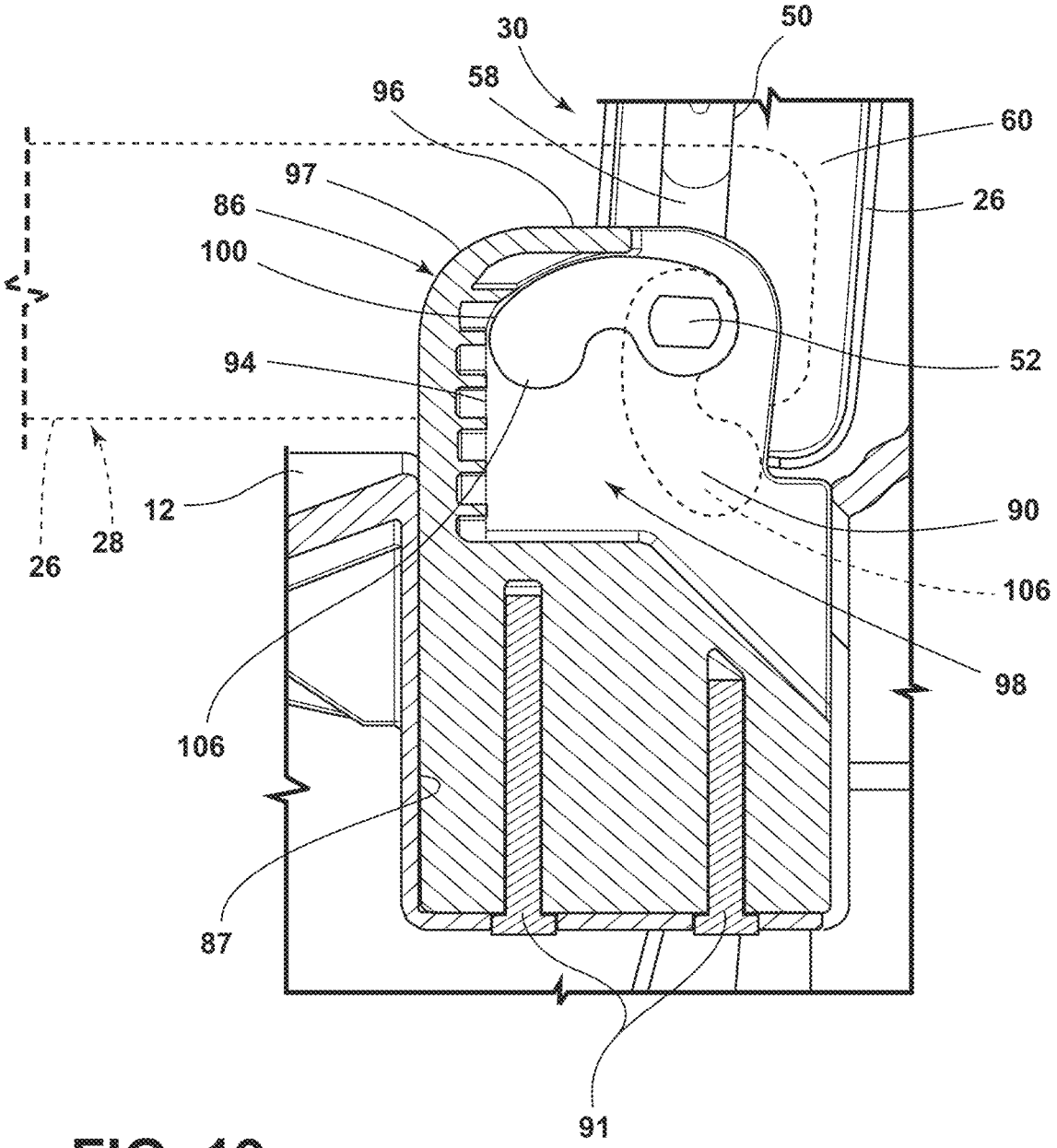
FIG. 19 is a view of the cross-section taken through line XIX-XIX of FIG. 3, illustrating a first end of the hinge having a cam which rotates freely within the inner chamber of the hinge receiver of FIG. 3 while the lid rotates from the closed position to the open position, but not past the open position because the cam contacts the inner surface of the inner chamber thus preventing further rotation of the cam, the hinge, and thus the lid.
Figure 20:
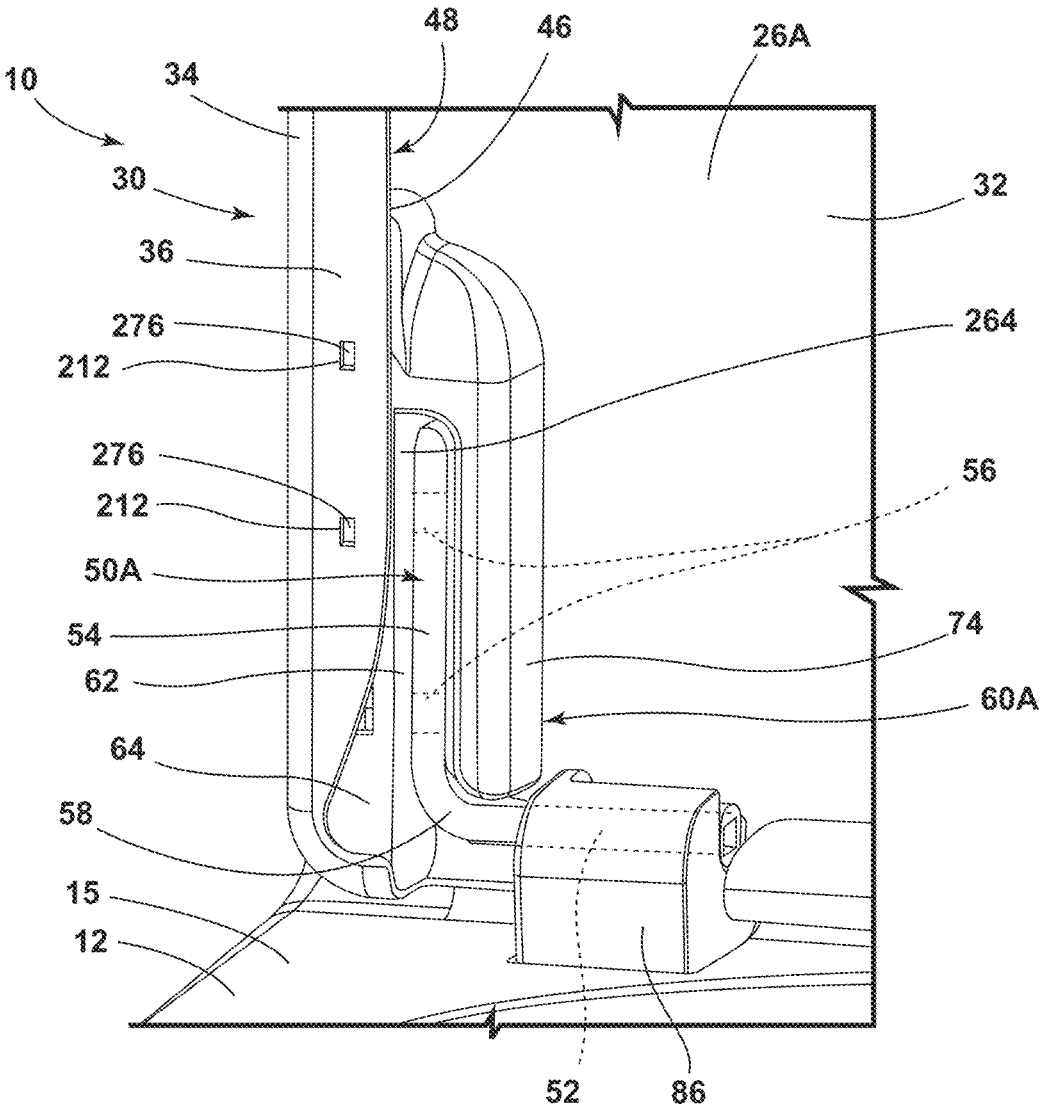
FIG. 20 is a perspective view of area III of FIG. 2A again, but this time illustrating an alternative embodiment hinge, an alternative embodiment hinge bracket, and an alternative embodiment lid having snap-fit receivers.
Figure 21:
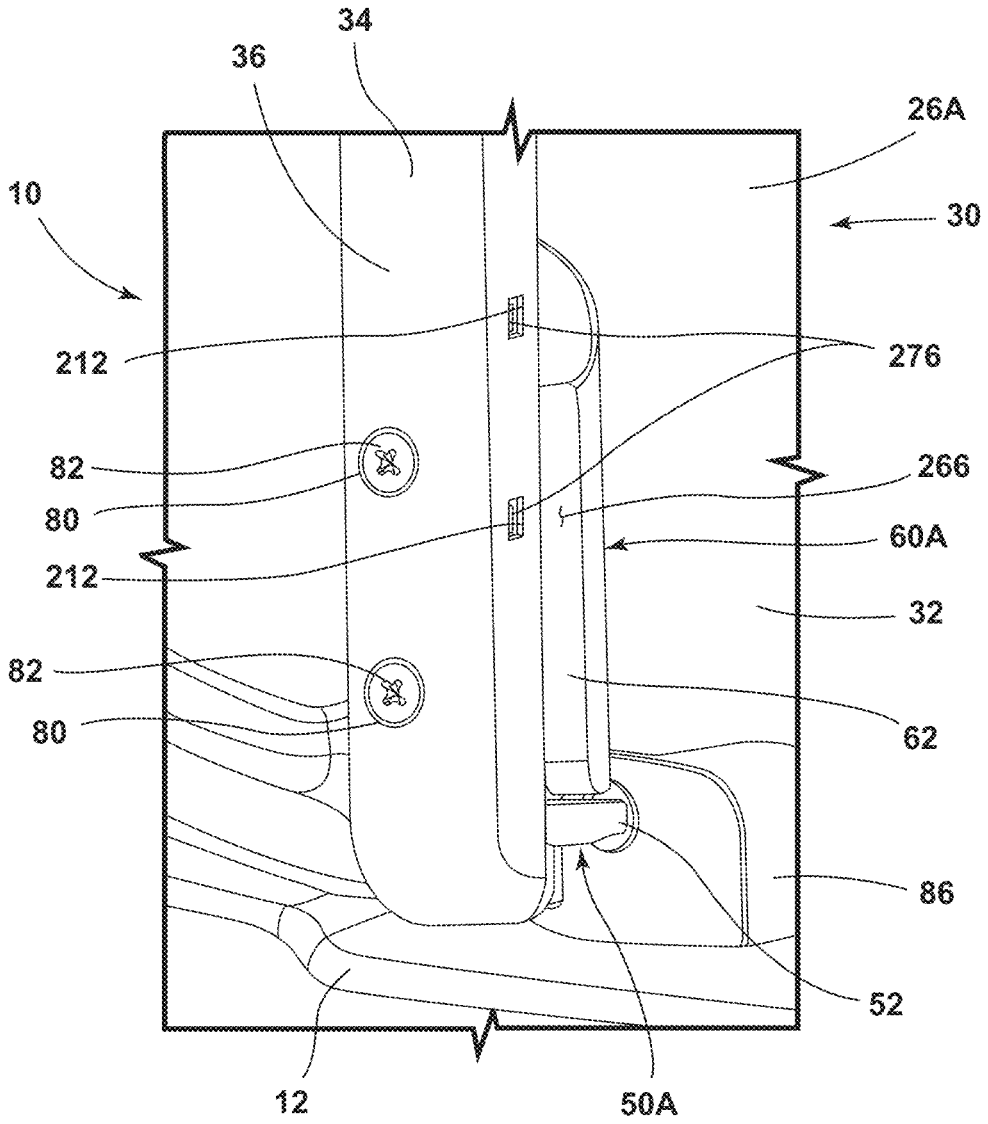
FIG. 21 is another perspective view of what is illustrated in FIG. 20, further illustrating fasteners extending through the fastener receivers through the C-shaped lip of the lid and into the hinge bracket (and ultimately into the hinge), to interconnect the lid, the hinge bracket, and the hinge.
Figure 22:
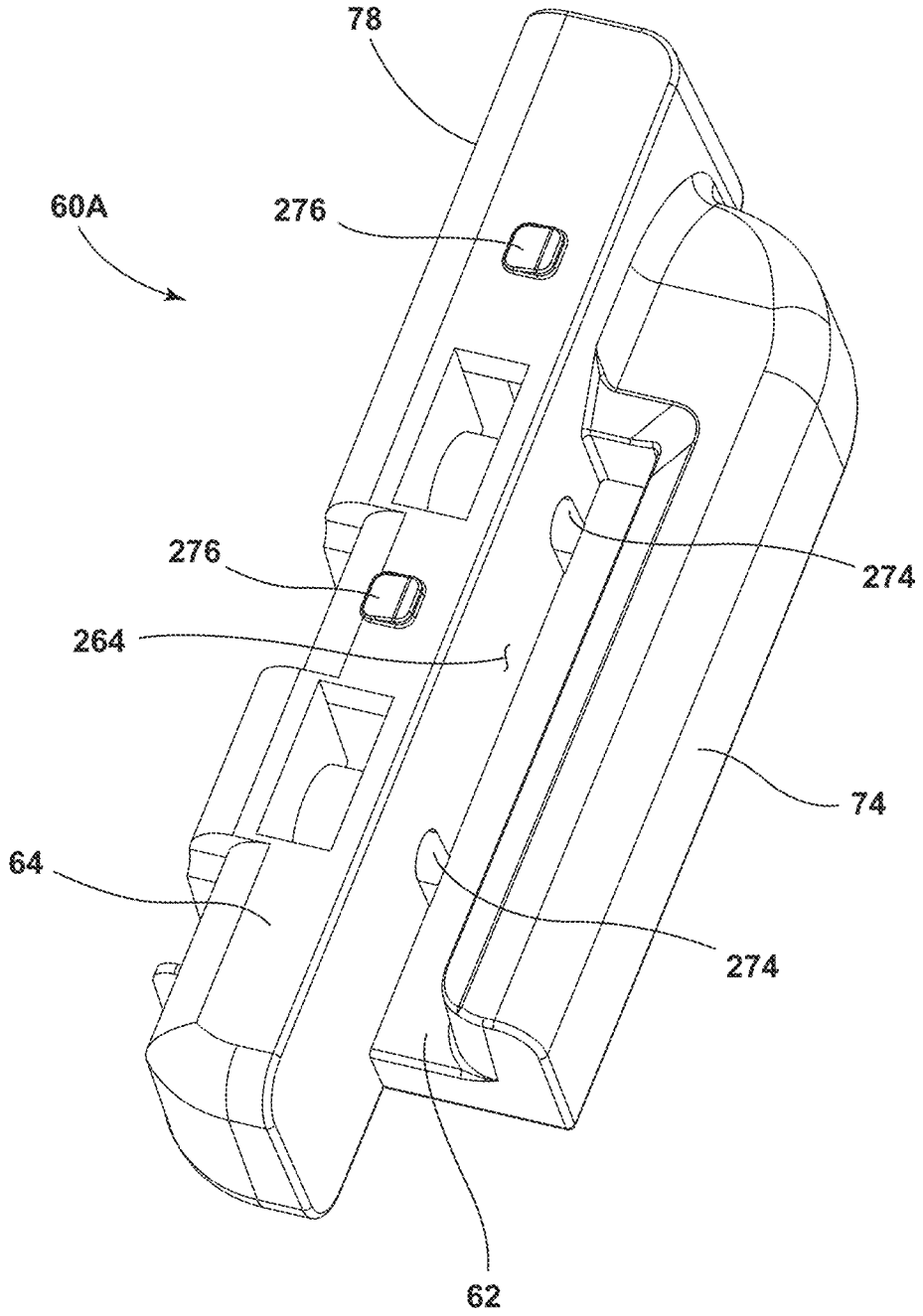
FIG. 22 is a perspective view of the hinge bracket of FIG. 20, illustrating an elongated slot to receive the hinge of FIG. 20 available at a bottom side of the hinge bracket, snap-fit features extending from the bottom side to snap-fit into snap-fit receivers of the C-shaped lip of the lid, and the fastener receivers extending through the hinge bracket from the outboard side and through a first surface of the elongated slot.
Figure 23:
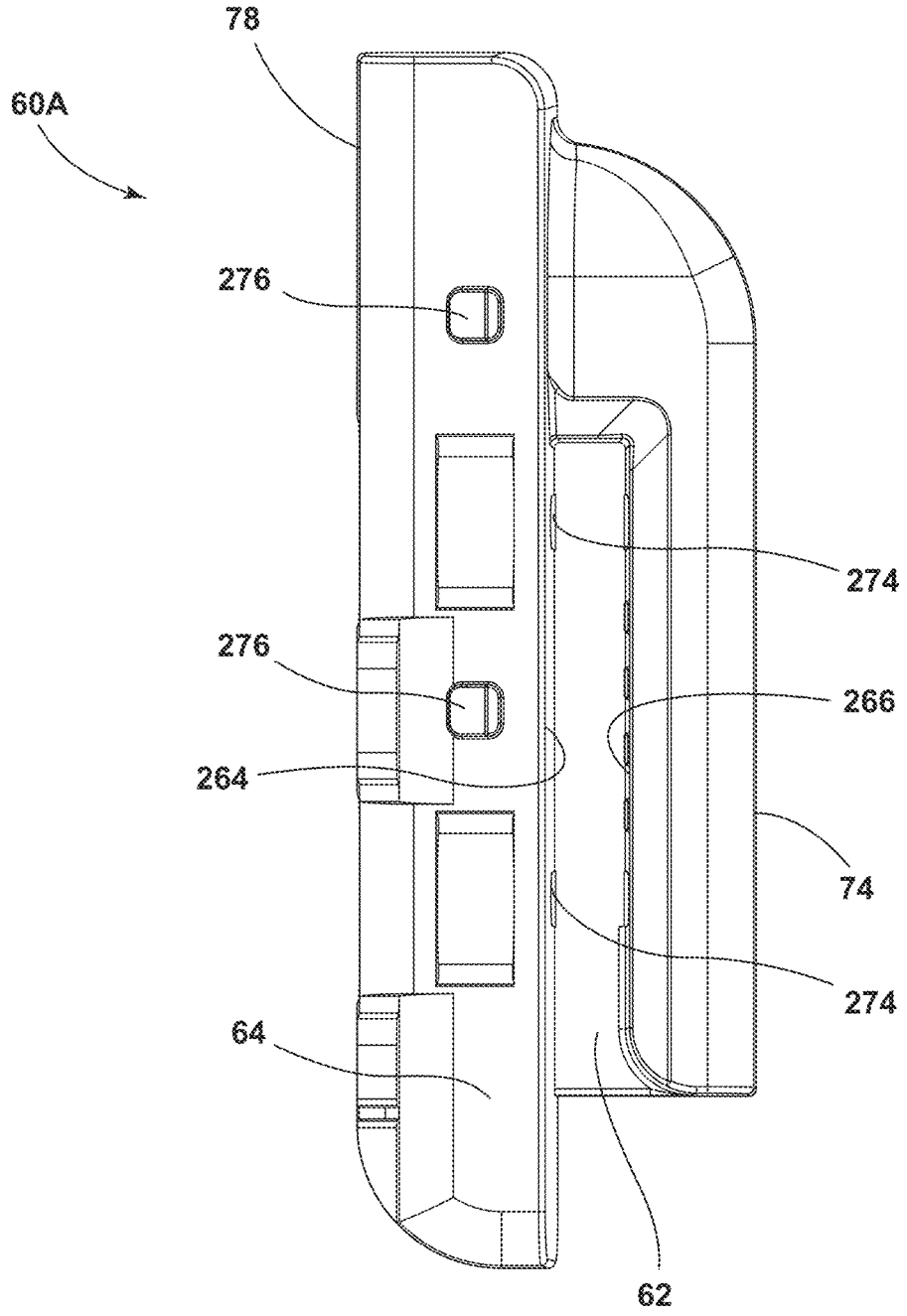
FIG. 23 is a view of the bottom side of the hinge bracket of FIG. 20, illustrating the elongated slot having the first surface and also a second surface opposing the first surface.
Figure 24:
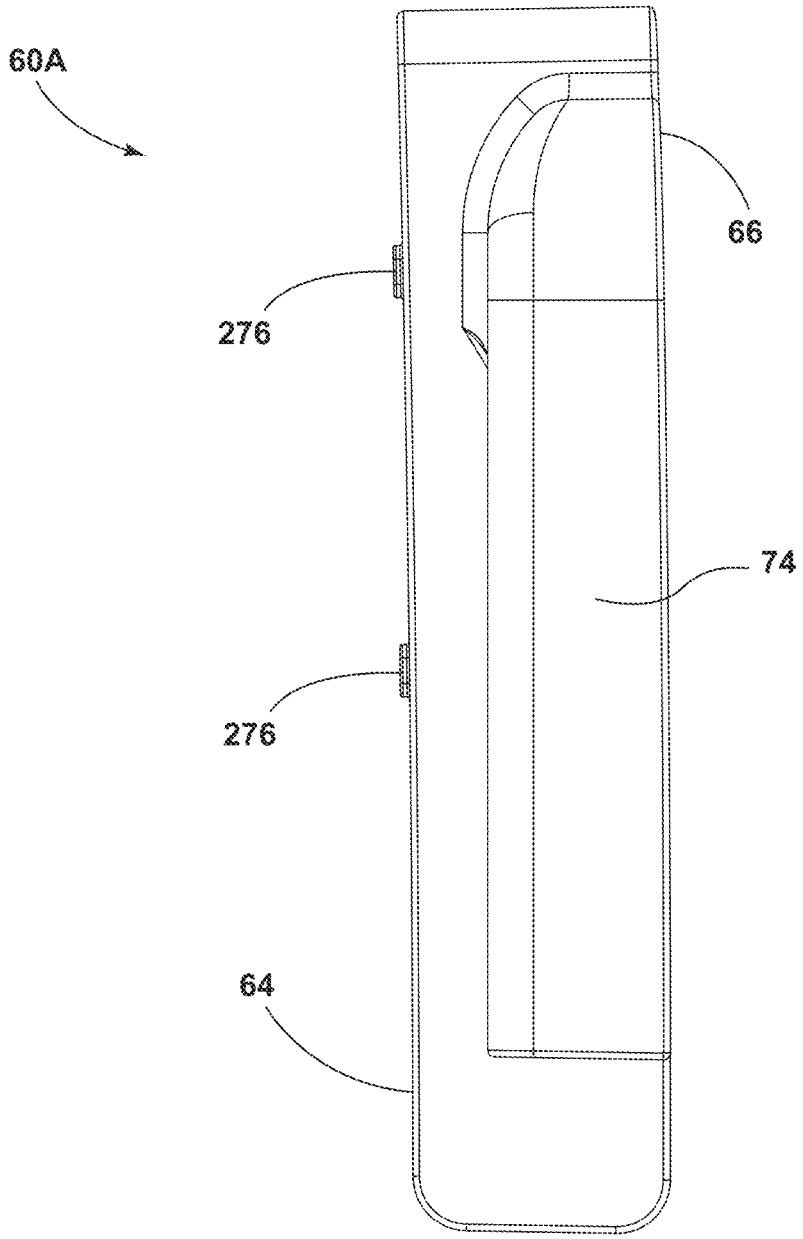
FIG. 24 is a view of an inboard side of the hinge bracket of FIG. 20, illustrating the snap-fit features extending away from the bottom side.
Figure 25:
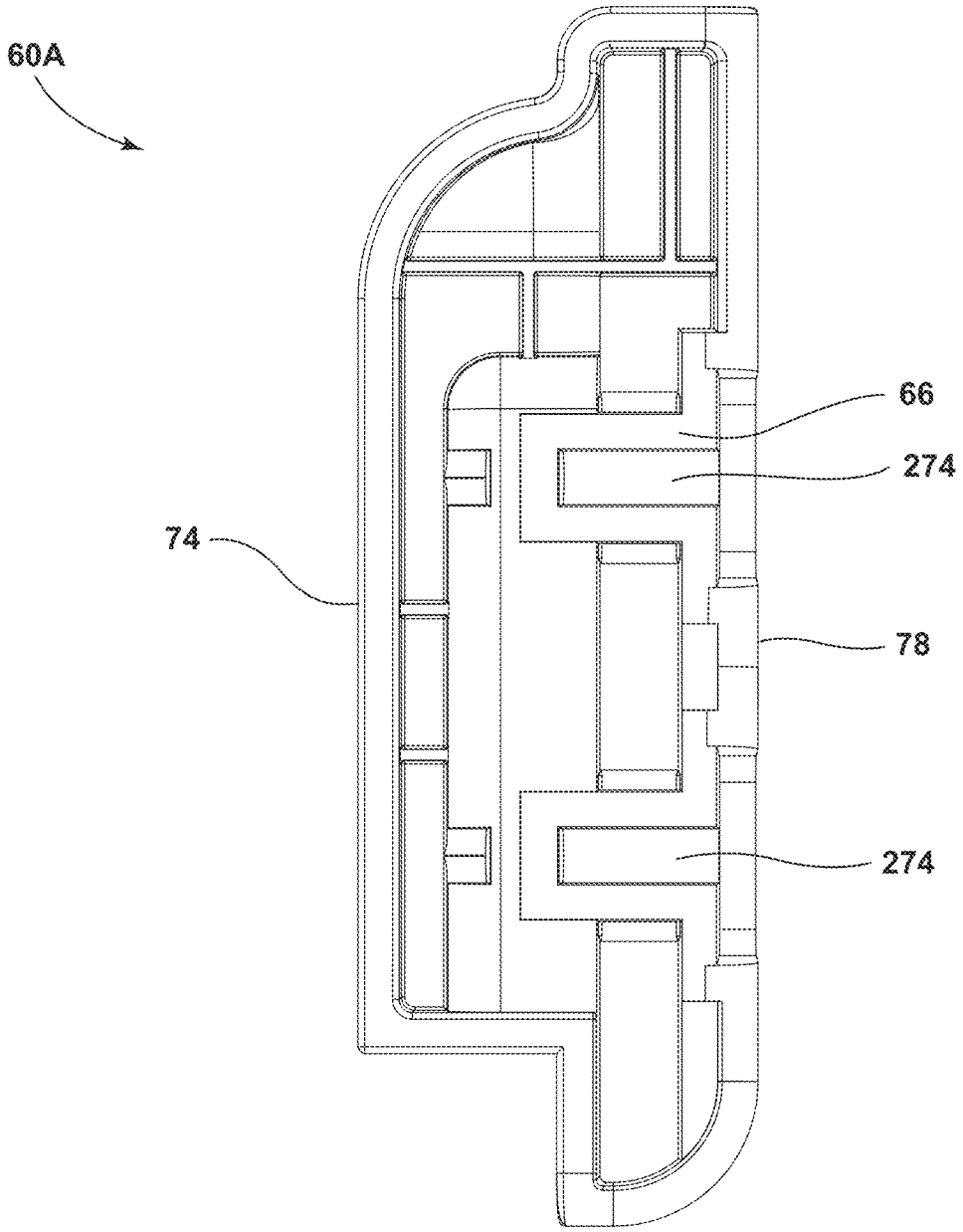
FIG. 25 is a view of the top side of the hinge bracket of FIG. 20, illustrating the fastener receivers available at the outboard side.
Figure 26:
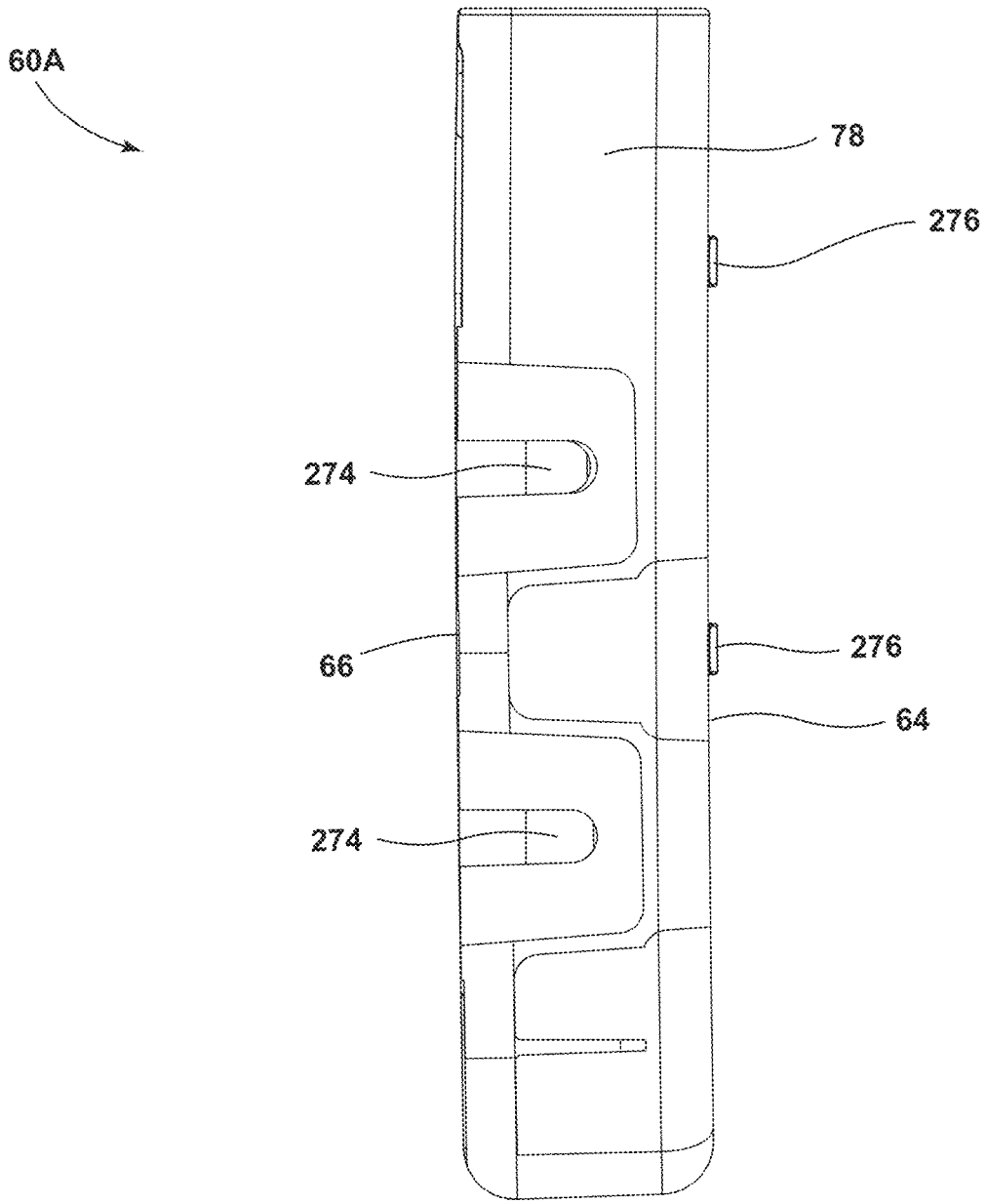
FIG. 26 is a view of the outboard side of the hinge bracket of FIG. 20, illustrating the fastener receivers available.
Figure 27:
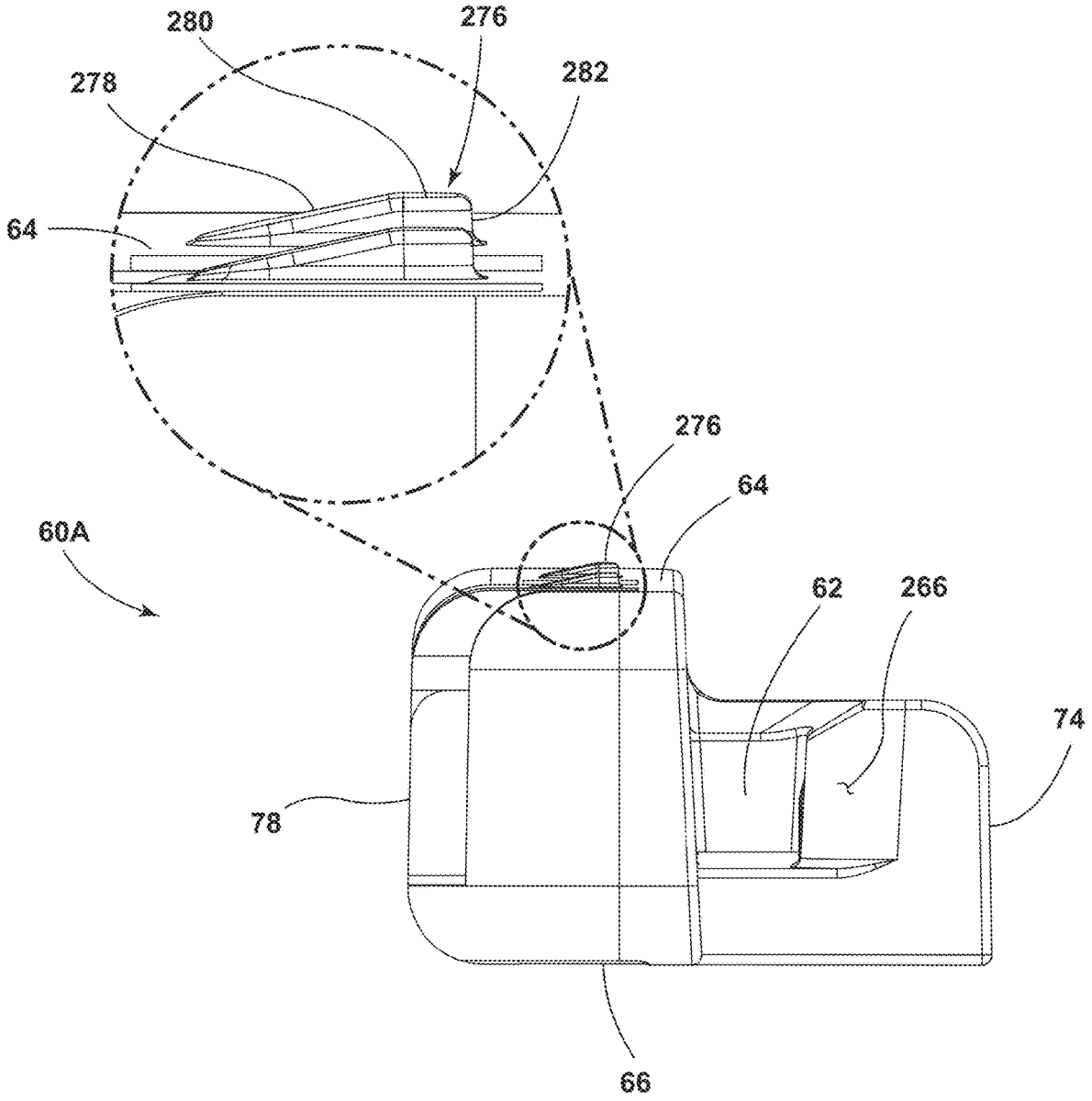
FIG. 27 is an elevational view of the hinge bracket of FIG. 20, illustrating the snap-fit features having a sloped surface terminating in an apex, which forms a retaining wall extending orthogonally from the bottom surface to the apex.
Figure 28:
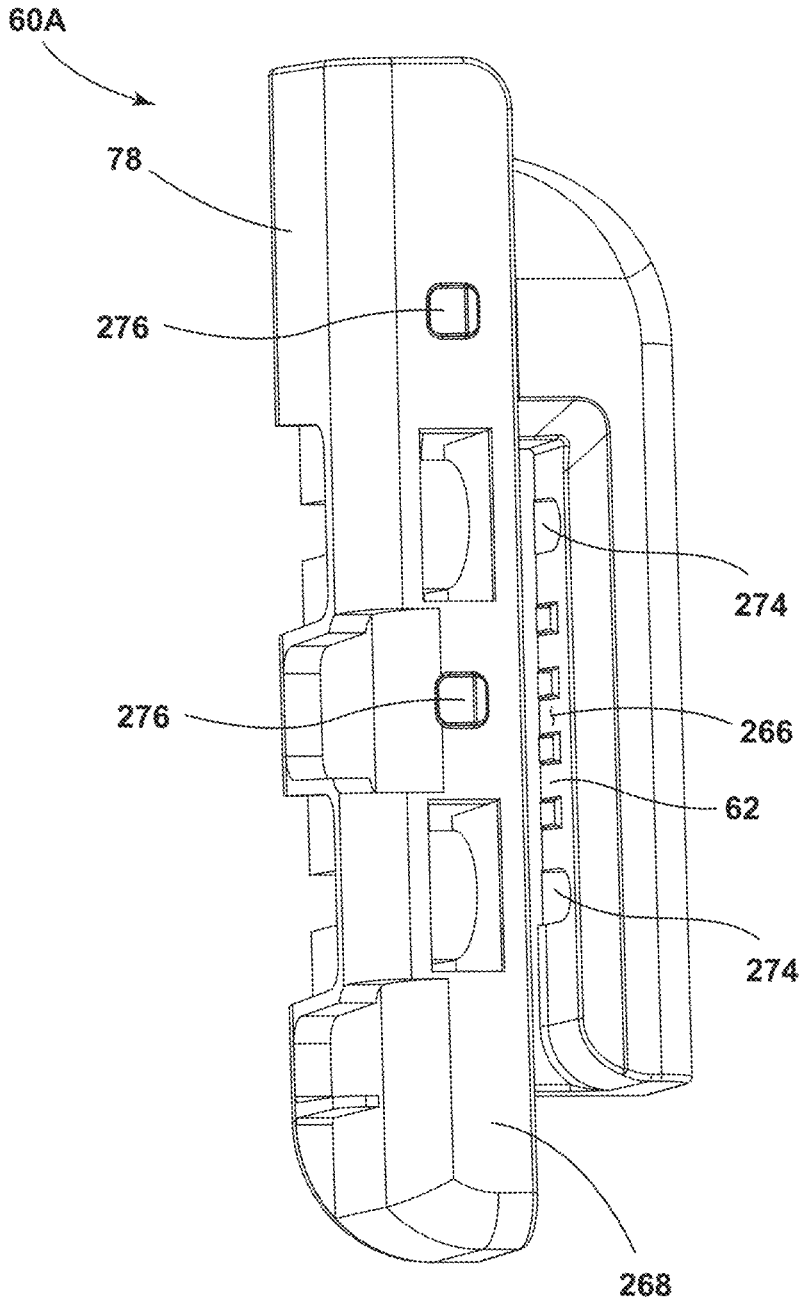
FIG. 28 is another perspective view of the hinge bracket of FIG. 20, illustrating the fastener receivers further extending through the second surface of the elongated slot.
Figure 29:
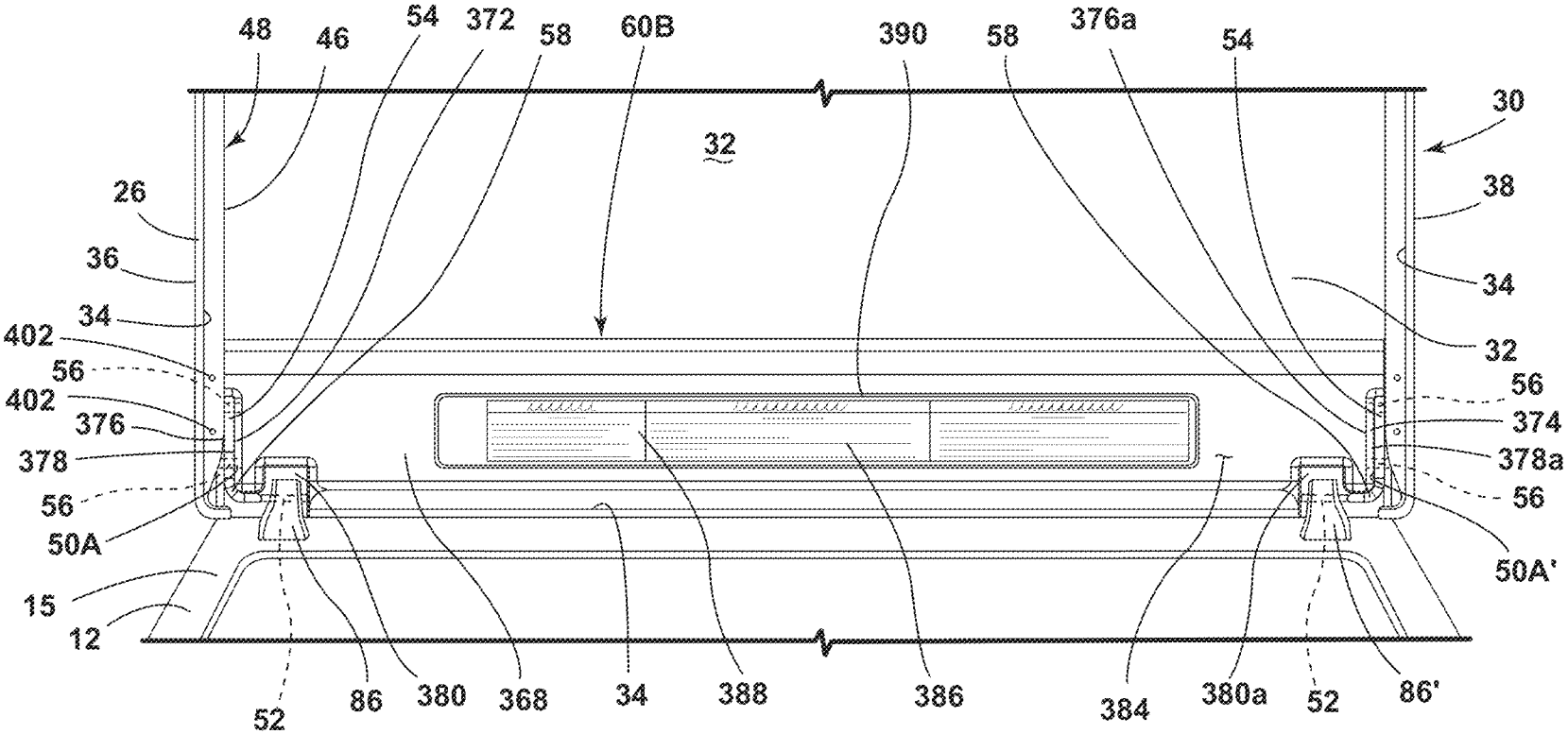
FIG. 29 is a view of another embodiment of a hinge bracket for use to connect the hinge of FIG. 20 to the lid of FIG. 1, illustrating the hinge bracket extending between a first lateral side of the lid to a second lateral side of the hinge bracket, and providing an elongated flat surface to provide consumer instructions or consumer warnings or both.
Figure 30:
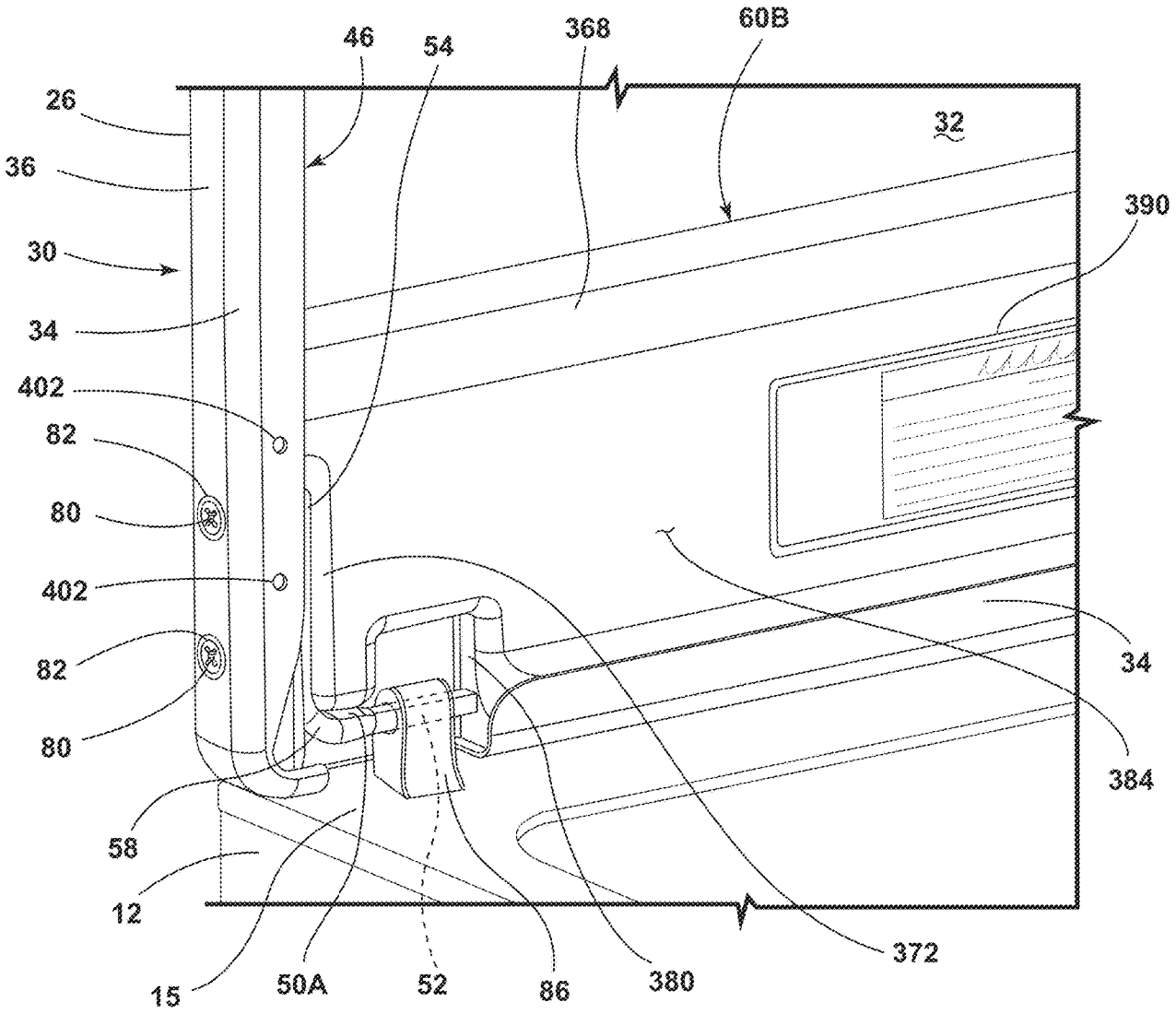
FIG. 30 is a perspective view akin to area III of FIG. 2A but with the hinge bracket and hinge of FIG. 29 (which is the hinge embodiment from FIG. 20), illustrating fasteners extending through the fastener receivers of the C-shaped lip of the lid and into the hinge bracket and ultimately into fastener receivers of the hinge, to interconnect the lid, hinge bracket, and hinge.
Figure 31:
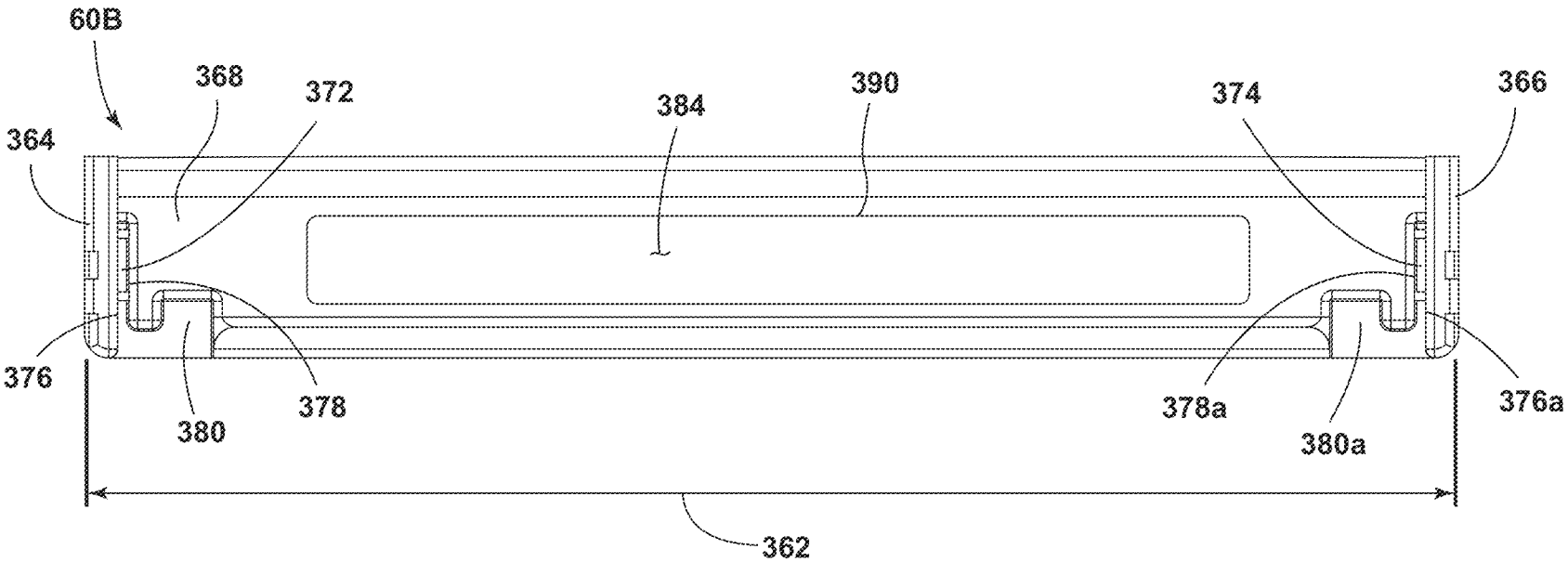
FIG. 31 is a view of a bottom side of the hinge bracket of FIG. 29, illustrating a first elongated slot to receive the hinge near a first side of the hinge bracket, a second elongated slot to receive a second hinge near a second side of the hinge bracket, and a length defined as the distance between the first side and the second side.
Figure 32:
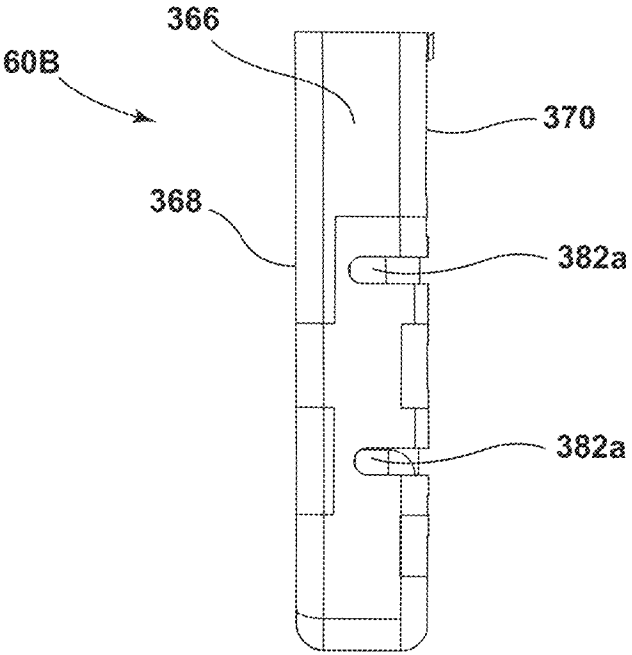
FIG. 32 is a view of the second side of the hinge bracket of FIG. 29, illustrating fastener receivers extending into the hinge bracket from the second side.
Figure 33:
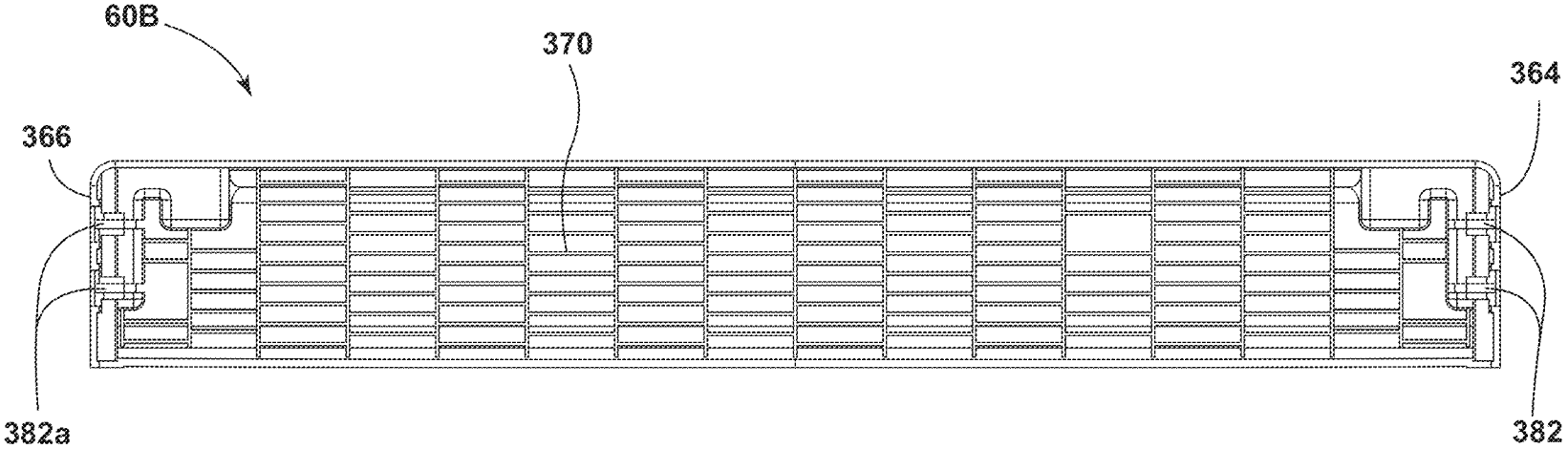
FIG. 33 is a view of the top side of the hinge bracket of FIG. 29, illustrating fastener receivers extending into the hinge bracket at both the first side and the second side.
Figure 34:
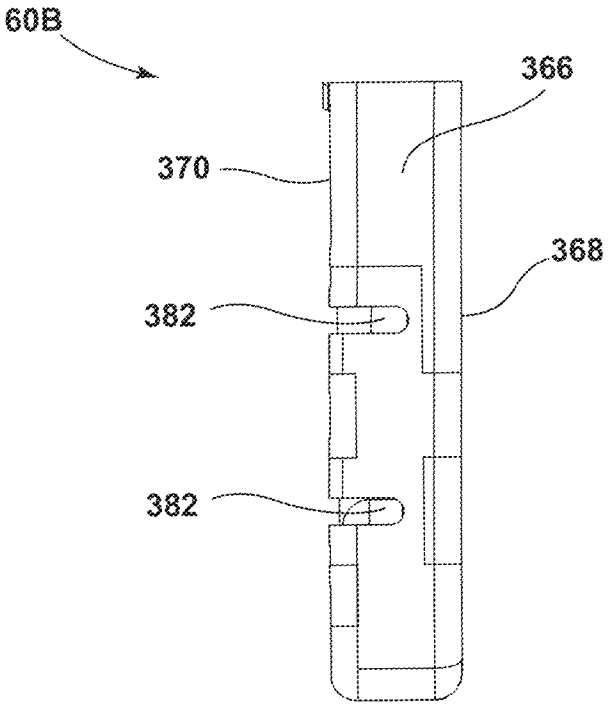
FIG. 34 is a view of the first side of the hinge bracket of FIG. 29.
Figure 35:
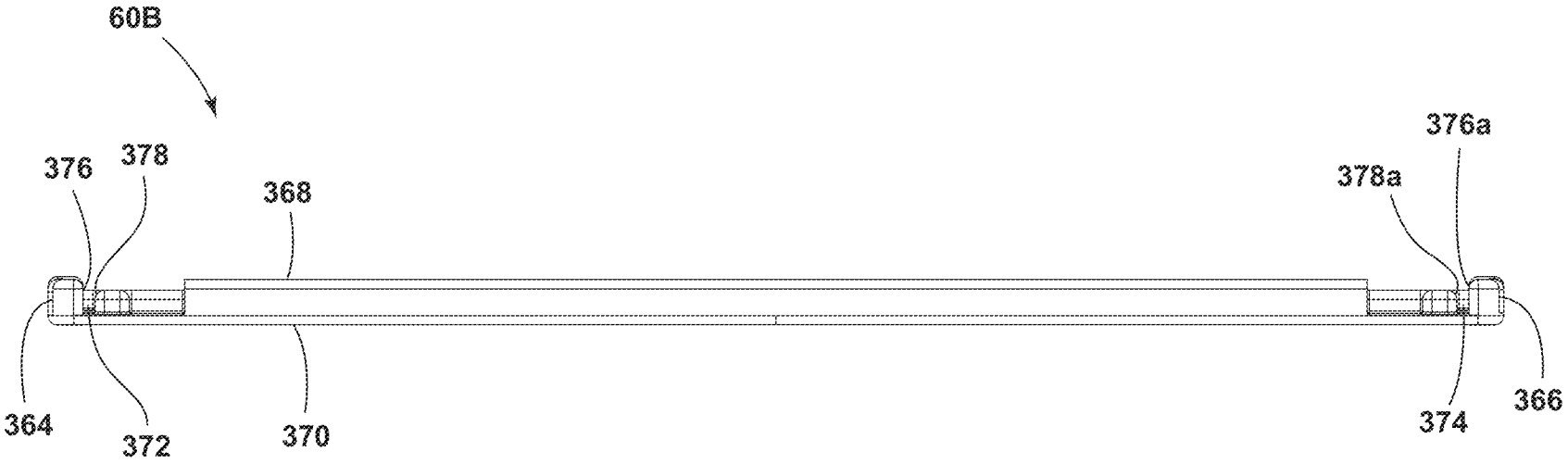
FIG. 35 is an elevational view of the hinge bracket of FIG. 29, illustrating each of the first elongated slot and the second elongated slot having a first surface opposing a second surface.
Figure 36:
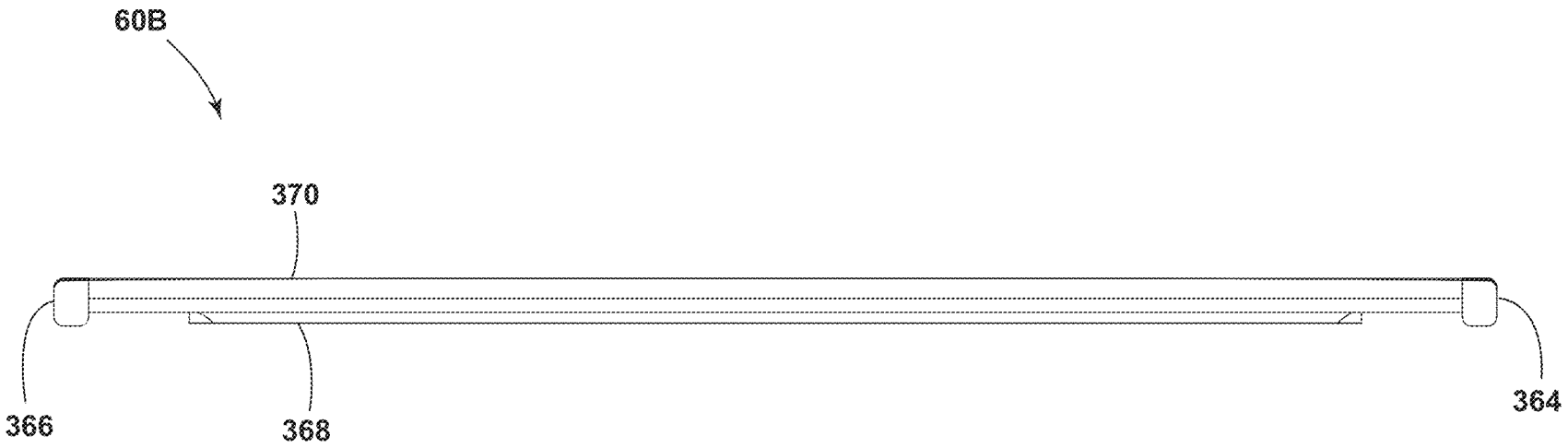
FIG. 36 is another elevational view of the hinge bracket of FIG. 29, but from the opposite side as FIG. 35.
Figure 37:
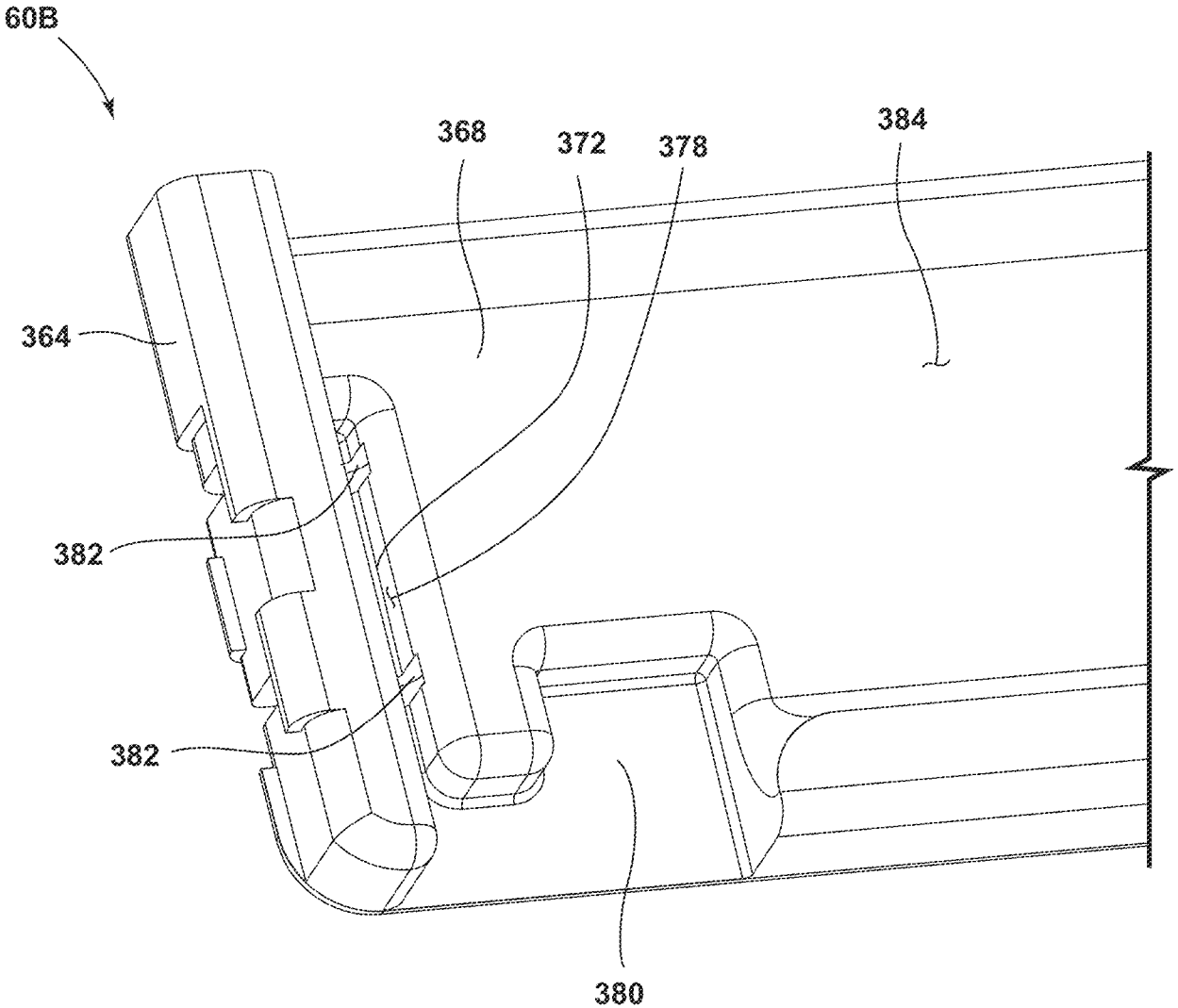
FIG. 37 is a close-up perspective view near the first side of the hinge bracket of FIG. 29, illustrating the fastener receivers further extending through the second surface of the first elongated slot, as well as an indented portion near the first elongated slot to provide room for the hinge receiver when the lid is in the closed position.
Figure 38:
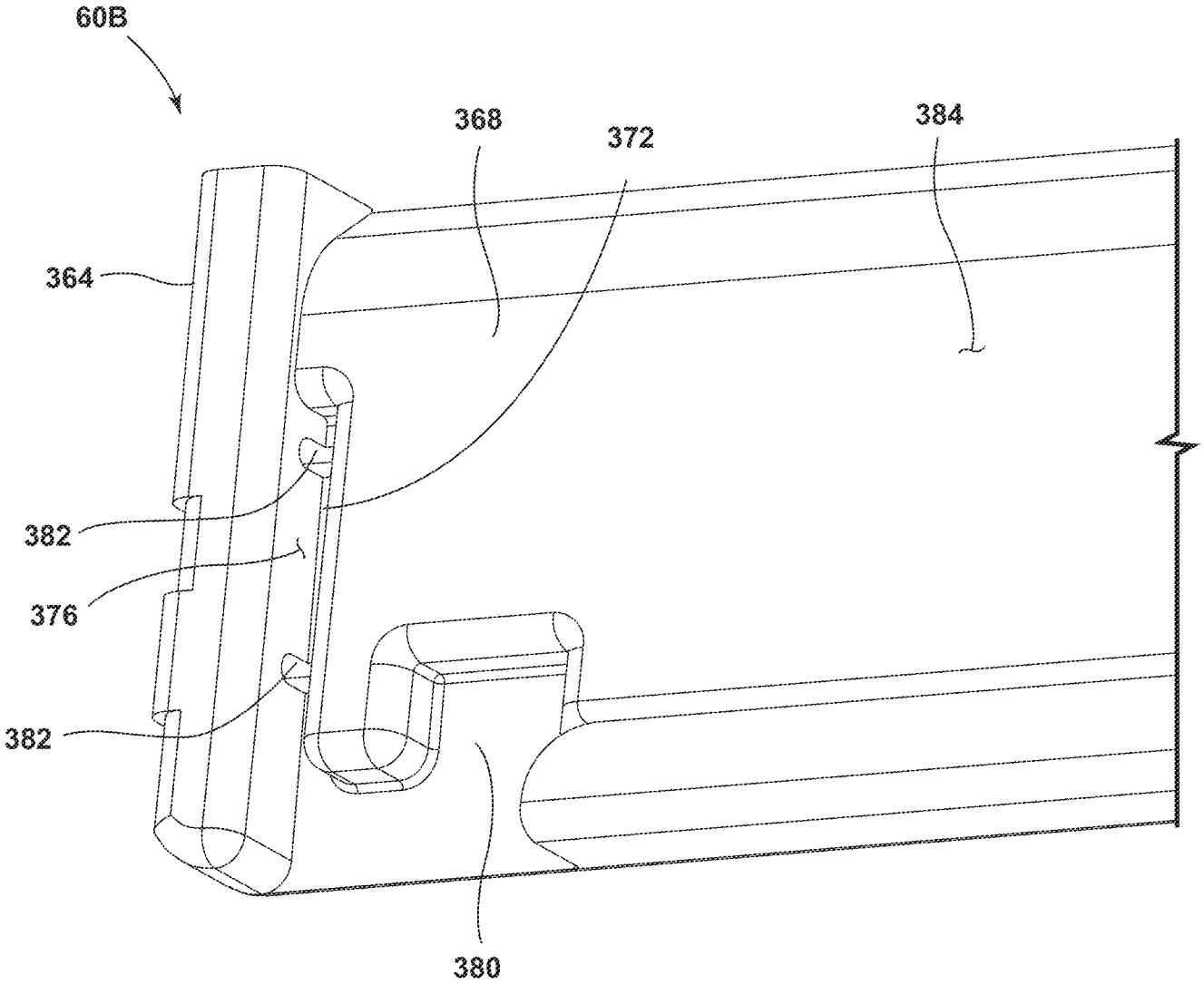
FIG. 38 is another close-up perspective view near the first side of the hinge bracket of FIG. 29, illustrating the fastener receivers extending through the first surface of the first elongated slot.
Figure 39:
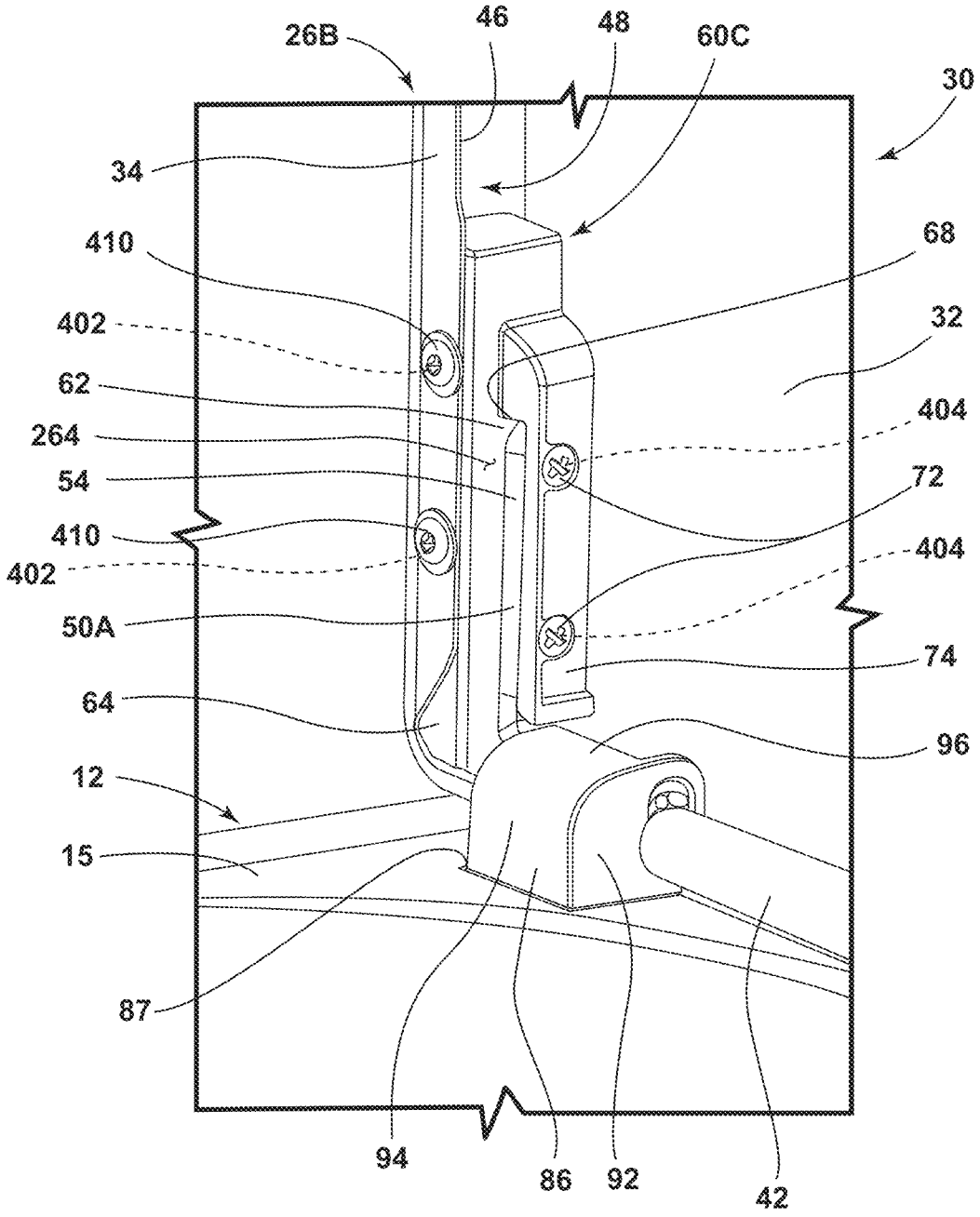
FIG. 39 is a perspective view of area III of FIG. 2A again, but this time illustrating an alternative embodiment hinge bracket and an alternative embodiment lid having fastener receivers that cooperate to receive fasteners that face the top portion of the cabinet when the lid is in the closed position.
Figure 40:
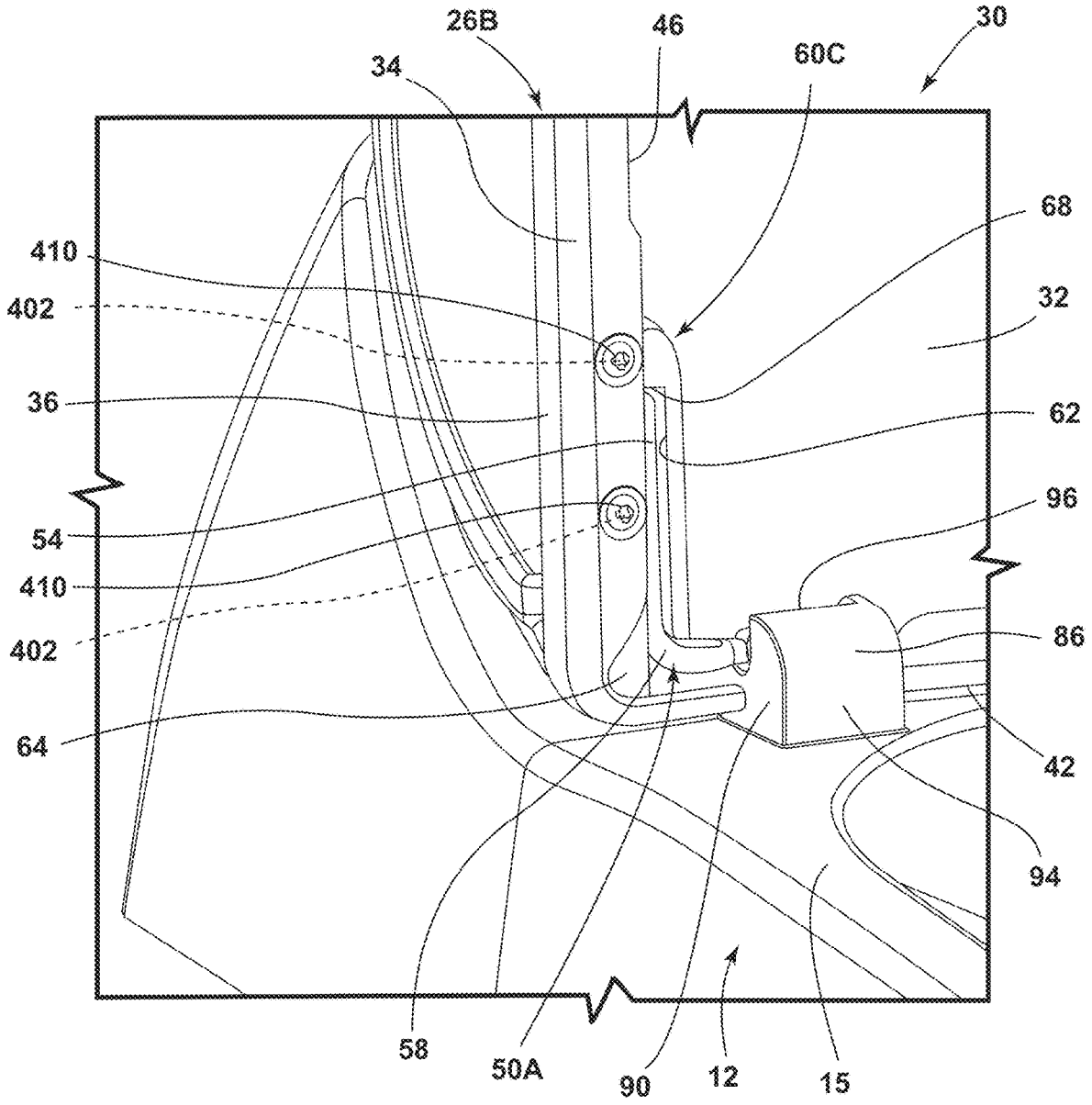
FIG. 40 is another perspective view of what is shown in FIG. 39, illustrating the elongated slot of the hinge bracket receiving the connector portion of the hinge.
Figure 41:
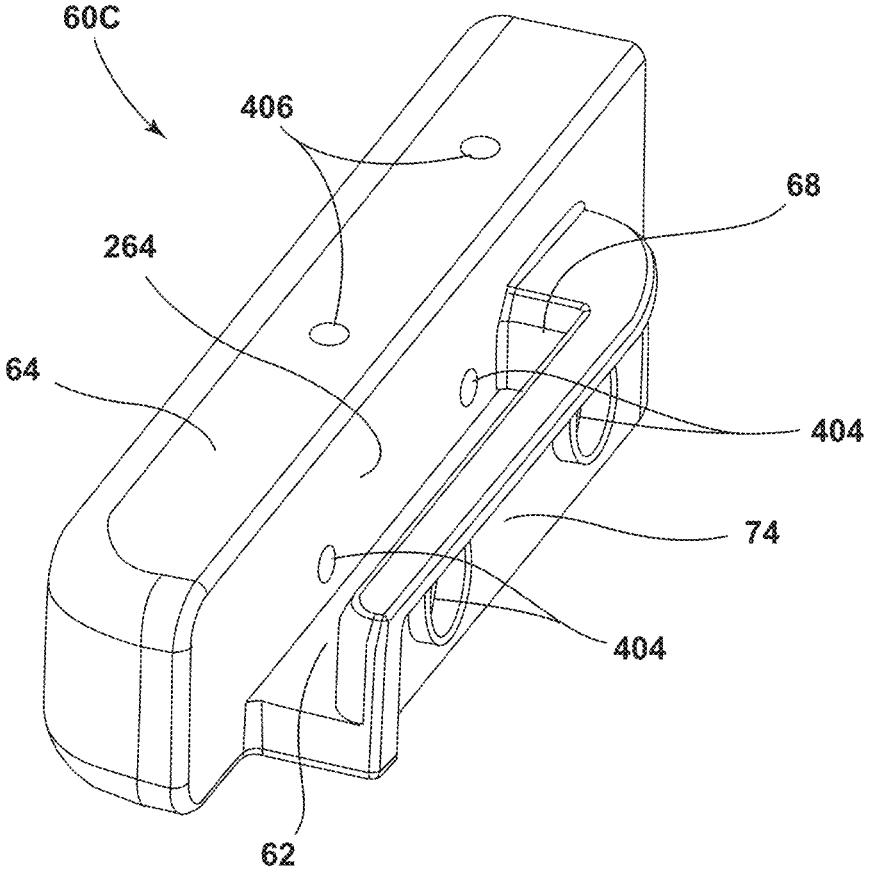
FIG. 41 is a perspective view of the hinge bracket of FIG. 39, illustrating first fastener receivers disposed at a first side facing the midline to the laundry appliance when coupled to the lid, and second fastener receivers disposed at a bottom side and extending orthogonally to the first fastener receivers.
Figure 42:
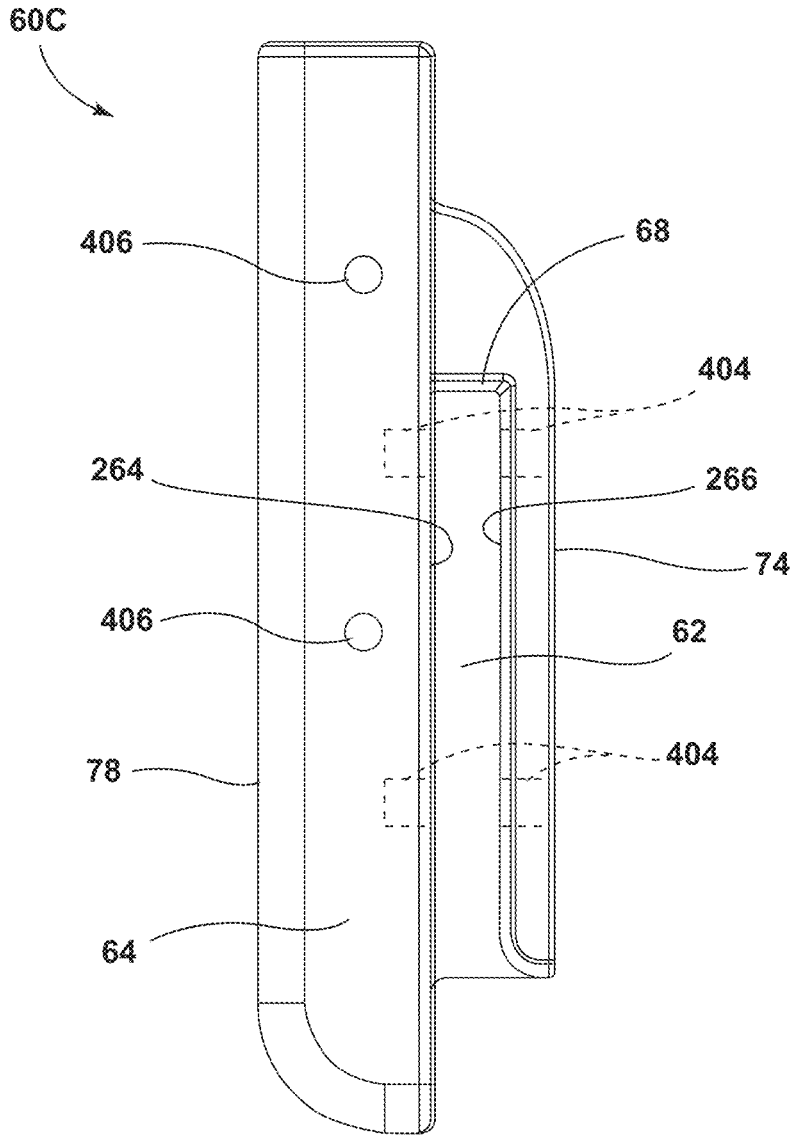
FIG. 42 is a bottom view of the hinge bracket of FIG. 39, illustrating a first surface and a second surface parallel to the first surface defining the elongated slot.
Figure 43:
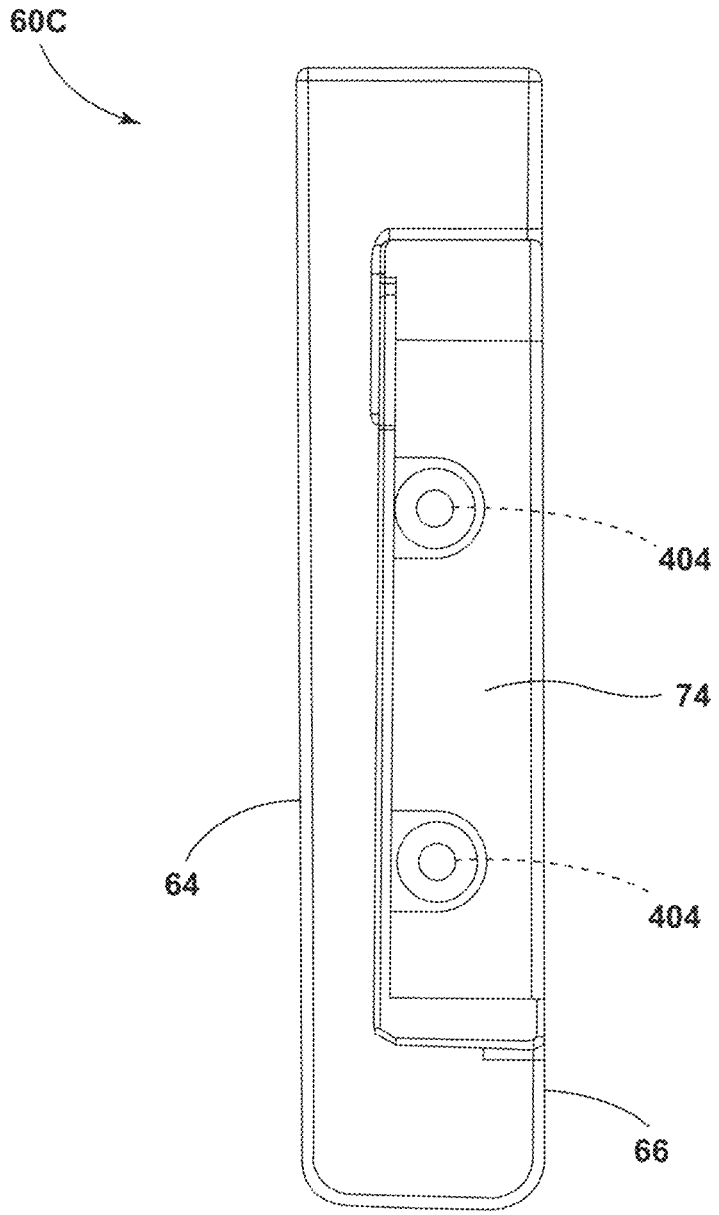
FIG. 43 is a side view of the hinge bracket of FIG. 39, illustrating the first fastener receivers extending into the hinge bracket from the first side.
Figure 44:
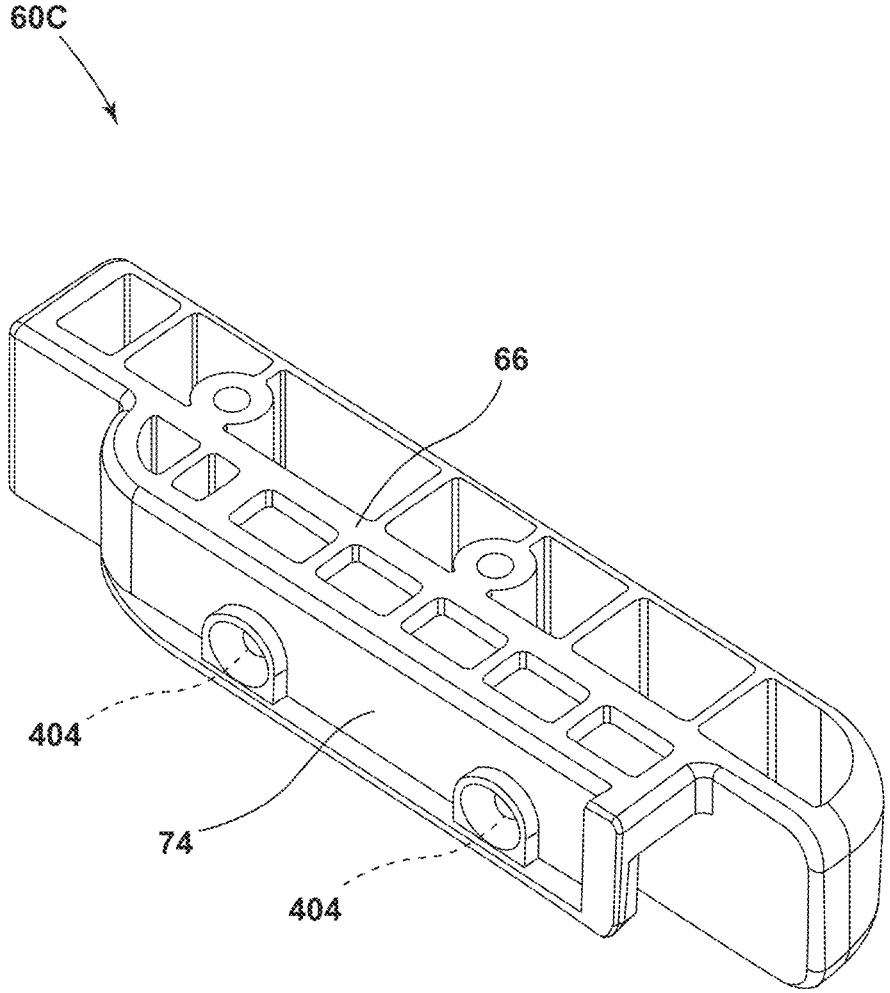
FIG. 44 is another perspective view of the hinge bracket of FIG. 39, illustrating a top side of the hinge bracket.
Figure 45:
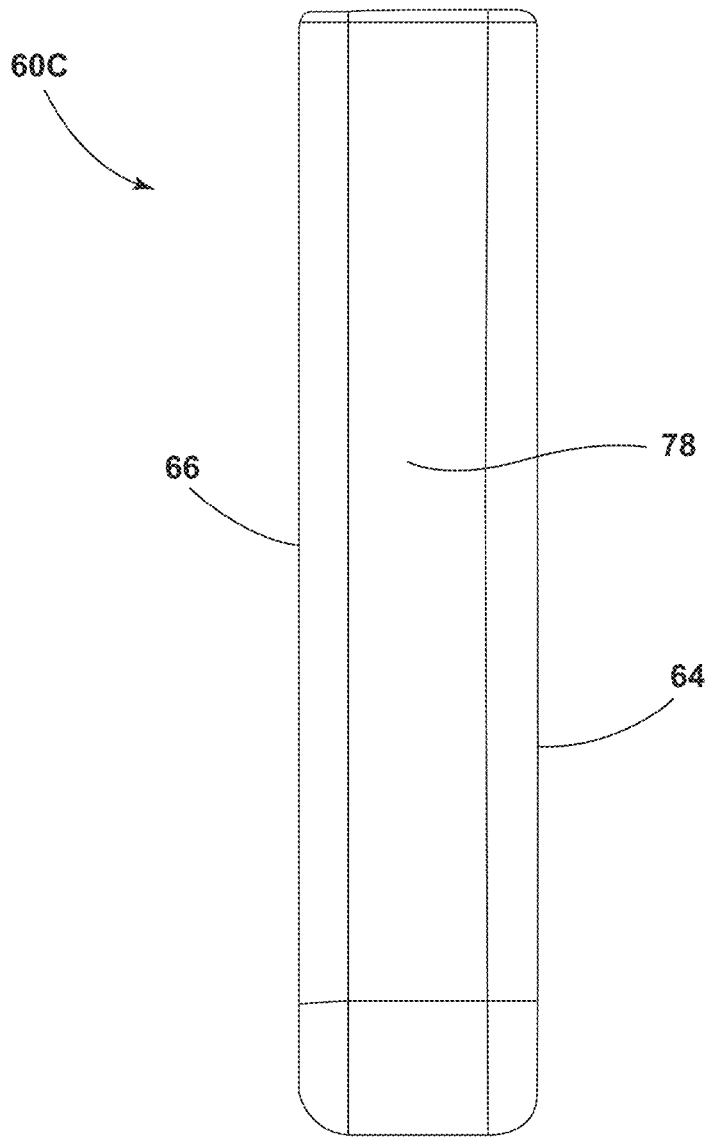
FIG. 45 is another side view of the hinge bracket of FIG. 39, illustrating the second side of the hinge bracket not having fastener receivers.

Referring now particularly to FIG. 19, in embodiments, the first end 52 of the hinge 50 includes a cam 106. The cam 106 is disposed in the inner chamber 98 of the hinge receiver 86. The hinge 50 is operably connected to the lid 26, such as with the connector portion 54 (as illustrated in FIG. 4). When the lid 26 is in the closed position 28 (illustrated in phantom, see also FIG. 1), the cam 106 is not abutting the inner surface 100 of the inner chamber 98 of the hinge receiver 86. However, when the lid 26 is in the open position 30, the cam 106 abuts the inner surface 100 of the hinge receiver 86, and the inner surface 100 prevents the cam 106 and thus the lid 26 from further rotation past the open position 30. As the lid 26 transitions from the closed position 28 to the open position 30, the hinge 50 rotates upon the first curved surface 102 and the second curved surface 104 of the hinge receiver 86. In the illustrated embodiment, the forward wall 94 that transitions into the top wall 96 provides the inner surface 100 of the inner chamber 98 abutting the cam 106 when the lid 26 is in the open position 30 to prevent further rotation of the lid 26. In other words, the inner surface 100 blocks the cam 106 from further rotational movement and, thus, limits the rotational movement of the lid 26 away from the closed position 28 and thereby defines the limit of the open position 30 of the lid 26. However, it should be understood that the inner chamber 98 and the cam 106 can take any form or shape as long as the inner chamber 98 provides the inner surface 100 that allows the cam 106 to rotate while the lid 26 transitions to, from, and between the closed position 28 and the open position 30 but stops the cam 106 (and thus the lid 26) from rotating beyond the open position 30.

Referring now to FIGS. 20-28, the laundry appliance 10 includes an alternative embodiment lid 26A, an alternative embodiment hinge 50A, and an alternative embodiment hinge bracket 60A. The alternative embodiment lid 26A is the same as the lid 26 described above, except the lid 26A further includes snap-fit receivers 212 through the C-shaped lip 34. The purpose of the snap-fit receivers 212 is discussed below. In embodiments, the snap-fit receivers 212 are disposed through the portion of the C-shaped lip 34 that is parallel to the top wall 32 of the lid 26.

The hinge 50A is similar to the hinge 50, and includes the first end 52, the connector portion 54, and the curved portion 58 between the first end 52 and the connector portion 54. The first end 52 extends laterally into the hinge receiver 86 of the cabinet 12 in a direction towards the midline 16 of the cabinet 12, and, in embodiments, includes the cam 106 as described above. The connector portion 54 and the first end 52 are orthogonal to each other. The connector portion 54 has fastener receivers 56. The curved portion 58 of the hinge 50A does not extend laterally further toward the first lateral side 36 of the lid 26 than the connector portion 54, as in the hinge 50 described above. In other embodiments, the curved portion 58 of the hinge 50A does extend laterally further toward the first lateral side 36 of the lid 26 than the connector portion 54, as in the hinge 50 described above.

The hinge bracket 60A couples the hinge 50A to the lid 26A. The hinge bracket 60A includes the elongated slot 62. The elongated slot 62 has a first surface 264 that opposes a second surface 266, which can form parallel planes. The elongated slot 62 receives the connector portion 54 of the hinge 50A, with the connector portion 54 of the hinge 50A being disposed between the first surface 264 and the second surface 266 of the elongated slot 62.

As described above with the hinge bracket 60, the hinge bracket 60A further includes the bottom side 64, the top side 66, the first side 74, and the second side 78. The bottom side 64 of the hinge bracket 60A faces downward when the lid 26A is in the closed position 28. The top side 66 faces upward when the lid 26A is in the closed position 28. The second side 78 faces laterally outward away from the midline 16 of the cabinet 12.

The hinge bracket 60A further includes snap-fit features 276 that extend outward from the bottom side 64. The snap-fit features 276 include a sloped surface 278 (see FIG. 27) that slopes away from the bottom side 64 in a direction laterally towards the midline 16 of the cabinet 12. The sloped surface 278 terminates at an apex 280 thus forming a retaining wall 282 that extends between the apex 280 and the bottom side 64 of the hinge bracket 60A.

Like the hinge bracket 60, at least a portion of the hinge bracket 60A is disposed in the space 48 of the lid 26A between the edge 46 and the top wall 32. The hinge bracket 60A is forced into the space 48 of the lid 26 so that the snap-fit receivers 212 through the C-shaped lip 34 of the lid 26A receive the snap-fit features 276 of the hinge bracket 60A, thus at least partially connecting the lid 26A and the hinge bracket 60A. The bottom side 64 of the hinge bracket 60A faces the edge 46 of the C-shaped lip 34 of the lid 26A. The top side 66 of the hinge bracket 60A faces the top wall 32 of the lid 26A. The second side 78 of the hinge bracket 60A faces the C-shaped lip 34.

Instead of the fastener receivers that the hinge bracket 60 includes, the hinge bracket 60A includes fastener receivers 274. The fastener receivers 274 extend from the second side 78, through the first surface 264 of the elongated slot 62, and through the second surface 266 of the elongated slot 62. The fastener receivers 274 of the hinge bracket 60A, the fastener receivers 56 of the hinge 50A, and the fastener receivers 80 of the lid 26A all cooperate together (that is, are collinear), to receive the fasteners 82. To secure the lid 26A, the hinge bracket 60A, and the hinge 50A together, the fasteners 82 extend through the fastener receivers 80 of the lid 26A, through the second side 78 of the hinge bracket 60A, through the first surface 264 of the hinge bracket 60A, through the fastener receivers 56 of the hinge 50A, and then through the second surface 266 of the hinge bracket 60A.

Referring now to FIGS. 29-38, the laundry appliance 10 includes an alternative embodiment hinge bracket 60B, which can be utilized with the lid 26, the hinge 50A, a second hinge 50A', and a second hinge receiver 86'. The second hinge 50A' is the same as the hinge 50A but oriented in the opposite direction. The second hinge receiver 86' is the same as the hinge receiver 86 but configured to accept the second hinge 50A' from the opposite direction. The hinge 50A operably connects to the hinge receiver 86, and the second hinge 50A' operably connects to the second hinge receiver 86', to facilitate the lid 26 moving to, from, and between the closed position 28 and the open position 30 and to limit the open position 30 as described above.

The alternative embodiment bracket 60B includes a length 362, which is defined as the distance between a first side 364 and a second side 366 of the hinge bracket 60B. The hinge bracket 60B includes a bottom side 368 and a top side 370. The bottom side 368 faces downward when the lid 26 is in the closed position 28. The top side 370 faces upward when the lid 26 is in the closed position 28.

The hinge bracket 60B further includes a first elongated slot 372 near the first side 364, and a second elongated slot 374 near the second side 366. The first elongated slot 372 has a first surface 376 and a second surface 378 that opposes the first surface 376. The second elongated slot 374 has a first surface 376*a* and a second surface 378*a* that opposes the first surface 376*a*. The hinge bracket 60B further includes a first indentation 380 and a second indentation 380*a*.

The hinge bracket 60B further includes fastener receivers 382 at the first side 364, and fastener receivers 382*a* at the second side 366. The fastener receivers 382 at the first side 364 of the hinge bracket 60B extend through the first side 364, through the first surface 376 of the first elongated slot 372, and through the second surface 378 of the first elongated slot 372. The fastener receivers 382*a* at the second side 366 of the hinge bracket 60B extend through the second side 366, through the first surface 376*a* of the second elongated slot 374, and through the second surface 378*a* of the second elongated slot 374.

The hinge bracket 60B further includes an elongated flat surface 384 at the bottom side 368. The elongated flat surface 384 thus faces downward when the lid 26 is in the closed position 28. The elongated flat surface 384 is coplanar with the top wall 32 of the lid 26. The elongated flat surface 384 extends lengthwise from approximately the first elongated slot 372 to the second elongated slot 374 of the hinge bracket 60B. The elongated flat surface 384 provides opportunity for the hinge bracket 60B to further include either consumer instructions 386 or consumer warnings 388 or both on the elongated flat surface 384 that is visible to the consumer when the lid 26 is in the open position 30. The consumer instructions 386 or consumer warnings 388 or both can be printed directly onto the elongated flat surface 384. Alternatively, the consumer instructions 386 or consumer warnings 388 or both can be on a sticker 390 that is applied to the elongated flat surface 384.

The hinge bracket 60B operably couples both the hinge 50A and the second hinge 50A' to the lid 26. At least a portion of the hinge bracket 60B at the first side 364 of the hinge bracket 60B is disposed in the space 48 of the lid 26 at the first lateral side 36. At least a portion of the hinge bracket 60B at the second side 366 of the hinge bracket 60B is disposed in the space 48 of the lid 26 at the second lateral side 38. The bottom side 368 of the hinge bracket 60B faces the edge 46 of the C-shaped lip 34 at both the first lateral side 36 and the second lateral side 38 of the lid 26. The top side 370 of the hinge bracket 60B faces the top wall 32 of the lid 26. The first side 364 of the hinge bracket 60B faces the C-shaped lip 34 at the first lateral side 36 of the lid 26. The second side 366 of the hinge bracket 60B faces the C-shaped lip 34 at the second lateral side 38 of the lid 26.

The first elongated slot 372 of the hinge bracket 60B receives the connector portion 54 of the hinge 50A. The second elongated slot 374 of the hinge bracket 60B receives the connector portion 54 of the second hinge 50A'. The connector portion 54 of the hinge 50A is disposed between the first surface 376 and the second surface 378 of the first elongated slot 372. The connector portion 54 of the second hinge 50A' is disposed between the first surface 376*a* and the second surface 378*a* of the second elongated slot 374.

The fastener receivers 382 at the first side 364 of the hinge bracket 60B, the fastener receivers 80 through the C-shaped lip 34 at the first lateral side 36 of the lid 26, and the fastener receivers 56 of the connector portion 54 of the hinge 50A all cooperate (that is, are collinear) to receive the fasteners 82. The fasteners 82 extend through the fastener receivers 80 of the C-shaped lip 34 at the first lateral side 36 of the lid 26, through the first side 364 of the hinge bracket 60B, through the first surface 376 of the first elongated slot 372, through the fastener receivers 56 of the connector portion 54 of the hinge 50A, and through the second surface 378 of the first elongated slot 372 of the hinge bracket 60B, to fasten the lid 26, the hinge bracket 60B, and the hinge 50A together. The fastener receivers 382*a* at the second side 366 of the hinge bracket 60B, the fastener receivers (not separately illustrated, but identical to fastener receivers 80) through the C-shaped lip 34 at the second lateral side 38 of the lid 26, and the fastener receivers 56 of the connector portion 54 of the second hinge 50A' all cooperate (that is, are collinear) to receive fasteners (not separately illustrated, but identical to fasteners 82). The fasteners (identical to fasteners 82) extend through the fastener receivers (identical to fastener receivers 80) of the C-shaped lip 34 at the second lateral side 38 of the lid 26, through the second side 366 of the hinge bracket 60B, through the first surface 376*a* of the second elongated slot 374, through fastener receivers 56 of the connector portion 54 of second hinge 50A', and through the second surface 378*a* of the second elongated slot 374 of the hinge bracket 60B, to fasten the lid 26, the hinge bracket 60B, and the second hinge 50A' together.

When coupled to the lid 26, the length 362 of the hinge bracket 60B extends essentially from the first lateral side 36 of the lid 26 to the second lateral side 38. The first indentation 380 of the hinge bracket 60B at least partially surrounds the hinge receiver 86 receiving the hinge 50A when the lid 26 is in the closed position 28. The second indentation 380*a* of the hinge bracket 60B at least partially surrounds the second hinge receiver 86' receiving the second hinge 50A' when the lid 26 is in the closed position 28.

Referring now to FIGS. 39-45, the laundry appliance 10 includes an alternative embodiment hinge bracket 60C for use with the hinge 50A and an alternative embodiment lid 26B. The alternative embodiment lid 26B is like the lid 26 except that the lid 26B includes fastener receivers 402 through the C-shaped lip 34 that are disposed adjacent to the portion of the C-shaped lip 34 that extends parallel to the top wall 32 of the lid 26B.

The alternative embodiment hinge bracket 60C includes the elongated slot 62. The elongated slot 62 includes the first surface 264 and the second surface 266 that opposes the first surface 264. The hinge bracket 60C further includes the bottom side 64 and the top side 66 that face in opposite directions. The hinge bracket 60C further includes the first side 74 and the second side 78. The first side 74 and the second side 78 face in opposite directions. The elongated slot 62 is open at the bottom side 64.

The hinge bracket 60C further includes first fastener receivers 404. The first fastener receivers 404 are open at the first side 74 of the hinge bracket 60C. The first fastener receivers 404 extend from the first side 74, through the second surface 266 defining the elongated slot 62, through the first surface 264 defining the elongated slot 62, and back into the hinge bracket 60C.

The hinge bracket 60C further includes second fastener receivers 406. The second fastener receivers 406 are open at the bottom side 64 of the hinge bracket 60C. The second fastener receivers 406 extend from the bottom side 64 and into the hinge bracket 60C orthogonally to the first fastener receivers 404.

At least a portion of the hinge bracket 60C is nested in the space 48 of the lid 26B. The bottom side 64 of the hinge bracket 60C faces the edge 46 of the C-shaped lip 34. The top side 66 faces the top wall 32 of the lid 26B. The first side 74 faces toward the midline 16. The second side 78 faces toward the C-shaped lip 34 at the first lateral side 36 of the lid 26B. The second fastener receivers 406 of the hinge bracket 60C cooperate with fastener receivers 402 extending through the C-shaped lip 34 of the lid 26B to receive fasteners 410. The fasteners 410 extend into the fastener receivers 402, through the portion of the C-shaped lip 34 parallel with the top wall 32, and into the second fastener receivers 406 of the hinge bracket 60C, thus interconnecting the hinge bracket 60C and the lid 26B. When the lid 26B is in the closed position 28, the fasteners 410 are hidden from view, which can be desirable.

The elongated slot 62 of the hinge bracket 60C receives the connector portion 54 of the hinge 50A. The connector portion 54 of the hinge 50A is disposed between the first surface 264 and the second surface 266 that define the elongated slot 62. The first fastener receivers 404 cooperate with the fastener receivers 56 of the hinge 50A and receive the fasteners 72. To fasten the hinge 50A and the hinge bracket 60C, the fasteners 72 extend into the first fastener receivers 404 at the first side 74, through the second surface 266, through the fastener receivers 56 of the hinge 50A, and through the first surface 264 and into the hinge bracket 60C.

In at least one aspect, a laundry appliance comprises: a cabinet having a midline; a chamber disposed within the cabinet, and configured to hold an article of clothing for washing or drying; an opening into the chamber; a lid selectively movable to, from, and between a closed position that prevents access to the opening, and an open position that allows access to the opening, the lid having a C-shaped lip having an edge that extends inward when the lid is in the closed position creating a space between a top wall of the lid and the edge of the lip, and fastener receivers through the C-shaped lip; a hinge including: a first end extending laterally into a hinge receiver of the cabinet in a direction towards the midline of the cabinet; a connecter portion having fastener receivers, the connector portion extending at least approximately orthogonally to the first end; and a curved portion between the first end and the connector portion, the curved portion extending laterally further away from the midline than the connector portion; and a hinge bracket coupling the hinge to the lid, the hinge bracket including: an elongated slot receiving the connector portion of the hinge; first fastener receivers extending from the elongated slot laterally inward toward the midline and configured to cooperate with the fastener receivers of the hinge to receive fasteners that fasten the hinge to the hinge bracket; second fastener receivers on an opposite side of the hinge bracket as the first fastener receivers that extend laterally inward toward the midline and configured to cooperate with the fastener receivers through the C-shaped lip of the lid to receive fasteners fastening the lid to the hinge bracket; and an indented portion formed laterally away from the elongated slot and facing the curved portion of the hinge. In an embodiment, the first fastener receivers and the second fastener receivers of the hinge bracket are parallel but not collinear. In an embodiment, the hinge bracket further includes a bottom side that faces downward when the lid is in the closed position and an opening into the elongated slot that is disposed at the bottom side. In an embodiment, the opposite side of the hinge bracket is nested into the C-shaped lip of the lid. In an embodiment, the cabinet having a top portion, and the lid having a first lateral side, a second lateral side, and a front side that are disposed above the top portion of the cabinet when the lid is in the closed position. In an embodiment, the top wall, the C-shaped lip, and the edge of the lip of the lid are adjacent to the top side, the opposite side, and the bottom side of the hinge bracket respectively. In an embodiment, the curved portion of the hinge projects laterally outward from the perspective of the midline toward the C-shaped lip of the lid.

In at least another aspect, a laundry appliance comprises: a cabinet having a midline; a chamber disposed within the cabinet, and configured to hold an article of clothing for washing or drying; an opening into the chamber; a lid selectively movable to, from, and between a closed position that prevents access to the opening, and an open position that allows access to the opening, the lid having a C-shaped lip having an edge that extends inward when the lid is in the closed position creating a space between a top wall of the lid and the edge of the lip, and fastener receivers through the C-shaped lip; a hinge including: a first end extending laterally into a hinge receiver of the cabinet in a direction towards the midline of the cabinet; a connecter portion having fastener receivers, the connector portion extending at least approximately orthogonally to the first end; and a curved portion between the first end and the connector portion; and a hinge bracket coupling the hinge to the lid, the hinge bracket including: an elongated slot receiving the connector portion of the hinge, the elongated slot having a first surface opposing a second surface, the connector portion of the hinge disposed between the first surface and the second surface; at least a portion of the hinge bracket is disposed in the space of the lid, with a bottom side that faces the edge of the C-shaped lip and a top side that faces the top wall of the lid; fastener receivers that cooperate with the fastener receivers through the C-shaped lip to receive fasteners to fasten the lid and the hinge bracket together. In an embodiment, the hinge bracket further includes snap-fit features extending outward from the bottom side. In an embodiment, the lid further includes snap-fit receivers through the C-shaped lip receiving the snap-fit features of the hinge bracket. In an embodiment, the cabinet has a top portion, and the lid has a first lateral side, a second lateral side, and a front side that are disposed above the top portion of the cabinet when the lid is in the closed position. In an embodiment, the hinge bracket includes a first side that faces toward the midline, and a second side that faces the C-shaped lip. In an embodiment, the fastener receivers of the hinge bracket extend from the second side, through the first surface of the elongated slot, and through the second surface of the elongated slot, so that the fasteners extend through the fastener receivers of the lid, through the second side, the first surface, the fastener receivers of the hinge, and through the second surface, to fasten the lid, the hinge bracket, and the hinge together. In an embodiment, the hinge bracket includes a first side that faces toward the midline, and a second side that faces the C-shaped lip. In an embodiment, the fastener receivers of the lid are disposed at a portion of the C-shaped lip that is parallel to the top wall of the lid. In an embodiment, the fastener receivers of the hinge bracket extend from the first side, through the second surface of the elongated slot, and through the first surface of the elongated slot, so that the fasteners extend through the fastener receivers of the hinge bracket at the first side, through the second surface of the elongated slot, through the fastener receivers of the hinge, and through the first surface of the elongated slot, to fasten the hinge bracket and the hinge together. In an embodiment, the hinge bracket further comprises second fastener receivers open at the bottom side of the hinge bracket and extending toward the top side of the hinge bracket orthogonal to the fastener receivers of the hinge bracket, so that fasteners extend through the fastener receivers of the lid and through the second fastener receivers open at the bottom side of the hinge bracket, to fasten the hinge bracket and the lid together. In an embodiment, the laundry appliance further comprises: a second hinge including a first end extending laterally into a hinge receiver of the cabinet in a direction towards the midline of the cabinet, a connecter portion having fastener receivers, the connector portion extending at least approximately orthogonally relative to the first end, a curved portion between the first end and the connector portion. In an embodiment, the lid has a first lateral side and a second lateral side, the C-shaped lip is disposed at each of the first lateral side and the second lateral side, fastener receivers through the C-shaped lip at the first lateral side of the lid, and fastener receivers through the C-shaped lip at the second lateral side of the lid. In an embodiment, the hinge bracket couples both the hinge and the second hinge to the lid, the hinge bracket including a length that extends essentially from the first lateral side of the lid to the second lateral side of the lid. In an embodiment, at least a portion of the hinge bracket is disposed in the space of the lid at the first lateral side and in the space of the lid at the second lateral side, with a bottom side that faces the edge of the C-shaped lip at both the first lateral side and the second lateral side of the lid, a top side that faces the top wall of the lid, a first side that faces the C-shaped lip at the first lateral side and a second side that faces the C-shaped lip at the second lateral side. In an embodiment, the hinge bracket further comprises a first elongated slot receiving the connector portion of the hinge, and a second elongated slot receiving the connector portion of the second hinge, both the first elongated slot and the second elongated slot each having a first surface opposing a second surface, the connector portion of the hinge disposed between the first surface and the second surface of the first elongated slot, and the connector portion of the second hinge disposed between the first surface and the second surface of the second elongated slot. In an embodiment, the hinge bracket further comprises fastener receivers at the first side that cooperate with the fastener receivers through the C-shaped lip at the first lateral side of the lid and fastener receivers through the connector portion of the hinge to receive fasteners, the fastener receivers at the first side of the hinge bracket extending through the first side, through the first surface of the first elongated slot, and through the second surface of the first elongated slot, so that the fasteners extend through the fastener receivers of the C-shaped lip at the first lateral side of the lid, through the first side of the hinge bracket, the first surface of the first elongated slot, the fastener receivers of the hinge, and through the second surface of the first elongated slot to fasten the lid, the hinge bracket, and the hinge together. In an embodiment, the hinge bracket further comprises fastener receivers at the second side that cooperate with the fastener receivers through the C-shaped lip at the second lateral side of the lid and fastener receivers through the connector portion of the second hinge to receive fasteners, the fastener receivers at the second side of the hinge bracket extending through the second side, through the first surface of the second elongated slot, and through the second surface of the second elongated slot, so that the fasteners extend through the fastener receivers of the C-shaped lip at the second lateral side of the lid, through the second side of the hinge bracket, the first surface of the second elongated slot, the fastener receivers of the second hinge, and through the second surface of the second elongated slot to fasten the lid, the hinge bracket, and the second hinge together. In an embodiment, the hinge bracket further includes a first indentation at least partially surrounding a hinge receiver receiving the hinge when the lid is in the closed position, and a second indentation at least partially surrounding a hinge receiver receiving the second hinge when the lid is in the closed position. In an embodiment, the hinge bracket further including an elongated flat surface at the bottom side that is coplanar with the top wall of the lid and facing downward when the lid is in the closed position, the elongated flat surface extending lengthwise from approximately the first elongated slot to the second elongated slot. In an embodiment, the cabinet has a top portion, and the lid has a first lateral side, a second lateral side, and a front side that are disposed above the top portion of the cabinet when the lid is in the closed position.

In at least another aspect, a laundry appliance comprises: a cabinet having a midline; a chamber disposed within the cabinet, and configured to hold an article of clothing for washing or drying; an opening into the chamber; a lid selectively movable to, from, and between a closed position that prevents access to the opening, and an open position that allows access to the opening; a hinge receiver coupled to the cabinet, the hinge receiver including an inner chamber with an inner surface; a hinge including: a cam at a first end that is disposed in the inner chamber of the hinge receiver; and a connecter portion operably connected to the lid; wherein, when the lid is in the closed position, the cam is not abutting the inner surface of the hinge receiver; and wherein, when the lid is in the open position, the cam abuts the inner surface of the hinge receiver and the inner surface prevents the cam and the lid from rotating past the open position. In an embodiment, the hinge receiver further includes a first side wall, a second side wall opposing the first side wall, and a forward wall that transitions into a top wall via an intermediary curved portion. In an embodiment, the first side wall, the second side wall, and the forward wall that transitions into the top wall define at least part of the inner chamber. In an embodiment, the forward wall that transitions into the top wall provides the inner surface abutting the cam of the hinge when the lid is in the open position. In an embodiment, the hinge receiver further includes a first curved surface and a second curved surface that is parallel to the first curved surface upon which the hinge rotates when the lid transitions from the closed position to the open position. In an embodiment, the first side wall provides the first curved surface, and the second side wall provides the second curved surface.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A laundry appliance comprising:

a cabinet comprising a midline;

a chamber disposed within the cabinet, the chamber configured to hold an article of clothing for washing or drying;

an opening into the chamber;

a lid selectively movable to, from, and between a closed position that prevents access to the opening, and an open position that allows access to the opening, the lid comprising a C-shaped lip having an edge that extends inward when the lid is in the closed position creating a space between a top wall of the lid and the edge of the C-shaped lip, and fastener receivers through the C-shaped lip;

a hinge comprising:

a first end extending laterally into a hinge receiver of the cabinet in a direction towards the midline of the cabinet;

a connecter portion comprising fastener receivers, the connector portion extending at least approximately orthogonally to the first end; and a curved portion between the first end and the connector portion, the curved portion extending laterally further away from the midline than the connector portion; and a hinge bracket coupling the hinge to the lid, the hinge bracket comprising:

an elongated slot receiving the connector portion of the hinge;

first fastener receivers extending from the elongated slot laterally inward toward the midline to a first side of the hinge bracket, the first fastener receivers configured to cooperate with the fastener receivers of the hinge to receive fasteners that fasten the hinge to the hinge bracket;

second fastener receivers disposed at a second side of the hinge bracket, which second side is an opposite side of the hinge bracket as the first side of the hinge bracket, the second fastener receivers extending laterally inward toward the midline from the second side and configured to cooperate with the fastener receivers through the C-shaped lip of the lid to receive fasteners fastening the lid to the hinge bracket; and an indented portion formed laterally away from the elongated slot and facing the curved portion of the hinge.

2. The laundry appliance of claim 1, wherein, the first fastener receivers and the second fastener receivers of the hinge bracket are parallel but not collinear.

3. The laundry appliance of claim 1, wherein, the hinge bracket further comprises a bottom side that faces downward when the lid is in the closed position and an opening into the elongated slot that is disposed at the bottom side.

4. The laundry appliance of claim 1, wherein, the second side of the hinge bracket is nested into the C-shaped lip of the lid.

5. The laundry appliance of claim 1, wherein the cabinet comprises a top portion; and the lid comprises a first lateral side, a second lateral side, and a front side that are disposed above the top portion of the cabinet when the lid is in the closed position.

6. The laundry appliance of claim 1, wherein, the top wall, the C-shaped lip, and the edge of the C-shaped lip of the lid are adjacent to the hinge bracket.

7. The laundry appliance of claim 1, wherein, the curved portion of the hinge projects laterally outward from the perspective of the midline toward the C-shaped lip of the lid.

8. A laundry appliance comprising:

a cabinet comprising a midline;

a chamber disposed within the cabinet, the chamber configured to hold an article of clothing for washing or drying;

an opening into the chamber;

a lid selectively movable to, from, and between a closed position that prevents access to the opening, and an open position that allows access to the opening, the lid comprising (i) a top wall, (ii) a C-shaped lip having an edge that extends inward when the lid is in the closed position creating a space between the top wall of the lid and the edge of the C-shaped lip, and (iii) fastener receivers through the C-shaped lip;

a hinge comprising:

a first end extending laterally into a hinge receiver of the cabinet in a direction towards the midline of the cabinet;

a connecter portion comprising fastener receivers, the connector portion extending at least approximately orthogonally to the first end; and a curved portion between the first end and the connector portion; and a hinge bracket, at least a portion of which is disposed in the space of the lid, coupling the hinge to the lid, the hinge bracket comprising:

a bottom side that face the edge of the C-shaped lid;

a top side that faces the top wall of the lid;

an elongated slot receiving the connector portion of the hinge, the elongated slot comprising a first surface opposing a second surface, the connector portion of the hinge disposed between the first surface and the second surface; and fastener receivers that cooperate with the fastener receivers through the C-shaped lip to receive fasteners to fasten the lid and the hinge bracket together.

9. The laundry appliance of claim 8, wherein the hinge bracket further comprises snap-fit features; and the lid further comprises snap-fit receivers through the C-shaped lip receiving the snap-fit features of the hinge bracket.

10. The laundry appliance of claim 8, wherein the cabinet further comprises a top portion; and the lid further comprises a first lateral side, a second lateral side, and a front side that are disposed above the top portion of the cabinet when the lid is in the closed position.

11. The laundry appliance of claim 8, wherein the hinge bracket further comprises a first side that faces toward the midline, and a second side that faces the C-shaped lip of the lid;

the fastener receivers of the hinge bracket extend from the second side, through the first surface of the elongated slot, and through the second surface of the elongated slot; and the fasteners extend through the fastener receivers of the lid, through the second side of the hinge bracket, through the first surface of the elongated slot of the hinge bracket, through the fastener receivers of the hinge, and through the second surface of the elongated slot of the hinge bracket, thus fastening the lid, the hinge bracket, and the hinge together.

12. The laundry appliance of claim 11, wherein the cabinet further comprises a top portion; and the lid further comprises a first lateral side, a second lateral side, and a front side that are disposed above the top portion of the cabinet when the lid is in the closed position.

13. The laundry appliance of claim 8, wherein the hinge bracket further comprises a first side that faces toward the midline, and a second side that faces the C-shaped lip of the lid;

the fastener receivers of the hinge bracket are open at the bottom side of the hinge bracket and extend toward the top side of the hinge bracket;

the fastener receivers of the lid are disposed at a portion of the C-shaped lip that is parallel to the top wall of the lid;

the fasteners extend through the fastener receivers of the lid and through the fastener receivers open at the bottom side of the hinge bracket thus fastening the hinge bracket and the lid togther;

the hinge bracket further comprises second fastener receivers that extend from the first side of the hinge bracket, through the second surface of the elongated slot of the hinge bracket, and through the first surface of the elongated slot of the hinge bracket;

the laundry appliance further comprises additional fasteners extending through the second fastener receivers of the hinge bracket at the first side, through the second surface of the elongated slot of the hinge bracket, through the fastener receivers of the hinge, and through the first surface of the elongated slot of the hinge bracket, thus fastening the hinge bracket and the hinge together; and the second fastener receivers of the hinge bracket extend orthogonally to the fastener receivers of the hinge bracket.

14. The laundry appliance of claim 8 further comprising:

a second hinge comprising:

a first end extending laterally into a second hinge receiver of the cabinet in a direction towards the midline of the cabinet;

a connecter portion comprising fastener receivers, the connector portion extending at least approximately orthogonally relative to the first end; and a curved portion between the first end and the connector portion;

wherein, the lid further comprises (i) a first lateral side and a second lateral side, with the C-shaped lip of the lid disposed at each of the first lateral side and the second lateral side of the lid, (ii) additional fastener receivers through the C-shaped lip at the second lateral side of the lid;

wherein, the fastener receivers through the C-shaped lip are at the first lateral side of the lid;

wherein, the hinge bracket couples both the hinge and the second hinge to the lid, the hinge bracket further comprises a length that extends essentially from the first lateral side of the lid to the second lateral side of the lid;

wherein, (i) least a portion of the hinge bracket is disposed in the space of the lid at the first lateral side of the lid and in the space of the lid at the second lateral side of the lid, (ii) and the bottom side of the hinge bracket faces the edge of the C-shaped lip at both the first lateral side and the second lateral side of the lid, (iii) the hinge bracket further comprises a first side that faces the C-shaped lip of the lid at the first lateral side of the lid, and (iv) the hinge bracket further comprises a second side that faces the C-shaped lip of the lid at the second lateral side of the lid;

wherein, (i) the hinge bracket further comprises a second elongated slot receiving the connector portion of the second hinge, (ii) the second elongated slot of the hinge bracket comprises a first surface opposing a second surface, and (iii) the connector portion of the second hinge is disposed between the first surface and the second surface of the second elongated slot of the hinge bracket;

wherein, (i) the fastener receivers of the hinge bracket are disposed at the first side of the hinge bracket and cooperate with the fastener receivers through the C-shaped lip of the lid at the first lateral side of the lid and the fastener receivers through the connector portion of the hinge to receive fasteners, (ii) the fastener receivers at the first side of the hinge bracket extend through the first side of the hinge bracket, through the first surface of the elongated slot of the hinge bracket, and through the second surface of the elongated slot of the hinge bracket;

wherein, the fasteners extend through the fastener receivers of the C-shaped lip of the lid at the first lateral side of the lid, through the first side of the hinge bracket, through the first surface of the elongated slot of the hinge bracket, through the fastener receivers of the hinge, and through the second surface of the elongated slot of the hinge bracket, thus fastening the lid, the hinge bracket, and the hinge together; and wherein, (i) the hinge bracket further comprises additional fastener receivers at the second side of the hinge bracket that cooperate with the additional fastener receivers through the C-shaped lip at the second lateral side of the lid and the fastener receivers through the connector portion of the second hinge to receive additional fasteners, (ii) the additional fastener receivers at the second side of the hinge bracket extend through the second side of the hinge bracket, through the first surface of the second elongated slot of the hinge bracket, and through the second surface of the second elongated slot of the hinge bracket; and wherein, the laundry appliance further comprises the additional fasteners, and the additional fasteners extend through the additional fastener receivers of the C-shaped lip of the lid at the second lateral side of the lid, through the second side of the hinge bracket, through the first surface of the second elongated slot of the hinge bracket, through the fastener receivers of the second hinge, and through the second surface of the second elongated slot of the hinge bracket thus fastening the lid, the hinge bracket, and the second hinge together.

15. The laundry appliance of claim 14, wherein, the hinge bracket further comprises:

a first indentation that at least partially surrounds the hinge receiver receiving the hinge, when the lid is in the closed position; and a second indentation that at least partially surrounds the second hinge receiver receiving the second hinge, when the lid is in the closed position.

16. The laundry appliance of claim 14, wherein, the hinge bracket further comprises an elongated flat surface at the bottom side of the hinge bracket that is coplanar with the top wall of the lid and faces downward when the lid is in the closed position, the elongated flat surface extending lengthwise from approximately the elongated slot of the hinge bracket to the second elongated slot of the hinge bracket.

17. The laundry appliance of claim 16, wherein, the hinge bracket further comprises consumer instructions or consumer warnings on the elongated flat surface.

18. A laundry appliance comprising:

a cabinet comprising a midline, a top portion, and a slot disposed at the top portion;

a chamber disposed within the cabinet, the chamber configured to hold an article of clothing for washing or drying;

an opening into the chamber;

a lid selectively movable to, from, and between a closed position that prevents access to the opening, and an open position that allows access to the opening;

a hinge receiver disposed within the slot of the cabinet, the hinge receiver comprising an inner chamber with an inner surface and snap-fit portions that are received by the slot of the cabinet;

a hinge comprising:

a cam at a first end that is disposed in the inner chamber of the hinge receiver; and a connecter portion operably connected to the lid;

wherein, when the lid is in the closed position, the cam is not abutting the inner surface of the hinge receiver; and wherein, when the lid is in the open position, the cam abuts the inner surface of the hinge receiver and the inner surface prevents the cam and the lid from rotating past the open position.

19. The laundry appliance of claim 18, wherein the hinge receiver further comprises a first side wall, a second side wall opposing the first side wall, and a forward wall that transitions into a top wall via an intermediary curved portion;

the first side wall, the second side wall, and the forward wall of the hinge receiver that transitions into the top wall define at least part of the inner chamber; and the forward wall of the hinge receiver that transitions into the top wall provides the inner surface abutting the cam of the hinge when the lid is in the open position.

20. The laundry appliance of claim 19, wherein the hinge receiver further comprises a first curved surface into the first side wall and a second curved surface into the second side wall that is parallel to the first curved surface, and the first end of the hinge rotates upon the first curved surface and the second curved surface of the hinge receiver when the lid transitions from the closed position to the open position.

* * * * *